US011600213B2

(12) United States Patent
Hwang et al.

(10) Patent No.: US 11,600,213 B2
(45) Date of Patent: Mar. 7, 2023

(54) LEVEL SHIFTER, GATE DRIVING CIRCUIT, AND DISPLAY DEVICE

(71) Applicant: LG DISPLAY CO., LTD., Seoul (KR)

(72) Inventors: Sujin Hwang, Gyeonggi-do (KR); MiYoung Son, Gyeonggi-do (KR); EungKyu Kim, Gyeonggi-do (KR); HongJae Shin, Seoul (KR); MinKyu Chang, Incheon (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/542,583

(22) Filed: Dec. 6, 2021

(65) Prior Publication Data

US 2022/0208058 A1 Jun. 30, 2022

(30) Foreign Application Priority Data

Dec. 24, 2020 (KR) ..... 10-2020-0183863

(51) Int. Cl.
*G09G 3/20* (2006.01)

(52) U.S. Cl.
CPC ..... *G09G 3/20* (2013.01); *G09G 2310/0278* (2013.01); *G09G 2310/0289* (2013.01); *G09G 2310/08* (2013.01)

(58) Field of Classification Search
CPC ..... G09G 3/20; G09G 2310/0278; G09G 2310/0289; G09G 2310/08
See application file for complete search history.

(56) References Cited

U.S. PATENT DOCUMENTS

2018/0025696 A1* 1/2018 Su ..... G09G 3/20 345/213
2020/0219576 A1* 7/2020 Yao ..... G09G 3/20
2020/0357319 A1* 11/2020 Xu ..... G09G 3/20
2020/0357365 A1* 11/2020 Endo ..... G09G 5/393

FOREIGN PATENT DOCUMENTS

CN 106023941 B 5/2018
EP 3438963 A1 2/2019
KR 10-1510879 B1 4/2015
TW 201303822 A 1/2013

OTHER PUBLICATIONS

GB Combined Search and Examination Report issued in Patent Application No. 2117801.7, dated May 16, 2022 (7 pages).
Indian First Examination Report dated Jul. 11, 2022 issued in counterpart Patent Application No. 202114057228 (7 pages).
Taiwanese Office Action dated Oct. 14, 2022 issued in Patent Application No. 110146932 w/English Translation (7 pages).

* cited by examiner

*Primary Examiner* — Sejoon Ahn
(74) *Attorney, Agent, or Firm* — Polsinelli PC

(57) ABSTRACT

A display device includes a level shifter and a gate driving circuit that can reduce differences in characteristics among gate signals to improve image quality by controlling a signal waveform of a first clock signal of the m number of clock signals different from a signal waveform of an m-th clock signal when m number of gate signals is output by using m number of clock signals.

23 Claims, 44 Drawing Sheets

LEVEL SHIFTER, GATE DRIVING CIRCUIT, AND DISPLAY DEVICE

CROSS-REFERENCE TO RELATED APPLICATION

This application claims the priority of Korean Patent Application No. 10-2020-0183863, filed on Dec. 24, 2020, which is hereby incorporated by reference in its entirety.

BACKGROUND

Field of the Disclosure

The present disclosure relates to level shifters, gate driving circuits and display devices having the same.

Description of the Background

As the advent of information society, there have been growing needs for display devices for displaying images. To meet such needs, various types of display devices, such as a Liquid Crystal Display (LCD) device, an Electroluminescence Display (ELD) device including a Quantum-dot Light Emitting Display device, and an Organic Light Emitting Display (e.g., OLED) device, and the like, have been developed and widely used.

Generally, display devices charge a capacitor disposed in each of a plurality of sub-pixels arranged on a display panel and use the charged capacitance for display driving. However, in such typical display devices, such a capacitor in each sub-pixel can be insufficiently charged, and thereby, image quality can be deteriorated.

In typical display devices, if a size of the non-display area of a display panel can be reduced, design freedom of the display device can be increased and design quality can be improved. However, since various lines and circuit elements are arranged in the non-display area of the display panel, in actual, it is not easy to reduce the size of the non-display area of the display panel.

In addition, in such typical display devices, an insufficient charging time can cause image quality to become poor, and further, gate driving can malfunction due to differences in characteristics of gate signals, which can lead image quality to become poor.

SUMMARY

Accordingly, the present disclosure is to provide a level shifter, a gate driving circuit, and a display device, which are capable of reducing differences in characteristics between gate signals, and thereby improving image quality.

The present disclosure is also to provide a level shifter capable of variously controlling rising characteristics and falling characteristics of clock signals, and a gate driving circuit and a display device that use the level shifter.

Further, the present disclosure is to provide a level shifter, a gate driving circuit, and a display device, which are capable of reducing a size of an area in which the gate driving circuit is disposed even when the gate driving circuit is embedded in a display panel as an embedded type, and reducing differences in characteristics between gate signals.

According to aspects of the present disclosure, a display device is provided that includes a substrate, m number of gate lines disposed over the substrate, where m is a natural number of 2 or more, and a gate driving circuit that is disposed over, or connected to, the substrate, and capable of supplying m number of gate signals based on m number of inputted clock signals to m number of gate lines.

The gate driving circuit may include m number of output buffer circuits capable of outputting the m number of gate signals based on the m number of clock signals, and a control circuit capable of controlling the m output buffer circuits.

Each of the m number of output buffer circuits may include a pull-up transistor and a pull-down transistor, and a point at which the pull-up transistor and the pull-down transistor are connected may be electrically connected with a corresponding gate line of the m number of gate lines.

All gate nodes of the respective pull-up transistors included in the m number of output buffer circuits may be electrically connected, and all gate nodes of the respective pull-down transistors included in the m number of output buffer circuits may be electrically connected.

A signal waveform of at least one of them number of clock signals may be different from a signal waveform of another clock signal of the m number of clock signals.

The m number of gate signals may include a first gate signal having a turn-on level voltage duration at the earliest timing and an m-th gate signal having a turn-on level voltage duration at the latest timing.

The m number of clock signals may include a first clock signal corresponding to the first gate signal, and an m-th clock signal corresponding to the m-th gate signal.

A falling length of the first clock signal may be longer than a falling length of the m-th clock signal. In this case, a difference between a falling length of the first gate signal and a falling length of the m-th gate signal may be smaller than a difference between the falling length of the first clock signal and the falling length of the m-th clock signal.

A rising length of the m-th clock signal may be longer than a rising length of the first clock signal. In this case, a difference between a rising length of the first gate signal and a rising length of the m-th gate signal may be smaller than a difference between the rising length of the first clock signal and the rising length of the m-th clock signal.

The display device according to aspects of the present disclosure may further include a level shifter for outputting m number of clock signals according to a clock difference control signal.

In the display device according to aspects of the present disclosure, m may be 2 or 4.

According to aspects of the present disclosure, a gate driving circuit is provided that includes m number of output buffer circuits capable of outputting m number of gate signals based on m number of clock signals, and a control circuit capable of controlling the m output buffer circuits.

Each of the m number of output buffer circuits may include a pull-up transistor and a pull-down transistor, and a point at which the pull-up transistor and the pull-down transistor are connected may be electrically connected with a corresponding gate line of the m number of gate lines.

All gate nodes of the respective pull-up transistors included in the m number of output buffer circuits may be electrically connected.

All gate nodes of the respective pull-down transistors included in the m number of output buffer circuits may be electrically connected.

A signal waveform of at least one of them number of clock signals may be different from a signal waveform of another clock signal.

According to aspects of the present disclosure, a level shifter is provided that includes m number of clock output buffers for outputting m number of clock signals.

In the level shifter, m may be a natural number of 2 or more, and the m number of clock signals may include first to m-th clock signals.

A high level voltage duration of the first clock signal and a high level voltage duration of the second clock signal may partially overlap.

A signal waveform of the first clock signal of the m number of clock signals may be different from a signal waveform of the m-th clock signal.

The m number of clock output buffers may include a first clock output buffer for outputting the first clock signal and an m-th clock output buffer for outputting the m-th clock signal.

The first clock output buffer may include a first rising control circuit including N (N being a natural number of 2 or more) number of first rising control transistors electrically connected between a high level voltage node and a first clock output terminal, and a first falling control circuit including N number of first falling control transistors electrically connected between a low level voltage node and the first clock output terminal.

The m-th clock output buffer may include an m-th rising control circuit including N number of m-th rising control transistors electrically connected between the high level voltage node and an m-th clock output terminal, and an m-th falling control circuit including N number of m-th falling control transistors electrically connected between the low level voltage node and the m-th clock output terminal.

The respective turn-ons and/or turn-offs of N number of control transistors included in at least one of the first rising control circuit, the first falling control circuit, the m-th rising control circuit, and the m-th falling control circuit may be independently controlled.

A falling length of the first clock signal may be greater than a falling length of the m-th clock signal. In this case, the number of turned-on falling control transistors among the N number of first falling control transistors may be smaller than the number of turned-on falling control transistors among the N number of m-th falling control transistors.

A rising length of the m-th clock signal may be greater than a rising length of the first clock signal. In this case, the number of turned-on rising control transistors among the N number of m-th rising control transistors may be smaller than the number of turned-on rising control transistors among the N number of first rising control transistors.

According to aspects of the present disclosure, it is possible to provide a level shifter, a gate driving circuit, and a display device, which are capable of reducing differences in characteristics between gate signals, and thereby, improving image quality.

According to aspects of the present disclosure, it is possible to provide a level shifter capable of variously controlling rising characteristics and falling characteristics of clock signals, and a gate driving circuit and a display device that use the level shifter.

According to aspects of the present disclosure, it is possible to provide a level shifter, a gate driving circuit, and a display device, which are capable of reducing a size of an area in which the gate driving circuit is disposed even when the gate driving circuit is embedded in a display panel as an embedded type, and reducing differences in characteristics between gate signals.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Figure 1:
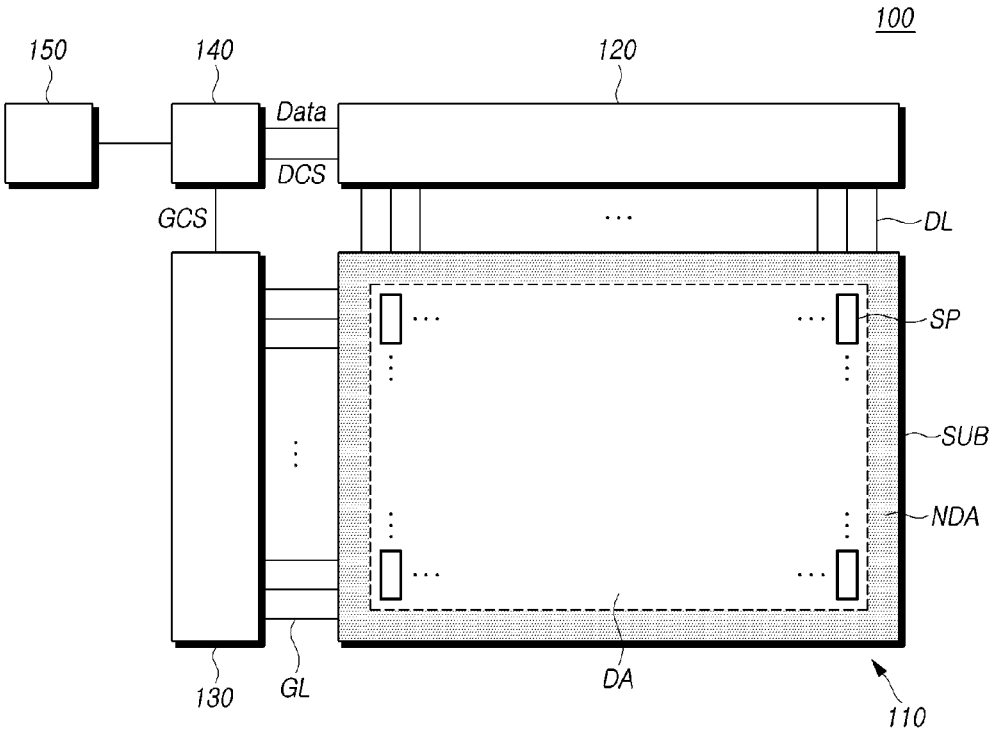
FIG. 1 illustrates a system configuration of a display device according to aspects of the present disclosure.

In the following description of examples or aspects of the present disclosure, reference will be made to the accompanying drawings in which it is shown by way of illustration specific examples or aspects that can be implemented, and in which the same reference numerals and signs can be used to designate the same or like components even when they are shown in different accompanying drawings from one another. Further, in the following description of examples or aspects of the present disclosure, detailed descriptions of well-known functions and components incorporated herein will be omitted when it is determined that the description may make the subject matter in some aspects of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 illustrates a system configuration of a display device 100 according to aspects of the present disclosure.

Referring to FIG. 1, the display device 100 according to aspects of the present disclosure includes a display panel 110 and a driving circuit for driving the display panel 110.

The driving circuit may include a data driving circuit 120, a gate driving circuit 130, and the like, and further include a controller 140 for controlling the data driving circuit 120 and the gate driving circuit 130.

The display panel 110 may include a substrate SUB, and signal lines such as a plurality of data lines DL, a plurality of gate lines GL, and the like disposed over the substrate SUB. The display panel 110 may include a plurality of sub-pixels SP connected to the plurality of gate lines GL and the plurality of data lines DL.

The display panel 110 may include a display area DA in which an image is displayed and a non-display area NDA in which an image is not displayed. In the display panel 110, the plurality of sub-pixels SP for displaying an image may be disposed in the display area DA, and the driving circuits 120, 130, and 140 may be electrically connected to, or mounted on, the non-display area NDA. A pad portion to which an integrated circuit or a printed circuit is connected may be disposed in the non-display area NDA of the display panel 110.

The data driving circuit 120 is a circuit for driving the plurality of data lines DL, and can supply data signals to the plurality of data lines DL. The gate driving circuit 130 is a circuit for driving the plurality of gate lines GL, and can supply gate signals to the plurality of gate lines GL. The controller 140 can supply a data control signal DCS to the data driving circuit 120 in order to control an operation timing of the data driving circuit 120. The controller 140 can supply a gate control signal GCS to the gate driving circuit 130 in order to control an operation timing of the gate driving circuit 130.

The controller 140 starts a scanning operation according to timings scheduled in each frame, converts image data inputted from other devices or other image providing sources (e.g. host systems) to a data signal form used in the data driving circuit 120 and then supplies image data DATA resulting from the converting to the data driving circuit 120, and controls the loading of the data to at least one pixel at a pre-configured time according to a scan timing.

The controller 140 can receive, in addition to input image data, several types of timing signals including a vertical synchronous signal VSYNC, a horizontal synchronous signal HSYNC, an input data enable signal DE, a clock signal CLK, and the like from other devices, networks, or systems (e.g. a host system 150).

In order to control the data driving circuit 120 and the gate driving circuit 130, the controller 140 can receive one or more of the timing signals such as the vertical synchronization signal VSYNC, the horizontal synchronization signal HSYNC, the input data enable signal DE, the clock signal CLK, and the like, generate several types of control signals DCS and GCS, and output the generated signals to the data driving circuit 120 and the gate driving circuit 130.

For example, in order to control the gate driving circuit 130, the controller 140 can output several types of gate control signals GCS including a gate start pulse GSP, a gate shift clock GSC, a gate output enable signal GOE, and the like.

Further, to control the data driving circuit 120, the controller 140 can output several types of data control signals DCS including a source start pulse SSP, a source sampling clock SSC, a source output enable (SOE) signal, and the like.

The controller 140 may be implemented in a separate component from the data driving circuit 120, or integrated with the data driving circuit 120 and implemented into an integrated circuit.

The data driving circuit 120 can drive a plurality of data lines DL by receiving image data DATA from the controller 140 and supplying data voltages to the plurality of data lines DL. Here, the data driving circuit 120 may also be referred to as a source driving circuit.

The data driving circuit 120 may include one or more source driver integrated circuits SDIC.

Each source driver integrated circuit SDIC may include a shift register, a latch circuit, a digital-to-analog converter DAC, an output buffer, and the like. In some instances, each source driver integrated circuit SDIC may further include an analog to digital converter ADC.

In some aspects, each source driving circuit SDIC may be connected to the display panel 110 in a tape automated bonding (TAB) type, or connected to a conductive pad such as a bonding pad of the display panel 110 in a chip on glass (COG) type or a chip on panel (COP) type, or connected to the display panel 110 in a chip on film (COF) type.

The gate driving circuit 130 can output a gate signal of a turn-on level voltage or a gate signal of a turn-off level voltage according to the control of the controller 140. The gate driving circuit 130 can sequentially drive a plurality of gate lines GL by sequentially supplying the gate signals of the turn-on level voltage to the plurality of gate lines GL.

In some aspects, the gate driving circuit 130 may be connected to the display panel 110 in the tape automated bonding (TAB) type, or connected to a conductive pad such as a bonding pad of the display panel 110 in the chip on glass (COG) type or the chip on panel (COP) type, or connected to the display panel 110 in the chip on film (COF) type. In another aspect, the gate driving circuit 130 may be located in the non-display area NDA of the display panel 110 in a gate in panel (GIP) type. The gate driving circuit 130 may be disposed on or over a substrate SUB, or connected to the substrate SUB. That is, in the case of the GIP type, the gate driving circuit 130 may be disposed in the non-display area NDA of the substrate SUB. The gate driving circuit 130 may be connected to the substrate SUB in the case of the chip on glass (COG) type, the chip on film (COF) type, or the like.

At least one of the data driving circuit 120 and the gate driving circuit 130 may be disposed in the display area DA. For example, at least one of the data driving circuit 120 and the gate driving circuit 130 may be disposed not to overlap sub-pixels SP, or disposed to overlap one or more, or all, of the sub-pixels SP.

When a specific gate line is selectively driven by the gate driving circuit 130, the data driving circuit 120 can convert image data DATA received from the controller 140 into data voltages in an analog form and supplies the data voltages resulting from the converting to a plurality of data lines DL.

The data driving circuit 120 may be located on, but not limited to, only one portion (e.g., an upper portion or a lower portion) of the display panel 110. In some aspects, the data driving circuit 120 may be located on, but not limited to, two portions (e.g., an upper portion and a lower portion) of the panel 110 or at least two of four portions (e.g., the upper portion, the lower portion, a left side, and a right side) of the panel 110 according to driving schemes, panel design schemes, or the like.

The gate driving circuit 130 may be located on, but not limited to, only one portion (e.g., a left side or a right side) of the display panel 110. In some aspects, the gate driving circuit 130 may be located on, but not limited to, two portions (e.g., a left side and a right side) of the panel 110 or at least two of four portions (e.g., an upper portion, a lower portion, the left side, and the right side) of the panel 110 according to driving schemes, panel design schemes, or the like.

The controller 140 may be a timing controller used in the typical display technology or a control apparatus/device capable of additionally performing other control functionalities in addition to the typical function of the timing controller. In some aspects, the controller 140 may be one or more other control circuits different from the timing controller, or a circuit or component in the control apparatus/device. The controller 140 may be implemented using various circuits or electronic components such as an integrated circuit (IC), a field programmable gate array (FPGA), an application specific integrated circuit (ASIC), a processor, and/or the like.

The controller 140 may be mounted on a printed circuit board, a flexible printed circuit, or the like, and may be electrically connected to the data driving circuit 120 and the gate driving circuit 130 through the printed circuit board, the flexible printed circuit, or the like.

The controller 140 may transmit signals to, and receive signals from, the data driving circuit 120 via one or more predetermined interfaces. In some aspects, such interfaces may include a low voltage differential signaling (LVDS) interface, an EPI (Embedded Clock Point-Point Interface) interface, a serial peripheral interface (SPI), and the like.

The controller 140 may include a storage medium such as one or more registers.

The display device 100 according to aspects of the present disclosure may be a display including a backlight unit such as a liquid crystal display device, and the like, or may be a self-emissive display such as an organic light emitting diode (OLED) display, a quantum dot (QD) display, a micro light emitting diode (M-LED) display, and the like.

In case the display device 100 according to aspects of the present disclosure is the OLED display, each sub-pixel SP may include an OLED where the OLED itself emits light as a light emitting element. In case the display device 100 according to aspects of the present disclosure is the QD display, each sub-pixel SP may include a light emitting element including a quantum dot, which is a self-emissive semiconductor crystal. In case the display device 100 according to aspects of the present disclosure is the micro LED display, each sub-pixel SP may include a micro LED where the micro OLED itself emits light and which is based on an inorganic material as a light emitting element.

Figure 2A:
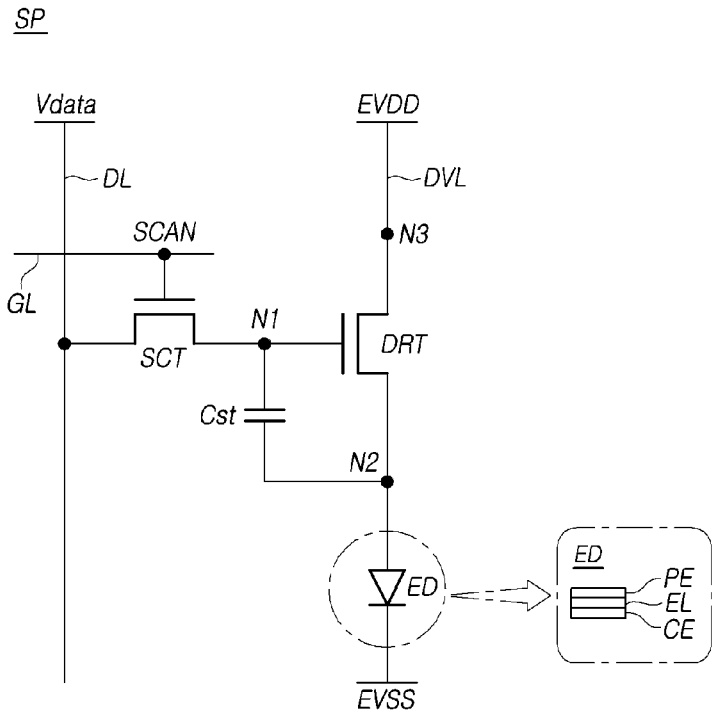
FIGS. 2A and 2B illustrate equivalent circuits for a sub-pixel of the display device according to aspects of the present disclosure.
Figure 2B:
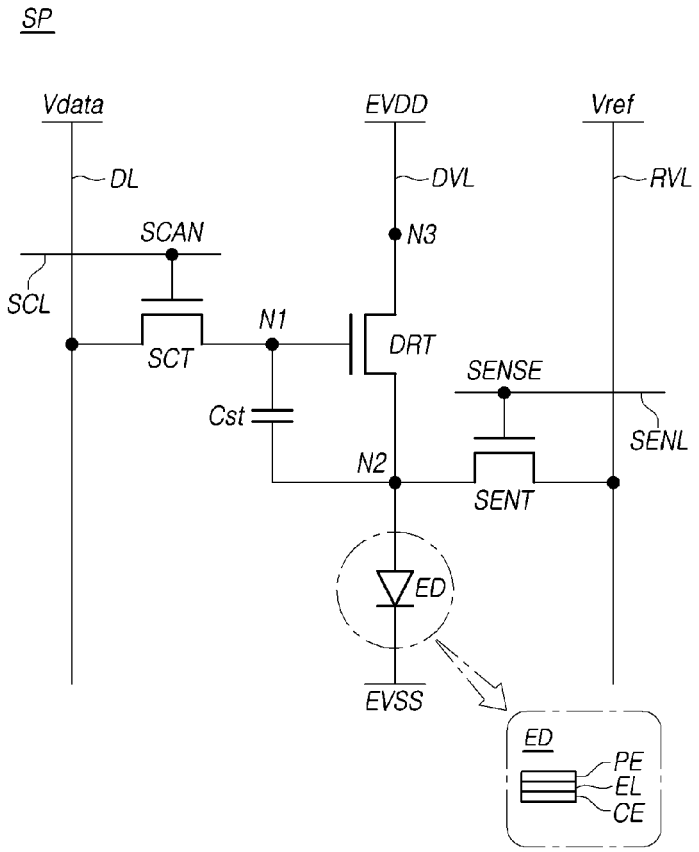

FIGS. 2A and 2B illustrate example equivalent circuits for a sub-pixel SP of the display device 100 according to aspects of the present disclosure.

Referring to FIG. 2A, each of a plurality of sub-pixels SP disposed in the display panel 110 of the display device 100 according to aspects of the present disclosure may include a light emitting element ED, a driving transistor DRT, a scan transistor SCT, and a storage capacitor Cst.

Referring to FIG. 2A, the light emitting element ED may include a pixel electrode PE and a common electrode CE, and include an emission layer EL located between the pixel electrode PE and the common electrode CE.

The pixel electrode PE of the light emitting element ED may be an electrode disposed in each sub-pixel SP, and the common electrode CE may be an electrode commonly disposed in all or some of the sub-pixels SP. Here, the pixel electrode PE may be an anode electrode and the common electrode CE may be a cathode electrode. In another aspect, the pixel electrode PE may be the anode electrode and the common electrode CE may be the cathode electrode.

In one aspect, the light emitting element ED may be an organic light emitting diode (OLED), a light emitting diode (LED), a quantum dot light emitting element or the like.

The driving transistor DRT may be a transistor for driving the light emitting element ED, and may include a first node N1, a second node N2, a third node N3, and the like.

The first node N1 of the driving transistor DRT may be a gate node of the driving transistor DRT, and may be electrically connected to a source node or a drain node of the scan transistor SCT. The second node N2 of the driving transistor DRT may be a source node or a drain node of the driving transistor DRT. The second node N2 may be also electrically connected to a source node or a drain node of a sensing transistor SENT, and connected to the pixel electrode PE of the light emitting element ED. A third node N3 of the driving transistor DRT may be electrically connected to a driving voltage line DVL for supplying a driving voltage EVDD.

The scan transistor SCT can be controlled by a scan signal SCAN, which is a type of gate signal, and may be connected between the first node N1 of the driving transistor DRT and a data line DL. In other words, the scan transistor SCT can be turned on or off according to the scan signal SCAN supplied through a scan signal line SCL, which is a type of the gate line GL, and control an electrical connection between the data line DL and the first node N1 of the driving transistor DRT.

The scan transistor SCT can be turned on by a scan signal SCAN having a turn-on level voltage, and passes a data voltage Vdata supplied through the data line DL to the first node of the driving transistor DRT.

In one aspect, when the scan transistor SCT is an n-type transistor, the turn-on level voltage of the scan signal SCAN may be a high level voltage. In another aspect, when the scan transistor SCT is a p-type transistor, the turn-on level voltage of the scan signal SCAN may be a low level voltage.

The storage capacitor Cst may be connected between the first node N1 and the second node N2 of the driving transistor DRT. The storage capacitor Cst can store the amount of electric charge corresponding to a voltage difference between both terminals and maintain the voltage difference between both terminals for a predetermined frame time. Accordingly, a corresponding sub-pixel SP can emit light for the predetermined frame time.

Referring to FIG. 2B, each of the plurality of sub-pixels SP disposed in the display panel 110 of the display device 100 according to aspects of the present disclosure may further include a sensing transistor SENT.

The sensing transistor SENT can be controlled by a sense signal SENSE, which is a type of gate signal, and may be connected between the second node N2 of the driving transistor DRT and a reference voltage line RVL. In other words, the sensing transistor SENT can be turned on or off according to the sense signal SENSE supplied through a sense signal line SENL, which is another type of the gate line GL, and control an electrical connection between the reference voltage line RVL and the second node N2 of the driving transistor DRT.

The sensing transistor SENT can be turned on by a sense signal SENSE having a turn-on level voltage, and pass a reference voltage Vref transmitted through the reference voltage line RVL to the second node of the driving transistor DRT.

Further, the sensing transistor SENT can be turned on by the sense signal SENSE having the turn-on level voltage, and transmit a voltage at the second node N2 of the driving transistor DRT to the reference voltage line RVL.

In one aspect, when the sensing transistor SENT is an n-type transistor, the turn-on level voltage of the sense signal SENSE may be a high level voltage. In another aspect, when the sensing transistor SENT is a p-type transistor, the turn-on level voltage of the sense signal SENSE may be a low level voltage.

The function of the sensing transistor SENT transmitting the voltage at the second node N2 of the driving transistor DRT to the reference voltage line RVL may be used when driven to sense at least one characteristic value of the sub-pixel SP. In this case, the voltage transmitted to the reference voltage line RVL may be a voltage for calculating at least one characteristic value of the sub-pixel SP or a voltage in which the at least one characteristic value of the sub-pixel SP is reflected.

Herein, the at least one characteristic value of the sub-pixel SP may be a characteristic value of the driving transistor DRT or the light emitting element ED. The characteristic value of the driving transistor DRT may include a threshold voltage and/or mobility of the driving transistor DRT. The characteristic value of the light emitting element ED may include a threshold voltage of the light emitting element ED.

The driving transistor DRT, the scan transistor SCT, and the sensing transistor SENT may be n-type transistors, p-type transistors, or combinations thereof. Herein, for convenience of description, it is assumed that the driving transistor DRT, the scan transistor SCT, and the sensing transistor SENT are n-type transistors.

The storage capacitor Cst may be an external capacitor intentionally designed to be located outside of the driving transistor DRT, other than an internal capacitor, such as a parasitic capacitor (e.g., a Cgs, a Cgd), that may be formed between the gate node and the source node (or drain node) of the driving transistor DRT.

The scan signal line SCL and the sense signal line SENL may be different gate lines GL. In some aspects, the scan signal SCAN and the sense signal SENSE may be separate gate signals, and the on-off timing of the scan transistor SCT and the on-off timing of the sensing transistor SENT in one sub-pixel SP may be independent. That is, the on-off timing of the scan transistor SCT and the on-off timing of the sensing transistor SENT in one sub-pixel SP may be equal to, or different from, each other.

In another aspect, the scan signal line SCL and the sense signal line SENL may be the same gate line GL. That is, a gate node of the scan transistor SCT and a gate node of the sensing transistor SENT in one sub-pixel SP may be connected to one gate line GL. In this aspect, the scan signal SCAN and the sense signal SENSE may be the same gate signal, and the on-off timing of the scan transistor SCT and the on-off timing of the sensing transistor SENT in one sub-pixel SP may be the same.

It should be understood that the sub-pixel structures shown in FIGS. 2A and 2B are merely examples of possible sub-pixel structures for convenience of discussion, and aspects of the present disclosure may be implemented in any of various structures, as desired. For example, the sub-pixel SP may further include at least one transistor and/or at least one capacitor.

Further, although discussions on the sub-pixel structures in FIGS. 2A and 2B have been conducted based on the assumption that the display device 100 is a self-emissive display device, when the display device 100 is a liquid crystal display, each sub-pixel SP may include a transistor, a pixel electrode, and the like.

Figure 3:
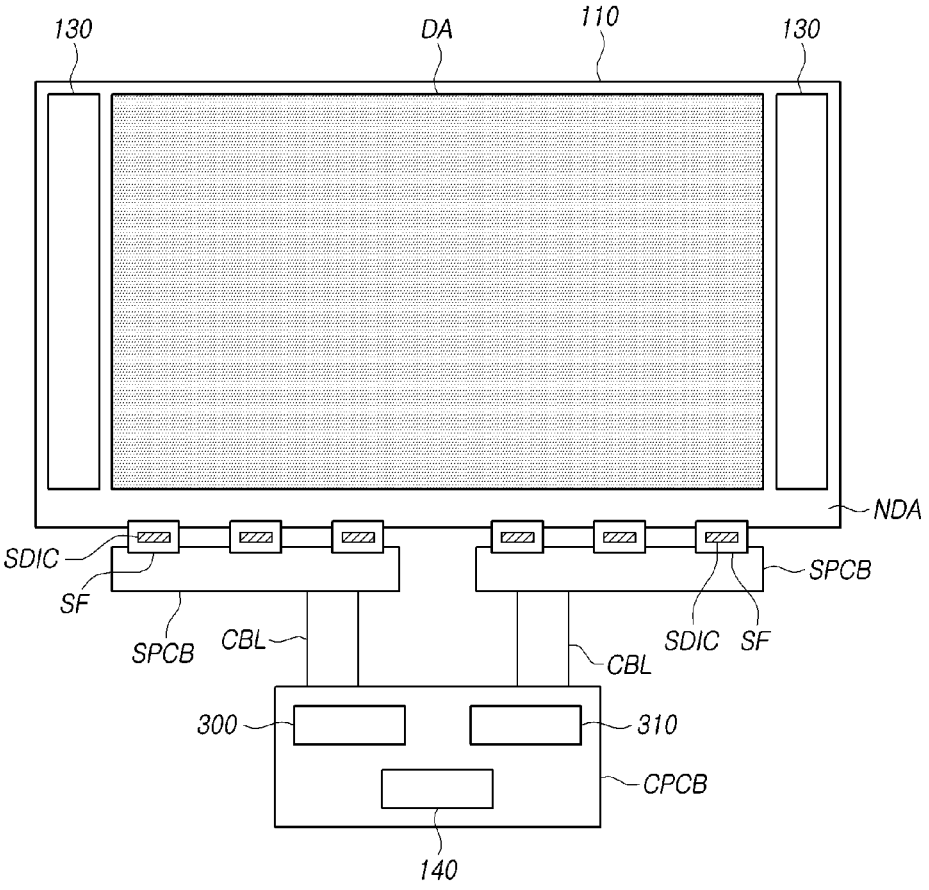
FIG. 3 illustrates an example system implementation of the display device according to aspects of the present disclosure.

FIG. 3 illustrates an example system implementation of the display device 100 according to aspects of the present disclosure.

Referring to FIG. 3, the display panel 110 may include a display area DA in which an image is displayed and a non-display area NDA in which an image is not displayed.

Referring to FIG. 3, when the data driving circuit 120 includes one or more source driver integrated circuits SDIC and is implemented in the chip on film (COF) type, each source driver integrated circuit SDIC may be mounted on a circuit film SF connected to the non-display area NDA of the display panel 110.

Referring to FIG. 3, the gate driving circuit 130 may be implemented in the gate in panel (GIP) type. In this aspect, the gate driving circuit 130 may be located in the non-display area NDA of the display panel 110. In another aspect, unlike the illustration in FIG. 3, the gate driving circuit 130 may be implemented in the chip on film (COF) type.

The display device 100 may include at least one source printed circuit board SPCB for a circuital connection between one or more source driver integrated circuits SDIC and other devices, components, and the like, and a control printed circuit board CPCB on which control components, and various types of electrical devices or components are mounted.

The circuit film SF on which the source driver integrated circuit SDIC is mounted may be connected to at least one source printed circuit board SPCB. That is, one side of the circuit film SF on which the source driver integrated circuit SDIC is mounted may be electrically connected to the display panel 110 and the other side thereof may be electrically connected to the source printed circuit board SPCB.

The controller 140 and the power management integrated circuit PMIC 310 may be mounted on the control printed circuit board CPCB. The controller 140 can perform an overall control function related to the driving of the display panel 110 and control operations of the data driving circuit 120 and the gate driving circuit 130. The power management integrated circuit 310 can supply various types of voltages or currents to the data driving circuit 120 and the gate driving circuit 130 or control various types of voltages or currents to be supplied.

A circuital connection between at least one source printed circuit board SPCB and the control printed circuit board CPCB may be performed through at least one connection cable CBL. The connection cable CBL may be, for example, a flexible printed circuit FPC, a flexible flat cable FFC, or the like.

At least one source printed circuit board SPCB and the control printed circuit board CPCB may be integrated and implemented into one printed circuit board.

The display device 100 according to aspects of the present disclosure may further include a level shifter 300 for adjusting a voltage level. In one aspect, the level shifter 300 may be disposed on the control printed circuit board CPCB or the source printed circuit board SPCB.

In the display device 100 according to aspects of the present disclosure, the level shifter 300 can supply signals required for gate driving to the gate driving circuit 130. In one aspect, the level shifter 300 can supply a plurality of clock signals to the gate driving circuit 130. Accordingly, the gate driving circuit 130 can supply a plurality of gate signals to a plurality of gate lines GL based on the plurality of clock signals input from the level shifter 300. The plurality of gate lines GL can carry the gate signals to the sub-pixels SP disposed in the display area DA of the substrate SUB.

Figure 4A:
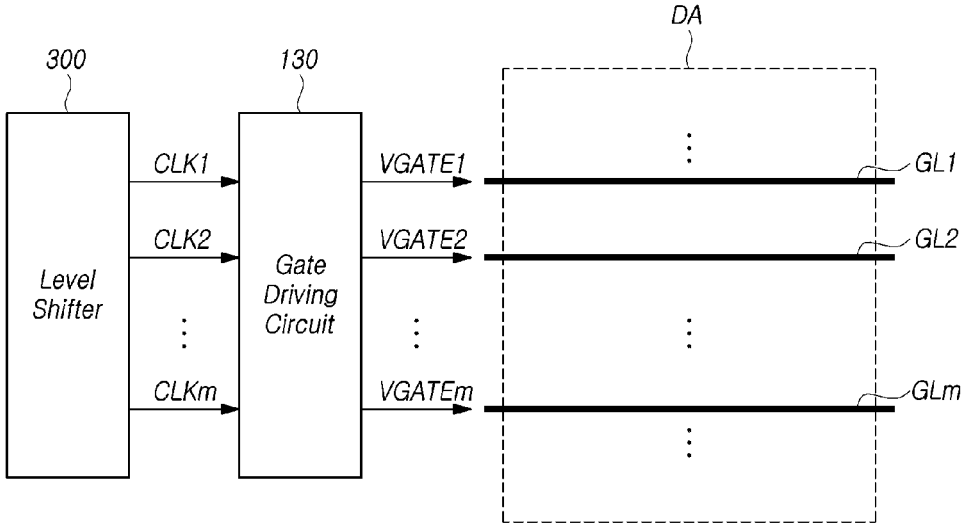
FIG. 4A illustrates an example gate signal output system of the display device according to aspects of the present disclosure.

FIG. 4A illustrates an example gate signal output system of the display device 100 according to aspects of the present disclosure.

Referring to FIG. 4A, the level shifter 300 can output m number of clock signals (CLK1 to CLKm) to the gate driving circuit 130. The gate driving circuit 130 can generate m number of gate signals (VGATE1 to VGATEm) based on the m number of clock signals (CLK1 to CLKm) and output the generated gate signals (VGATE1 to VGATEm) to m number of gate lines (GL1 to GLm).

The m number of gate lines (GL1 to GLm) can carry the m number of gate signals (VGATE1 to VGATEm) to sub-pixels SP disposed in the display area DA over the substrate SUB.

For example, the m number of gate lines (GL1 to GLm) may be scan signal lines SCL connected to the gate nodes of scan transistors SCT as illustrated in FIG. 2A or 2B, and the m number of gate signals (VGATE1 to VGATEm) may be scan signals SCAN applied to the gate nodes of the scan transistors SCT. A first gate signal VGATE1 of the m number of gate signals (VGATE1 to VGATEm) may be a scan signal SCAN applied to the respective gate nodes of scan transistors SCT included in each of sub-pixels SP disposed in a first sub-pixel row. A second gate signal VGATE2 of the m number of gate signals (VGATE1 to VGATEm) may be a scan signal SCAN applied to the respective gate nodes of scan transistors SCT included in each of sub-pixels SP disposed in a second sub-pixel row different from the first sub-pixel row.

In another example, the m number of gate lines (GL1 to GLm) may be sense signal lines SENL connected to the gate nodes of sensing transistors SENT as illustrated in FIG. 2B, and the m number of gate signals (VGATE1 to VGATEm) may be sense signals SENSE applied to the gate nodes of the sensing transistors SENT. A first gate signal VGATE1 of them number of gate signals (VGATE1 to VGATEm) may be a sense signal SENSE applied to the respective gate nodes of sense transistors SENT included in each of sub-pixels SP disposed in the first sub-pixel row. A second gate signal VGATE2 of the m number of gate signals (VGATE1 to VGATEm) may be a sense signal SENSE applied to the respective gate nodes of sense transistors SENT included in each of sub-pixels SP disposed in the second sub-pixel row different from the first sub-pixel row.

Figure 4B:
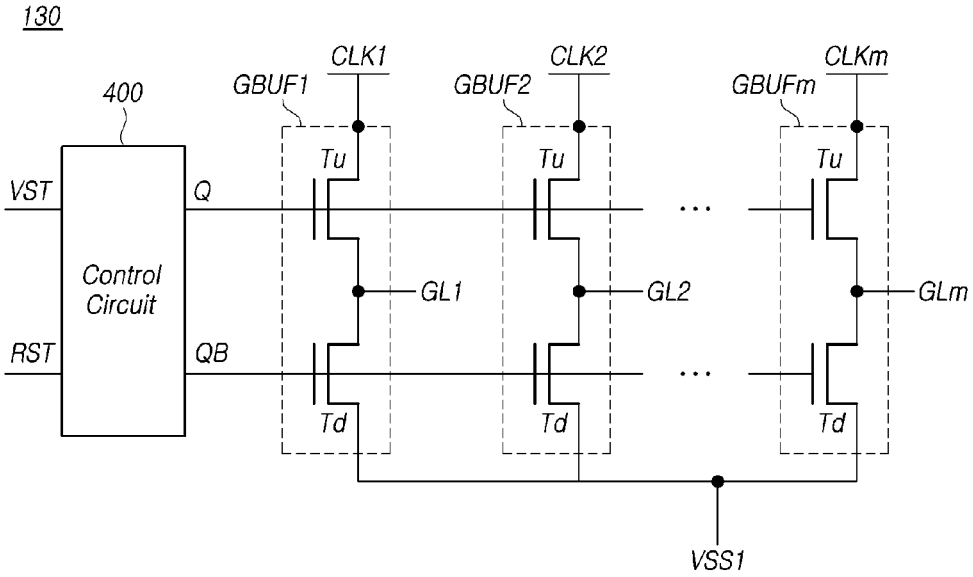
FIG. 4B illustrates an example gate driving circuit of the display device according to aspects of the present disclosure.

FIG. 4B illustrates an example gate driving circuit 130 of the display device according to aspects of the present disclosure.

Referring to FIG. 4B, the gate driving circuit 130 may include m number of output buffer circuits (GBUF1 to GBUFm) and a control circuit 400 capable of controlling m number of output buffer circuits (GBUF1 to GBUFm), where m may be a natural number of 2 or more.

The m number of output buffer circuits (GBUF1 to GBUFm) can receive m number of clock signals (CLK1 to CLKm) of a plurality of clock signals, and output m number of gate signals (VGATE1 to VGATEm) of a plurality of gate signals to m number of gate lines (GL1 to GLm) of a plurality of gate lines GL.

Each of the m number of output buffer circuits (GBUF1 to GBUFm) may include a pull-up transistor Tu and a pull-down transistor Td.

In each of the m number of output buffer circuits (GBUF1 to GBUFm), a point where the pull-up transistor Tu and the pull-down transistor Td are connected may be connected to a corresponding gate line of the m number of gate lines (GL1 to GLm).

The gate nodes of respective pull-up transistors Tu included in the m number of output buffer circuits (GBUF1 to GBUFm) may be commonly connected to one Q node Q in the control circuit 400. As such, a structure in which the gate nodes of the respective pull-up transistor Tu included in the m number of output buffer circuits (GBUF1 to GBUFm) are commonly connected to one Q node Q is referred to as a Q node sharing structure.

When the gate driving circuit 130 is formed in the gate in panel (GIP) type and is designed to have the Q node sharing structure, a size of a non-display area NDA in which the gate driving circuit 130 is disposed may be reduced. Here, the gate in panel type is also referred to as an embedded type.

In the Q node sharing structure, according to a voltage at one Q node Q, the respective pull-up transistors Tu included in the m number of output buffer circuits (GBUF1 to GBUFm) may turned on or turned off simultaneously, or nearly simultaneously.

The gate nodes of respective pull-down transistors Td included in them number of output buffer circuits (GBUF1 to GBUFm) may be commonly connected to one QB node QB in the control circuit 400. As such, a structure in which the gate nodes of the respective pull-down transistor Td included in the m number of output buffer circuits (GBUF1 to GBUFm) are commonly connected to one QB node QB is referred to as a QB node sharing structure.

In the QB node sharing structure, according to a voltage at one QB node QB, the respective pull-down transistors Td included in the m number of output buffer circuits (GBUF1 to GBUFm) may turned on or turned off simultaneously, or nearly simultaneously.

Figure 4C:
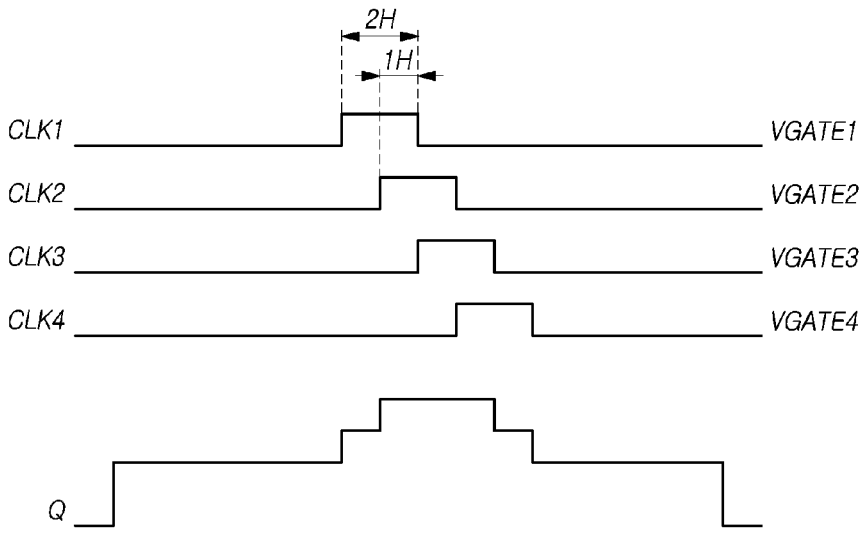
FIG. 4C illustrates clock signals and a voltage at a Q node in the display device according to aspects of the present disclosure.
Figure 4D:
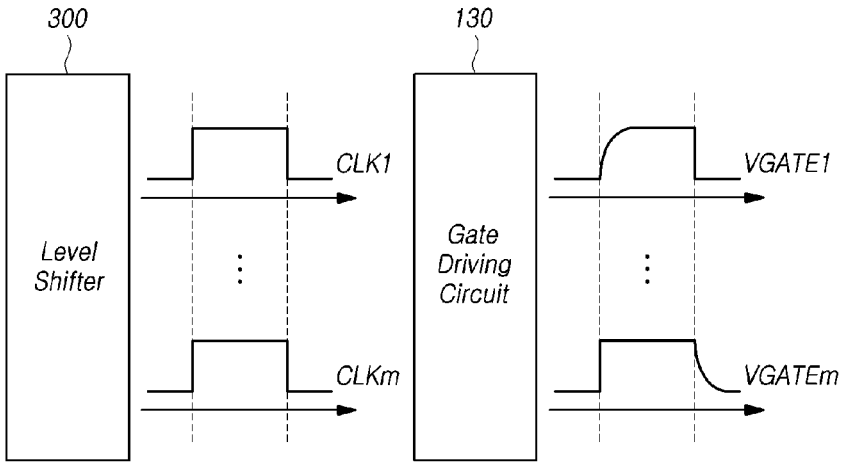
FIG. 4D illustrates characteristic differences between gate signals in the display device according to aspects of the present disclosure.

FIG. 4C illustrates clock signals (CLK1 to CLK4) and a voltage at the Q node in the display device 100 according to aspects of the present disclosure. FIG. 4D illustrates characteristic differences between gate signals in the display device 100 according to aspects of the present disclosure.

FIG. 4C is a diagram illustrating first to fourth clock signals (CLK1 to CLK4) and a voltage at the Q node when m is 4.

Respective high level voltage durations of m number of clock signals (CLK1 to CLKm) are placed at different timings in time, and respective turn-on level voltage durations (e.g., respective high level voltage durations) of m number of gate signals (VGATE1 to VGATEm) are placed at different times. However, in order to explain characteristics of the display device according to aspects of the present disclosure in terms of signal waveforms, in FIG. 4D, the respective high level voltage durations of the m number of clock signals (CLK1 to CLKm) are shifted at the same timing and displayed at the same timing, and the respective turn-on level voltage durations (e.g., respective high level voltage durations) of the m number of gate signals (VGATE1 to VGATEm) are shifted at the same timing and displayed at the same timing.

Referring to FIGS. 4C and 4D, the level shifter 300 can output m number of clock signals (CLK1 to CLKm) having an equal signal waveform. The gate driving circuit 130 can output m number of gate signals (VGATE1 to VGATEm) using the m number of clock signals (CLK1 to CLKm) having the equal signal waveform. That is, respective rising lengths of the m number of clock signals (CLK1 to CLKm) may be equal or differ from within a certain range. Respective falling lengths of the m number of clock signals (CLK1 to CLKm) may be equal or differ from within a certain range.

Referring to FIG. 4C, in the display device 100 according to aspects of the present disclosure, the gate driving circuit 130 can perform overlap gate driving.

Referring to FIG. 4C, when the gate driving circuit 130 performs the overlap gate driving, respective high level voltage durations of two clock signals may partially overlap. Accordingly, respective turn-on level voltage durations of two gate signals corresponding to consecutive driving timings may partially overlap.

For example, referring to FIG. 4C, a turn-on level voltage duration of a first gate signal VGATE1 and a turn-on level voltage duration of a second gate signal VGATE2 may partially overlap. A turn-on level voltage duration of a second gate signal VGATE2 and a turn-on level voltage duration of a third gate signal VGATE3 may partially overlap.

Turn-on level voltage durations of the m number of gate signals (VGATE1, VGATE2, . . . , VGATEm) may be high level voltage durations or low level voltage durations.

For example, referring to FIG. 4C, the turn-on level voltage durations of the m number of gate signals (VGATE1, VGATE2, . . . , VGATEm) may have a time period of 2 H. An overlapping length of the respective turn-on level voltage durations of the two gate signals may be a period of 1 H.

Referring to FIG. 4D, when the gate driving circuit 130 has the Q node sharing structure (as in FIG. 4B) and performs the overlap gate driving (as in FIG. 4C), a signal waveform of at least one of the m number of gate signals (VGATE1 to VGATEm) may be different from one or more signal waveforms of one or more other gate signals. Here, the signal waveform may include at least one of a rising length and a falling length.

Referring to FIG. 4D, a falling length of at least one of the m number of gate signals (VGATE1 to VGATEm) may be different from one or more falling lengths of one or more other gate signals. A rising length of at least one of them number of gate signals (VGATE1 to VGATEm) may be different from one or more rising lengths of one or more other gate signals.

Referring to FIG. 4D, the m number of gate signals (VGATE1, VGATE2, . . . , VGATEm) output from the gate driving circuit 130 having the Q node sharing structure may include a first gate signal VGATE1 having a turn-on level voltage duration at the earliest timing, and an m-th gate signal VGATEm having a turn-on level voltage duration at the latest timing.

Referring to FIG. 4D, m number of clock signals (CLK1 to CLKm) may include a first clock signal CLK1 corresponding to the first gate signal VGATE1 and a m-th clock signal CLKm corresponding to the m-th gate signal VGATEm.

Referring to FIG. 4D, among the first gate signal VGATE1 to the m-th gate signal VGATEm, the m-th gate signal VGATEm having the turn-on level voltage duration at the latest timing may have the worst falling characteristic. Accordingly, a falling length of the m-th gate signal VGATEm having the turn-on level voltage duration at the latest timing becomes greater than a falling length of the first gate signal VGATE1 having the turn-on level voltage duration at the earliest timing.

Referring to FIG. 4D, the first gate signal VGATE1 having the turn-on level voltage duration at the earliest timing may have the worst rising characteristic. Accordingly, a rising length of the first gate signal VGATE1 having the turn-on level voltage duration at the earliest timing becomes greater than a rising length of the m-th gate signal VGATEm having the turn-on level voltage duration at the latest timing.

The greater rising length of the first gate signal VGATE1 comparing with the rising length of the m-th gate signal VGATEm means a difference in rising characteristics between the gate signals (VGATE1 and VGATEm), and the greater falling length of the m-th gate signal VGATEm comparing with the falling length of the first gate signal VGATE1 means a difference in falling characteristics between the gate signals (VGATE1 and VGATEm).

The characteristic differences (rising characteristic differences, and falling characteristic differences) between gate signals (VGATE1 to VGATEm) may cause malfunction of transistors (e.g., scan transistors SCT, and/or sensing transistors SENT) to which the gate signals (VGATE1 to VGATEm) are applied, this leading image quality to be degraded.

To address these issues, through overlap gate driving performed by the display device 100 according to aspects of the present disclosure, a compensation scheme is provided for providing effects of both improving image quality by increasing a charging time that may be insufficient for charging in each sub-pixel, and reducing a size of the bezel area (non-display area NDA) of the display panel 110 through the Q node sharing structure, and for reducing characteristic differences between gate signals that may be caused. Hereinafter, this will be described in detail.

Figure 4E:
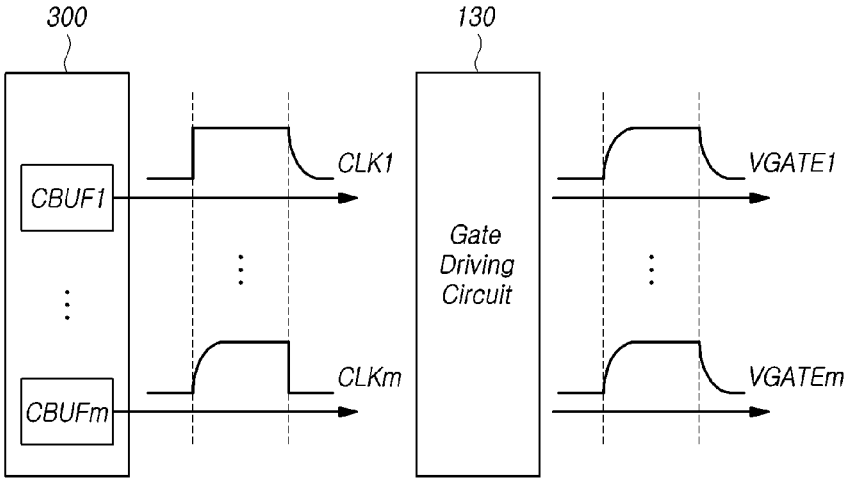
FIG. 4E illustrates compensation for characteristic differences between gate signals in the display device according to aspects of the present disclosure.

FIG. 4E illustrates compensation for characteristic differences between gate signals in the display device 100 according to aspects of the present disclosure.

Referring to FIG. 4E, the display device 100 according to aspects of the present disclosure can perform a clock signal control function in order to compensate for characteristic differences between the gate signals described with reference to FIG. 4D. According to this, a signal waveform of at least one of the m number of clock signals (CLK1 to CLKm) may be different from one or more signal waveforms of one or more other clock signals.

Referring to FIG. 4E, when the clock signal control function is performed to compensate for characteristic differences between gate signals in the display device 100, a falling length of a first clock signal CLK1 may become greater than a falling length of an m-th clock signal CLKm.

In turn, a difference between a falling length of an associated first gate signal VGATE1 and a falling length of an associated m-th gate signal VGATEm may be little or very little, or be smaller than a difference between the falling length of the first clock signal CLK1 and the falling length of the m-th clock signal CLKm.

When the clock signal control function is performed to compensate for characteristic differences between gate signals in the display device 100, a rising length of the m-th clock signal CLKm may become greater than a rising length of the first clock signal CLK1.

In turn, a difference between a rising length of the first gate signal VGATE1 and a rising length of the m-th gate signal VGATEm may be little or very little, or be smaller than a difference between the rising length of the first clock signal CLK1 and the rising length of the m-th clock signal CLKm.

The level shifter 300 can output m number of clock signals (CLK1 to CLKm) according to a clock difference control signal.

The level shifter 300 may include m number of clock output buffers for respectively outputting m number of clock signals (CLK1 to CLKm), where m may be a natural number of 2 or more.

The m number of clock signals (CLK1 to CLKm) may be first to m-th clock signals (CLK1 to CLKm).

Due to the overlap gate driving, a high level voltage duration of the first clock signal CLK1 and a high level voltage duration of the second clock signal CLK2 may partially overlap.

A signal waveform of the first clock signal CLK1 of the m number of clock signals (CLK1 to CLKm) may be different from a signal waveform of the m-th clock signal CLKm. Here, the signal waveform may include a falling length and a rising length, and at least one of a falling length and a rising length of the signal waveform of the first clock signal CLK1 may be different from at least one of a falling length and a rising length of the signal waveform of the m-th clock signal CLKm.

The m number of clock output buffers (CBUF1 to CBUFm) may include a first clock output buffer CBUF1 for outputting the first clock signal CLK1 and an m-th clock output buffer CBUFm for outputting the m-th clock signal CLKm.

The first clock output buffer CBUF1 may include a first rising control circuit including N (N being a natural number of 2 or more) number of first rising control transistors electrically connected between a high level voltage node and a first clock output terminal, and a first falling control circuit including N number of first falling control transistors electrically connected between a low level voltage node and the first clock output terminal.

The m-th clock output buffer CBUFm may include an m-th rising control circuit including N number of m-th rising control transistors electrically connected between the high level voltage node and an m-th clock output terminal, and an m-th falling control circuit including N number of m-th falling control transistors electrically connected between the low level voltage node and the m-th clock output terminal.

The respective turn-ons and/or turn-offs of N number of control transistors included in at least one of the first rising control circuit, the first falling control circuit, the m-th rising control circuit, and the m-th falling control circuit may be independently controlled.

A falling length of the first clock signal CLK1 may be greater than a falling length of the m-th clock signal CLKm. In this case, the number of turned-on falling control transistors among the N number of first falling control transistors may be smaller than the number of turned-on falling control transistors among the N number of m-th falling control transistors.

A rising length of the m-th clock signal CLKm may be greater than a rising length of the first clock signal CLK1. In this case, the number of turned-on rising control transistors among the N number of m-th rising control transistors may be smaller than the number of turned-on rising control transistors among the N number of first rising control transistors.

The m number of clock output buffers (CBUF1 to CBUFm) included in the level shifter 300 will be described in detail later with reference to FIG. 9, where m is 2 as an example.

In the QB node sharing structure, according to a voltage at one QB node QB, the respective pull-down transistors Td included in the m number of output buffer circuits (GBUF1 to GBUFm) may turned on or turned off simultaneously, or nearly simultaneously. In the gate driving circuit 130, m is a value representing a degree of sharing of a Q node Q, and may be the number of output buffer circuits (GBUF1 to GBUFm) sharing one Q node Q.

For example, m may be 2 or 4. Hereinafter, compensation for characteristic differences between gate signals when m is 2 will be described in more detail, and thereafter, compensation for characteristic differences between gate signals where m is 4 will be described in more detail.

Figure 5:
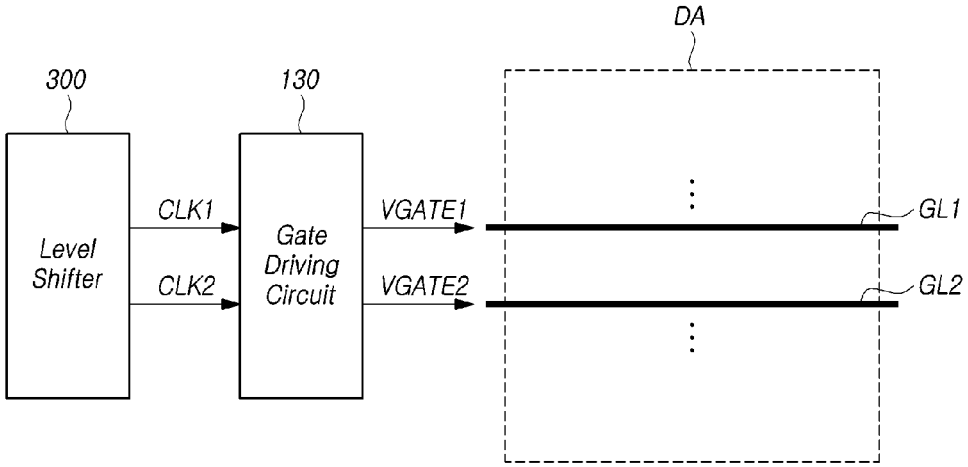
FIG. 5 illustrates an example gate signal output system of the display device according to aspects of the present disclosure.
Figure 6A:
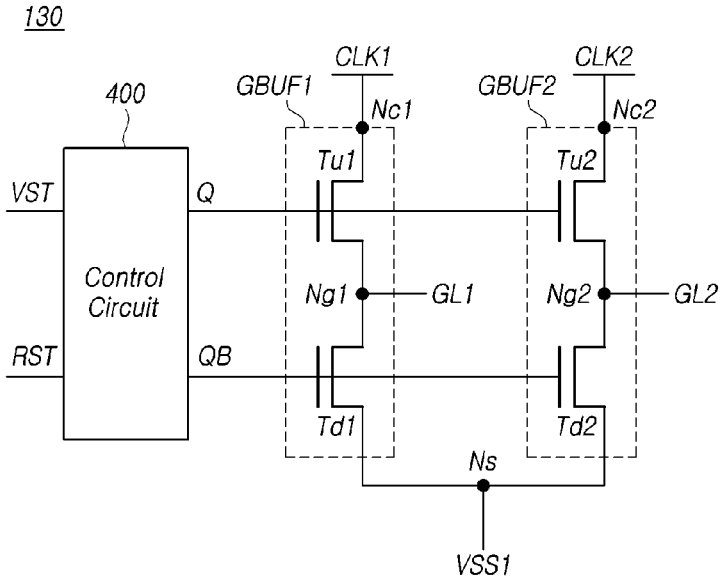
FIGS. 6A and 6B illustrate example gate driving circuits of the display device according to aspects of the present disclosure.
Figure 6B:
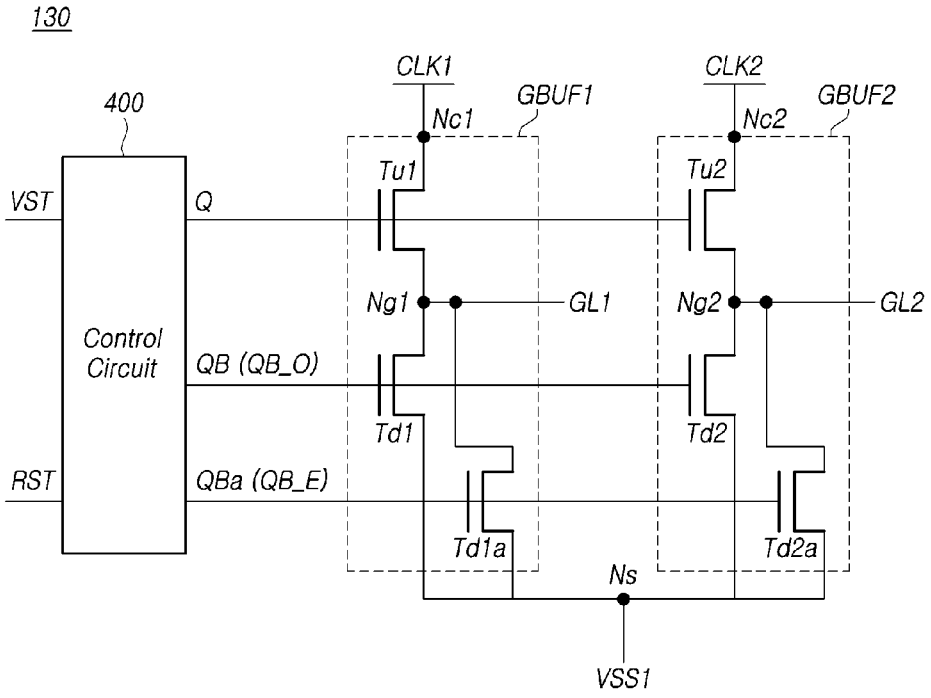

FIG. 5 illustrates an example gate signal output system of the display device 100 according to aspects of the present disclosure. FIGS. 6A and 6B illustrate example gate driving circuits 130 of the display device 100 according to aspects of the present disclosure.

Referring to FIGS. 5, 6A, and 6B, when m is 2, two output buffer circuits (GBUF1 and GBUF2) share one Q node Q.

When m is 2, m number of clock signals (CLK1 to CLKm) include first and second clock signals (CLK1 and CLK2), and m number of gate signals (VGATE1 to VGATEm) include first and second gate signals (VGATE1 and VGATE2).

Referring to FIGS. 5, 6A, and 6B, the level shifter 300 can output two clock signals (CLK1 and CLK2) of a plurality of clock signals. Here, the two clock signals (CLK1 and CLK2) may be the first clock signal CLK1 and the second clock signal CLK2.

Referring to FIGS. 5, 6A, and 6B, the gate driving circuit 130 can receive two clock signals (CLK1 and CLK2) and output two gate signals (VGATE1 and VGATE2). That is, the gate driving circuit 130 can receive the first clock signal CLK1 and output the first gate signal VGATE1 to a first gate line GL1, and receive the second clock signal CLK2 and output the second gate signal VGATE2 to a second gate line GL2.

Referring to FIG. 6A, the gate driving circuit 130 may include a first output buffer circuit GBUF1, a second output buffer circuit GBUF2, a control circuit 400 capable of controlling the first output buffer circuit GBUF1 and the second output buffer circuit GBUF2, and the like.

The first output buffer circuit GBUF1 can output the first gate signal VGATE1 to the first gate line GL1 through a first gate output terminal Ng1 in response to (based on) the first clock signal CLK1 input to a first clock input terminal Nc1.

The second output buffer circuit GBUF2 can output the second gate signal VGATE2 to the second gate line GL2 through a second gate output terminal Ng2 in response to (based on) the second clock signal CLK2 input to a second clock input terminal Nc2.

The control circuit 400 can receive a start signal VST and a reset signal RST and control operations of the first output buffer circuit GBUF1 and the second output buffer circuit GBUF2.

The first output buffer circuit GBUF1 may include a first pull-up transistor Tu1 electrically connected between the first clock input terminal Nc1 and the first gate output terminal Ng1, and controlled by a voltage in a Q node Q, and a first pull-down transistor Td1 electrically connected between the first gate output terminal Ng1 and a base input terminal Ns to which a base voltage VSS1 is input, and controlled by a voltage at a QB node QB.

The second output buffer circuit GBUF2 may include a second pull-up transistor Tu2 electrically connected between the second clock input terminal Nc2 and the second gate output terminal Ng2, and controlled by a voltage in the Q node Q, and a second pull-down transistor Td2 electrically connected between the second gate output terminal Ng2 and the base input terminal Ns, and controlled by a voltage at the QB node QB.

Referring to FIG. 6A, the gate node of the first pull-up transistor Tu1 of the first output buffer circuit GBUF1 and the gate node of the second pull-up transistor Tu2 of the second output buffer circuit GBUF2 are electrically connected to the same Q node Q.

By a voltage at the Q node Q, the first pull-up transistor Tu1 of the first output buffer circuit GBUF1 and the second pull-up transistor Tu2 of the second output buffer circuit GBUF2 may be simultaneously, or nearly simultaneously, turned on or turned off.

The gate node of the first pull-down transistor Td1 of the first output buffer circuit GBUF1 and the gate node of the second pull-down transistor Td2 of the second output buffer circuit GBUF2 are electrically connected to the same QB node QB.

The first pull-down transistor Td1 of the first output buffer circuit GBUF1 and the second pull-down transistor Td2 of the second output buffer circuit GBUF2 may be simultaneously, or nearly simultaneously, turned on or turned off according to a voltage at the shared QB node QB.

In the illustration of FIG. 6B when compared to the illustration of FIG. 6A, the first output buffer circuit GBUF1 may include a first additional pull-down transistor Td1*a*, and the second output buffer circuit GBUF2 may include a second additional pull-down transistor Td2*a*.

The first additional pull-down transistor Td1*a* may be electrically connected between the first gate output terminal Ng1 and the base input terminal Ns, and be controlled by a voltage at another QB node QBa different from the QB node QB.

The second additional pull-down transistor Td2*a* may be electrically connected between the second gate output terminal Ng2 and the base input terminal Ns, and be controlled by a voltage at the another QB node QBa.

The first additional pull-down transistor Td1*a* and the first pull-down transistor Td1 may be controlled independently of each other. The second additional pull-down transistor Td2*a* and the second pull-down transistor Td2 may be controlled independently of each other.

The first additional pull-down transistor Td1*a* and the first pull-down transistor Td1 may alternately operate. The second additional pull-down transistor Td2*a* and the second pull-down transistor Td2 may alternately operate.

For example, the QB node QB, to which the gate node of the first pull-down transistor Td1 and the gate node of the second pull-down transistor Td2 are commonly connected, may be an odd-numbered QB node QB_O having a turn-on level voltage capable of turning on the first pull-down transistor Td1 and the second pull-down transistor Td2 in an odd-numbered timing.

For example, the QB node QBa, to which the gate node of the first additional pull-down transistor Td1*a* and the gate node of the second additional pull-down transistor Td2*a* are commonly connected, may be an even-numbered QB node QB_E having a turn-on level voltage capable of turning on the first additional pull-down transistor Td1*a* and the second additional pull-down transistor Td2*a* in an even-numbered timing.

Figure 7:
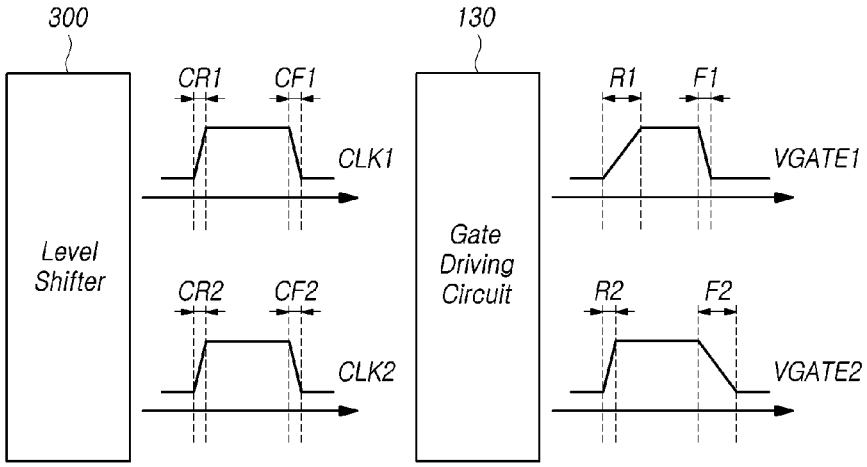
FIG. 7 illustrates characteristic differences in the display device according to aspects of the present disclosure.

FIG. 7 illustrates characteristic differences between gate signals in the display device 100 according to aspects of the present disclosure.

Referring to FIG. 7, the level shifter 300 can output a first clock signal CLK1 and a second clock signal CLK2 to the gate driving circuit 130. The gate driving circuit 130 can receive the first clock signal CLK1 and output an associated first gate signal VGATE1 to a first gate line GL1, and receive the second clock signal CLK2 and output an associated second gate signal VGATE2 to a second gate line GL2.

The first gate signal VGATE1 shown in FIG. 7 represents a turn-on level voltage duration thereof, and the second gate signal VGATE2 shown in FIG. 7 represents a turn-on level voltage duration thereof.

Referring to FIG. 7, the first clock signal CLK1 and the second clock signal CLK2 may have the same signal waveform. That is, a rising length CR1 of the first clock signal CLK1 and a rising length CR2 of the second clock signal CLK2 may be equal or nearly equal, or differ within a certain range. A falling length CF1 of the first clock signal CLK1 and a falling length CF2 of the second clock signal CLK2 may be equal or nearly equal, or differ within a certain range.

Among two (m=2) gate signals (VGATE1 and VGATE2) output from the gate driving circuit 130 having the Q node sharing structure in which m representing the degree of sharing is 2, the first gate signal VGATE1 has a turn-on level voltage duration at the earliest timing, and the second gate signal VGATE2 has a turn-on level voltage duration at the latest timing.

According to the overlap gate driving described above, the turn-on level voltage duration of the first gate signal VGATE1 and the turn-on level voltage duration of the second gate signal VGATE2 may partially overlap. For example, each of the turn-on level voltage duration of the first gate signal VGATE1 and the turn-on level voltage duration of the second gate signal VGATE2 may be a period of 2 horizontal time (H), and the second half (1H) of the turn-on level voltage duration of the first gate signal VGATE1 may overlap the first half (1H) of the turn-on level voltage duration of the second gate signal VGATE2.

When the gate driving circuit 130 performs overlap gate driving and has the Q node sharing structure (as in FIGS. 6A and 6B), if the first clock signal CLK1 and the second clock signal CLK2 have an equal signal waveform according to a typical scheme, a signal waveform of the first gate signal VGATE1 may become different from that of the second gate signal VGATE2.

The generation of different signal waveforms between the first gate signal VGATE1 and the second gate signal VGATE2 indicates that there is a characteristic difference between the first gate signal VGATE1 and the second gate signal VGATE2.

The occurrence of the characteristic difference between the first gate signal VGATE1 and the second gate signal VGATE2 may mean that there is present a difference in rising characteristics between the first gate signal VGATE1 and the second gate signal VGATE2, or a difference in falling characteristics between the first gate signal VGATE1 and the second gate signal VGATE2.

When the gate driving circuit 130 performs the overlap gate driving and has the Q node sharing structure (as in FIGS. 6A and 6B), if the first clock signal CLK1 and the second clock signal CLK2 have an equal signal waveform according to a typical scheme, a rising length R1 of the first gate signal VGATE1 may become greater than a rising length R2 of the second gate signal VGATE2, and a falling length F2 of the second gate signal VGATE2 may become greater that a falling length F1 of the first gate signal VGATE1.

The characteristic differences (rising characteristic differences, and falling characteristic differences) between gate signals (VGATE1 and VGATE2) may cause malfunction of transistors (e.g., scan transistors SCT, and/or sensing transistors SENT) to which the gate signals (VGATE1 and VGATE2) are applied, this leading image quality to be degraded.

To address these issues, a function of compensating for characteristic differences between gate signals may be provided to the display device 100 according to aspects of the present disclosure, and hereinafter, in some aspects, the function of compensating for characteristic differences between gate signals in the display device 100 will be described in detail with reference to drawings.

Figure 8A:
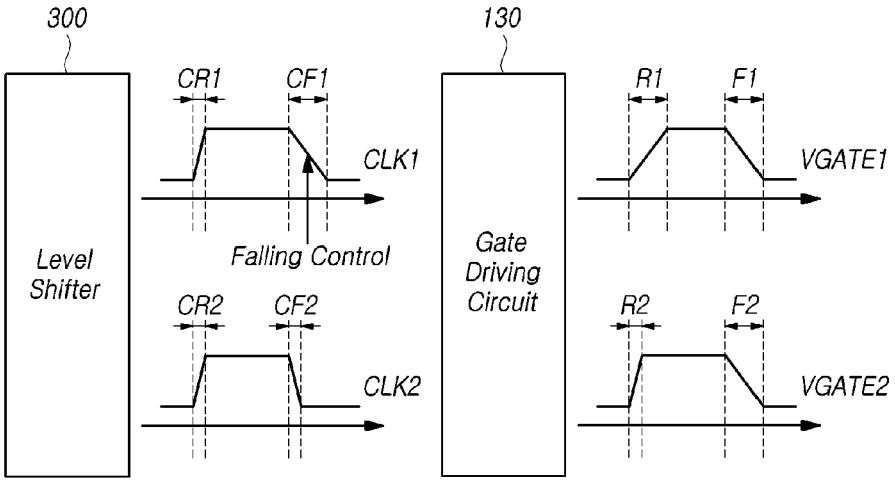
FIGS. 8A to 8C illustrate a function of compensating for characteristic differences between gate signals in the display device according to aspects of the present disclosure.
Figure 8B:
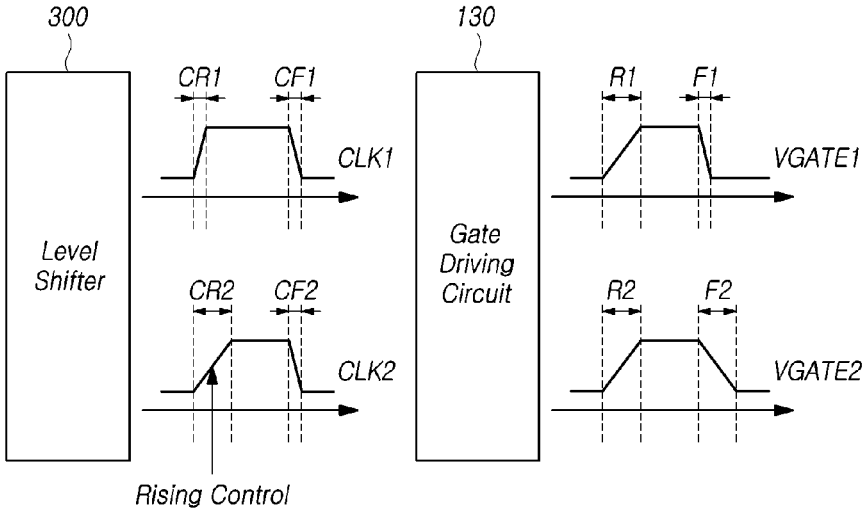
Figure 8C:
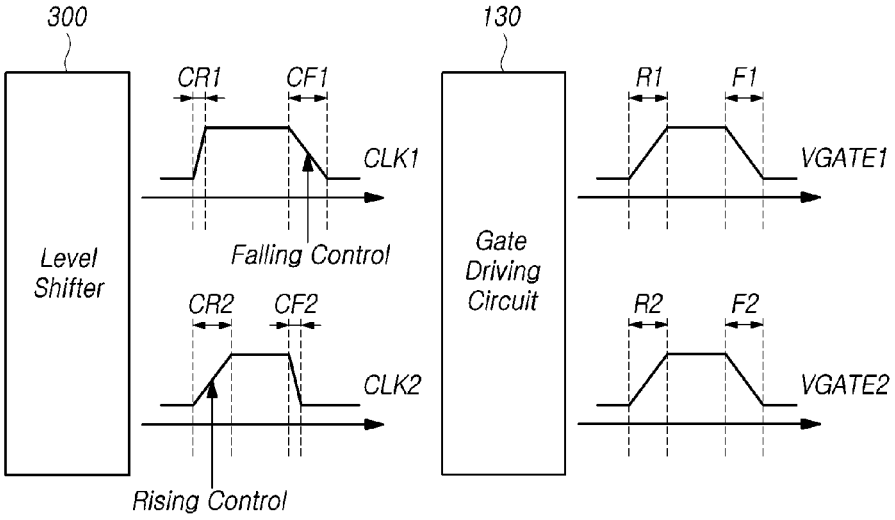

FIGS. 8A to 8C illustrate the function of compensating for characteristic differences between gate signals in the display device 100 according to aspects of the present disclosure.

Referring to FIGS. 8A to 8C, in order to compensate for characteristic differences between gate signals, the level shifter 300 can control one or more of a rising characteristic and a falling characteristic for one or more of first and second clock signals (CLK1 and CLK2), and thereby, generate and output an updated first clock signal CLK1 and an updated second clock signal CLK2.

In turn, a falling length CF1 of the first clock signal CLK1 and a falling length CF2 of the second clock signal CLK2 may be different, or a rising length CR1 of the first clock signal CLK1 and a rising length CR2 of the second clock signal CLK2 may be different.

Referring to FIG. 8A, the level shifter 300 can cause a first falling length CF1 of the first clock signal CLK1 to become greater than a second falling length CF2 of the second clock signal CLK2 through a falling control. Although FIG. 8A shows that the rising timings of the first gate signal VGATE1 and the second gate signal VGATE2 are equal, this is merely for convenience of description, and in an actual implementation, the first gate signal VGATE1 rises from a low level voltage to a high level voltage, and falls from the high level voltage to the low level voltage, at timings earlier than the second gate signal VGATE2. In this case, by the falling control of the level shifter 300, the falling length CF1 of the first clock signal CLK1 serving as a basis for generating the first gate signal VGATE1 may become greater than the falling length CF2 of the second clock signal CLK2 serving as a basis for generating the second gate signal VGATE2. In other words, when the first gate signal VGATE1 is a gate signal applied to a gate line scanned at a timing earlier than the second gate signal VGATE2, to address a situation (a difference in falling characteristics) in which the falling length F2 of the second gate signal VGATE2 is relatively greater and the falling length F1 of the first gate signal VGATE1 is relatively smaller under the Q node sharing structure, the level shifter 300 can intentionally extend the falling length CF1 of the first clock signal CLK1 serving as the basis for generating the first gate signal VGATE1, thereby, resulting in an updated falling length F1 of the first gate signal VGATE1 being intentionally extended. Accordingly, the extended falling length F1 of the first gate signal VGATE1 may be equal, or nearly equal, to the original falling length F2 of the second gate signal VGATE2.

By the falling control of the level shifter 300, the falling length F1 of the first gate signal VGATE1 and the falling length F2 of the second gate signal VGATE2 may be equal or nearly equal, or similar within a predetermined range.

By the falling control of the level shifter 300, a difference between the falling length F1 of the first gate signal VGATE1 and the falling length F2 of the second gate signal VGATE2 may be reduced comparing with the case where no falling control is performed (as in FIG. 7).

By the falling control of the level shifter 300, a difference between the falling length F1 of the first gate signal VGATE1 and the falling length F2 of the second gate signal VGATE2 may become smaller than a difference between the falling length CF1 of the first clock signal CLK1 and the falling length CF2 of the second clock signal CLK2.

As a result, a difference in falling characteristics between the first and second gate signals (VGATE1 and VGATE2) can be compensated for, thereby enabling image quality to be improved.

Referring to FIG. 8B, the level shifter 300 can cause a second rising length CR2 of the second clock signal CLK2 to become greater than a first rising length CR1 of the first clock signal CLK1 through a rising control.

Accordingly, when the first gate signal VGATE1 is a gate signal that rises from a low level voltage to a high level voltage and falls from the high level voltage to the low level voltage, at times earlier than the second clock signal VGATE2, an updated rising length CR2 of the second clock signal CLK2 may become greater than the rising length CR1 of the first clock signal CLK1. In other words, when the first gate signal VGATE1 is a gate signal applied to a gate line scanned at a timing earlier than the second gate signal VGATE2, to address a situation (a difference in rising characteristics) in which the rising length R1 of the first gate signal VGATE1 is relatively greater and the rising length R2 of the second gate signal VGATE2 is relatively smaller under the Q node sharing structure, the level shifter 300 can intentionally extend the rising length CR2 of the second clock signal CLK2 serving as a basis for generating the second gate signal VGATE2, thereby, resulting in an updated rising length R2 of the second gate signal VGATE2 being intentionally extended. Accordingly, the extended rising length R2 of the second gate signal VGATE2 may be equal, or nearly equal, to the original rising length R1 of the first gate signal VGATE1.

By the rising control of the level shifter 300, the rising length R1 of the first gate signal VGATE1 and the rising length R2 of the second gate signal VGATE2 may be equal or nearly equal, or similar within a predetermined range.

By the rising control of the level shifter 300, a difference between the rising length R1 of the first gate signal VGATE1 and the rising length R2 of the second gate signal VGATE2 may be reduced comparing with the case where no rising control is performed (as in FIG. 7).

By the rising control of the level shifter 300, a difference between the rising length R1 of the first gate signal VGATE1 and the rising length R2 of the second gate signal VGATE2 may become smaller than a difference between the rising length CR2 of the second clock signal CLK2 and the rising length CR1 of the first clock signal CLK1.

As a result, a difference in rising characteristics between the first and second gate signals (VGATE1 and VGATE2) can be compensated for, thereby enabling image quality to be improved.

Referring to FIG. 8C, the level shifter 300 can cause a first falling length CF1 of the first clock signal CLK1 to become greater than a second falling length CF2 of the second clock signal CLK2 through a falling control, and cause a second rising length CR2 of the second clock signal CLK2 to become greater than a first rising length CR1 of the first clock signal CLK1 through a rising control.

By the rising control and the falling control of the level shifter 300, the falling length CF1 of the first clock signal CLK1 may become greater than the falling length CF2 of the second clock signal CLK2, and the rising length CR2 of the second clock signal CLK2 may become greater than the rising length CR1 of the first clock signal CLK1.

By the falling control and the rising control of the level shifter 300, the falling length F1 of the first gate signal VGATE1 and the falling length F2 of the second gate signal VGATE2 may become equal or nearly equal, or similar within a predetermined range, and the rising length R1 of the first gate signal VGATE1 and the rising length R2 of the second gate signal VGATE2 may become equal or nearly equal, or similar within a predetermined range.

By the falling control and the rising control of the level shifter 300, a difference between the falling length F1 of the first gate signal VGATE1 and the falling length F2 of the second gate signal VGATE2 may be reduced comparing with the case where no falling control is performed (as in FIG. 7), and a difference between the rising length R1 of the first gate signal VGATE1 and the rising length R2 of the second gate signal VGATE2 may be reduced comparing with the case where no rising control is performed (as in FIG. 7).

By the falling control and the rising control of the level shifter 300, a difference between the falling length F1 of the first gate signal VGATE1 and the falling length F2 of the second gate signal VGATE2 may become smaller than a difference between the falling length CF1 of the first clock signal CLK1 and the falling length CF2 of the second clock signal CLK2, and a difference between the rising length R1 of the first gate signal VGATE1 and the rising length R2 of the second gate signal VGATE2 may become smaller than a difference between the rising length CR2 of the second clock signal CLK2 and the rising length CR1 of the first clock signal CLK1.

As a result, all of the rising and falling characteristic differences between the first and second gate signals (VGATE1 and VGATE2) can be compensated for, thereby enabling image quality to be significantly improved.

Figure 9:
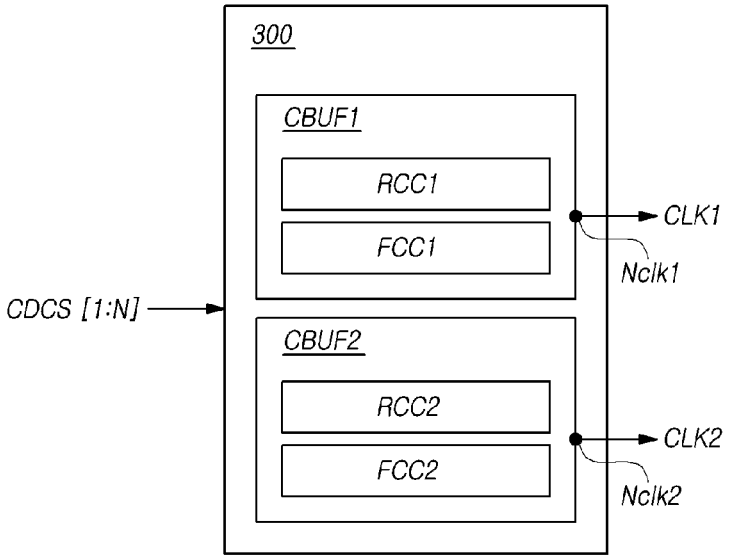
FIG. 9 is a block diagram of a level shifter of the display device according to aspects of the present disclosure.

FIG. 9 is a block diagram of the level shifter 300 of the display device 100 according to aspects of the present disclosure.

As described above, the level shifter 300 may include the m number of clock output buffers (CBUF1, CBUF2, . . . ). However, for convenience of description, in FIG. 9, as an example, discussions will be conducted on two clock output buffers (CBUF1 and CBUF2) capable of generating and outputting two clock signals (CLK1 and CLK2), where m is a natural number of 2 or more.

Referring to FIG. 9, the level shifter 300 may include a first clock output buffer CBUF1 for generating a first clock signal CLK1 and outputting the generated first clock signal CLK1 to a first clock output terminal Nclk1, and a second clock output buffer CBUF2 for generating a second clock signal CLK2 and outputting the generated second clock signal CLK2 to a second clock output terminal Nclk2.

The first clock output buffer CBUF1 may include a first rising control circuit RCC1 and a first falling control circuit FCC1, and can control at least one of a rising characteristic and a falling characteristic of the first clock signal CLK1 by controlling the first rising control circuit RCC1 and the first falling control circuit FCC1 in response to a clock difference control signal CDCS [1:N].

The second clock output buffer CBUF2 may include a second rising control circuit RCC2 and a second falling control circuit FCC2, and can control at least one of a rising characteristic and a falling characteristic of the second clock signal CLK2 by controlling the second rising control circuit RCC2 and the second falling control circuit FCC2 in response to a clock difference control signal CDCS [1:N].

Here, the clock difference control signal CDCS [1:N] may be provided by the power management integrated circuit 310 or the controller 140 to the level shifter 300.

FIGS. 10A to 10D are example circuits in the first clock output buffer CBUF1 of the level shifter 300 of the display device 100 according to aspects of the present disclosure, and FIGS. 11A to 11D are example circuits in the second clock output buffer CBUF2 of the level shifter 300 of the display device 100 according to aspects of the present disclosure.

Referring to FIGS. 10A to 10D, the first clock output buffer CBUF1 may include a first rising control circuit RCC1 including N number of first rising control transistors (RCT1-1 to RCT1-N) electrically connected between a high level voltage node Nhv to which a high level voltage HV is applied and a first clock output terminal Nclk1, and a first falling control circuit FCC1 including N number of first falling control transistors (FCT1-1 to FCT1-N) electrically connected between a low level voltage node Nlv to which a low level voltage LV is applied and the first clock output terminal Nclk1, where N is a natural number of 2 or more.

Referring to FIGS. 11A to 11D, the second clock output buffer CBUF2 may include a second rising control circuit RCC2 including N number of second rising control transistors (RCT2-1 to RCT2-N) electrically connected between a high level voltage node Nhv to which a high level voltage HV is applied and a second clock output terminal Nclk2, and a second falling control circuit FCC2 including N number of second falling control transistors (FCT2-1 to FCT2-N) electrically connected between a low level voltage node Nlv to which a low level voltage LV is applied and the second clock output terminal Nclk2.

Here, the high level voltage HV may correspond to high level voltages of clock signals (CLK1 and CLK2) and correspond to high level voltages (turn-on level voltages) of gate signals (VGATE1 and VGATE2). The low level voltage LV may correspond to low level voltages of the clock signals (CLK1 and CLK2) and correspond to low level voltages (turn-off level voltages) of the gate signals (VGATE1 and VGATE2).

Referring to FIGS. 10A to 11D, respective turn-ons or/and turn-offs of N number of control transistors included in at least one of the first rising control circuit RCC1, the first falling control circuit FCC1, the second rising control circuit RCC2, and the second falling control circuit FCC2 may be independently controlled.

A turn-off level gate voltage may be applied to one or more of the respective gate nodes of N number of control transistors included in at least one of the first rising control circuit RCC1, the first falling control circuit FCC1, the second rising control circuit RCC2, and the second falling control circuit FCC2. One or more of N number of control transistors included in at least one of the first rising control circuit RCC1, the first falling control circuit FCC1, the second rising control circuit RCC2, and the second falling control circuit FCC2 may be turned off.

Referring to FIGS. 10A to 11D, in response to a clock deviation control signal CDCS [1:N] input from the power management integrated circuit 310 or the controller 140, in the level shifter 300, one or more of N number of control transistors included in at least one of the first rising control circuit RCC1, the first falling control circuit FCC1, the second rising control circuit RCC2, and the second falling control circuit FCC2 can be turned on, and all or some of the remaining control transistors other than the turned-on control transistors can be turned off.

Figure 10A:
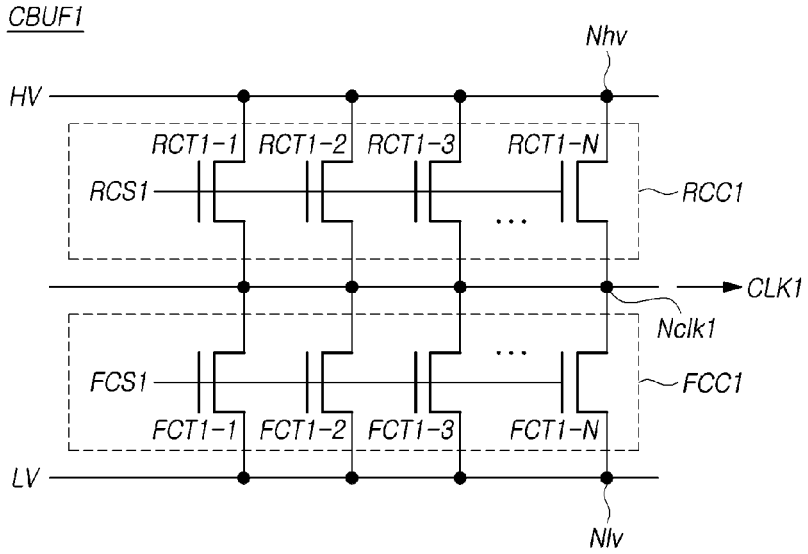
FIGS. 10A to 10D illustrate example circuits of a first clock output buffer of the level shifter of the display device according to aspects of the present disclosure.

Referring to FIG. 10A, in the first clock output buffer CBUF1, all of the respective gate nodes of the N number of first rising control transistors (RCT1-1 to RCT1-N) can be electrically connected and commonly receive one first rising control signal RCS1, and all of the respective gate nodes of the N number of first falling control transistors (FCT1-1 to FCT1-N) can be electrically connected and commonly receive one first falling control signal FCS1. In this situation, the N number of first rising control transistors (RCT1-1 to RCT1-N) can be simultaneously, or substantially simultaneously, turned on or turned off, and the N number of first falling control transistors (FCT1-1 to FCT1-N) can be simultaneously, or substantially simultaneously, turned on or turned off.

Figure 10B:
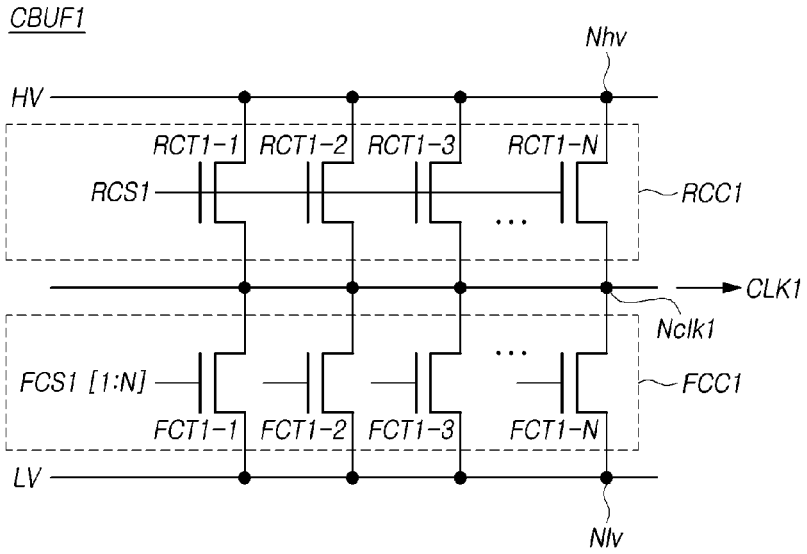

Referring to FIG. 10B, in the first clock output buffer CBUF1, all of the respective gate nodes of the N number of first rising control transistors (RCT1-1 to RCT1-N) can be electrically connected and commonly receive one first rising control signal RCS1, and N number of first falling control signals FCS1 [1:N] can be individually applied to the gate nodes of the N number of first falling control transistors (FCT1-1 to FCT1-N). In this situation, the N number of first rising control transistors (RCT1-1 to RCT1-N) can be simultaneously, or substantially simultaneously, turned on or turned off, and the N number of first falling control transistors (FCT1-1 to FCT1-N) can be independently turned on and turned off.

Figure 10C:
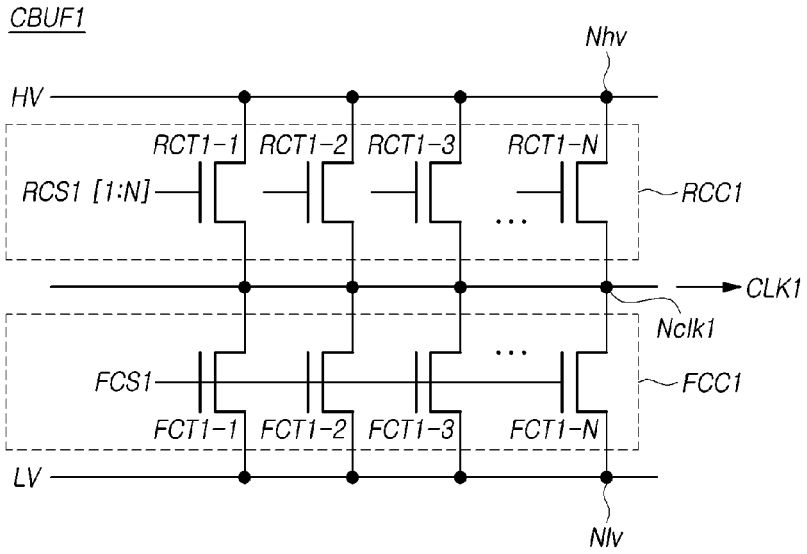

Referring to FIG. 10C, in the first clock output buffer CBUF1, N number of first rising control signals RCS1 [1:N] can be individually applied to the gate nodes of the N number of first rising control transistors (RCT1-1 to RCT1-N), and all of the respective gate nodes of the N number of first falling control transistors (FCT1-1 to FCT1-N) can be electrically connected and commonly receive one first falling control signal FCS1. In this situation, the N number of first rising control transistors (RCT1-1 to RCT1-N) can be independently turned on and turned off, and the N number of first falling control transistors (FCT1-1 to FCT1-N) can be simultaneously, or substantially simultaneously, turned on or turned off.

Figure 10D:
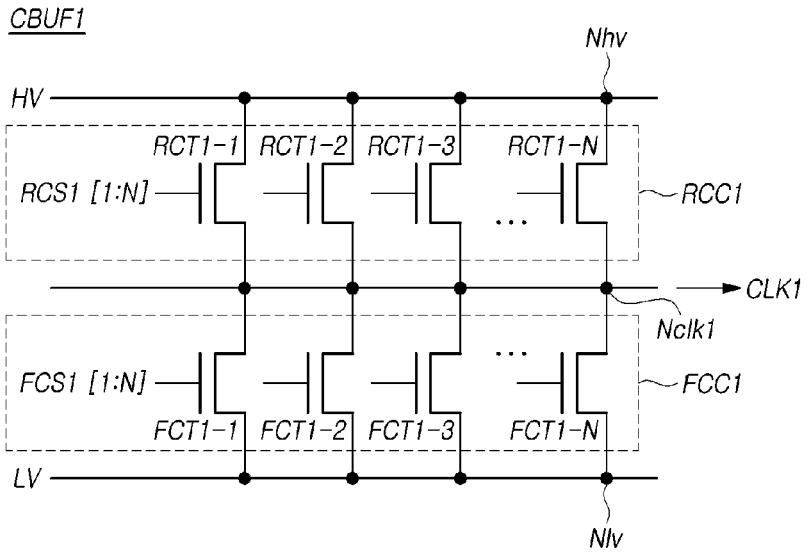

Referring to FIG. 10D, in the first clock output buffer CBUF1, N number of first rising control signals RCS1 [1:N] can be individually applied to the gate nodes of the N number of first rising control transistors (RCT1-1 to RCT1-N), and N number of first falling control signals FCS1 [1:N] can be individually applied to the gate nodes of the N number of first falling control transistors (FCT1-1 to FCT1-N). In this situation, the N number of first rising control transistors (RCT1-1 to RCT1-N) can be independently turned on and turned off, and the N number of first falling control transistors (FCT1-1 to FCT1-N) can be independently turned on and turned off.

Figure 11A:
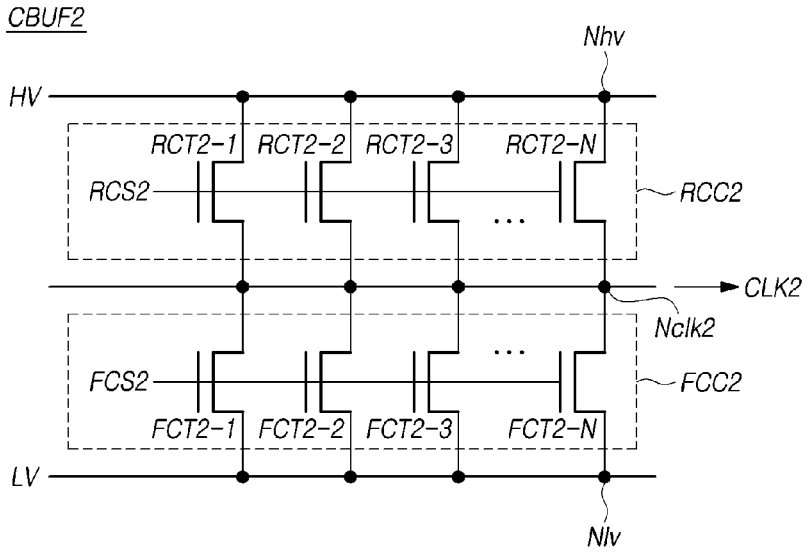
FIGS. 11A to 11D illustrate example circuits of a second clock output buffer of the level shifter of the display device according to aspects of the present disclosure.

Referring to FIG. 11A, in the second clock output buffer CBUF2, all of the respective gate nodes of the N number of second rising control transistors (RCT2-1 to RCT2-N) can be electrically connected and commonly receive one second rising control signals RCS2, and all of the respective gate nodes of the N number of second falling control transistors (FCT2-1 to FCT2-N) can be electrically connected and commonly receive one second falling control signal FCS2. In this situation, the N number of second rising control transistors (RCT2-1 to RCT2-N) can be simultaneously, or substantially simultaneously, turned on or turned off, and the N number of second falling control transistors (FCT2-1 to FCT2-N) can be simultaneously, or substantially simultaneously, turned on or turned off.

Figure 11B:
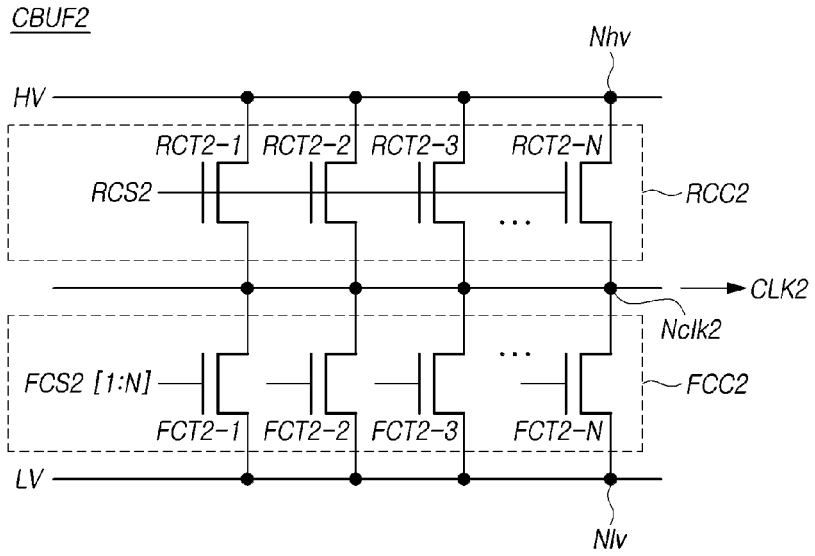

Referring to FIG. 11B, in the second clock output buffer CBUF2, all of the respective gate nodes of the N number of second rising control transistors (RCT2-1 to RCT2-N) can be electrically connected and commonly receive one second rising control signal RCS2, and N number of second falling control signals FCS2 [1:N] can be individually applied to the gate nodes of the N number of second falling control transistors (FCT2-1 to FCT2-N). In this situation, the N number of second rising control transistors (RCT2-1 to RCT2-N) can be simultaneously, or substantially simultaneously, turned on or turned off, and the N number of second falling control transistors (FCT2-1 to FCT2-N) can be independently turned on and turned off.

Figure 11C:
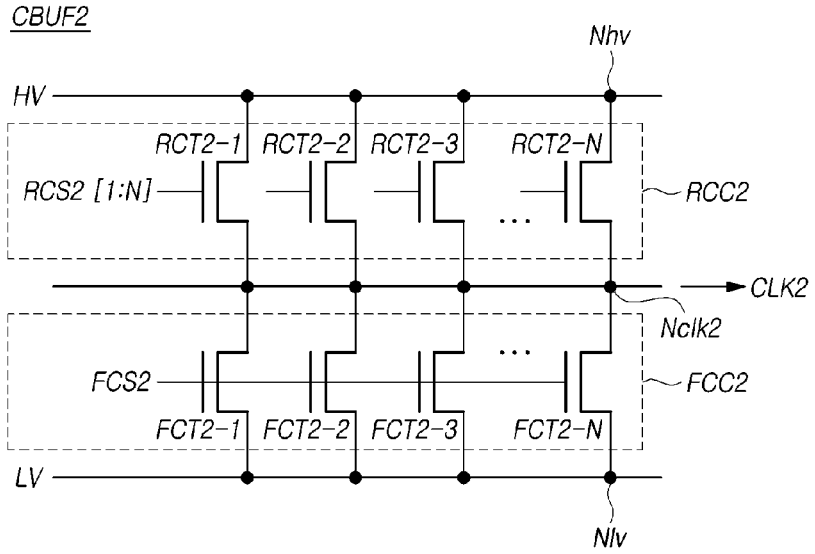

Referring to FIG. 11C, in the second clock output buffer CBUF2, N number of second rising control signals RCS2 [1:N] can be individually applied to the gate nodes of the N number of second rising control transistors (RCT2-1 to RCT2-N), and all of the respective gate nodes of the N number of second falling control transistors (FCT2-1 to FCT2-N) can be electrically connected and commonly receive one second falling control signal FCS2. In this situation, the N number of second rising control transistors (RCT2-1 to RCT2-N) can be independently turned on and turned off, and the N number of second falling control transistors (FCT2-1 to FCT2-N) can be simultaneously, or substantially simultaneously, turned on or turned off.

Figure 11D:
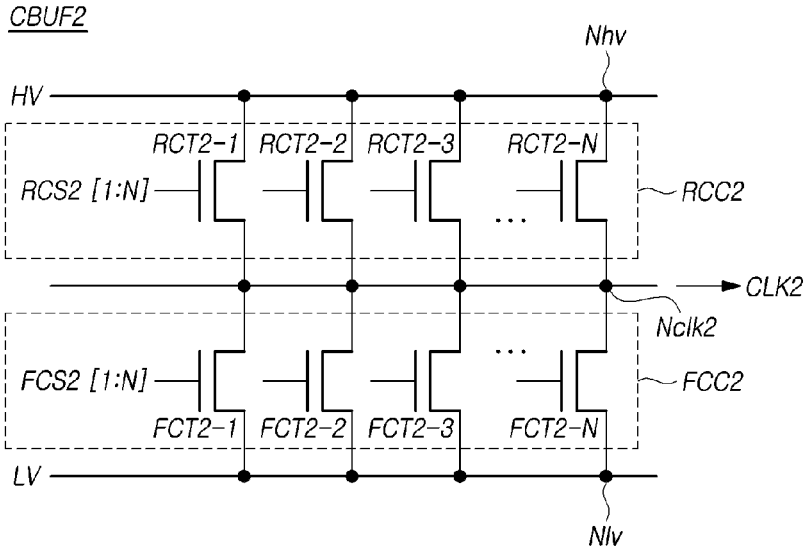

Referring to FIG. 11D, in the second clock output buffer CBUF2, N number of second rising control signals RCS2 [1:N] can be individually applied to the gate nodes of the N number of second rising control transistors (RCT2-1 to RCT2-N), and N number of second falling control signals FCS2 [1:N] can be individually applied to the gate nodes of the N number of second falling control transistors (FCT2-1 to FCT2-N). In this situation, the N number of second rising control transistors (RCT2-1 to RCT2-N) can be independently turned on and turned off, and the N number of second falling control transistors (FCT2-1 to FCT2-N) can be independently turned on and turned off.

In some aspects, one level shifter 300 can be configured by selectively combining one of the four types of first clock output buffers CBUF1 shown in FIGS. 10A to 10D and one of the four types of second clock output buffers CBUF2 shown in FIGS. 11A to 11D.

Hereinafter, a level shifter 300 configured by a combination of the first clock output buffer CBUF1 of FIG. 10B and the second clock output buffer CBUF2 of FIG. 11A will be described with reference to FIG. 12, and a level shifter 300 configured by a combination of the first clock output buffer CBUF1 of FIG. 10B and the second clock output buffer CBUF2 of FIG. 11C will be described with reference to FIG. 14.

Figure 12:
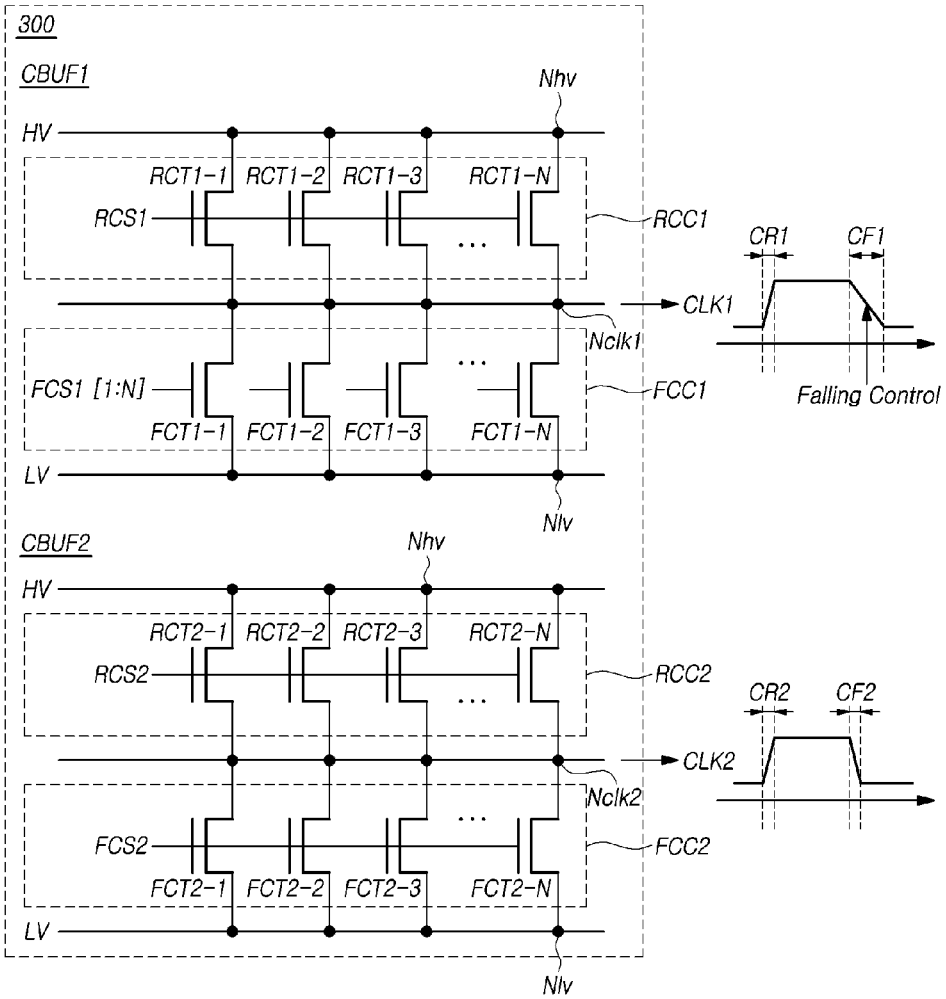
FIG. 12 is a detailed diagram of a level shifter for compensating for a difference in falling characteristics between gate signals in the display device according to aspects of the present disclosure.
Figure 13:
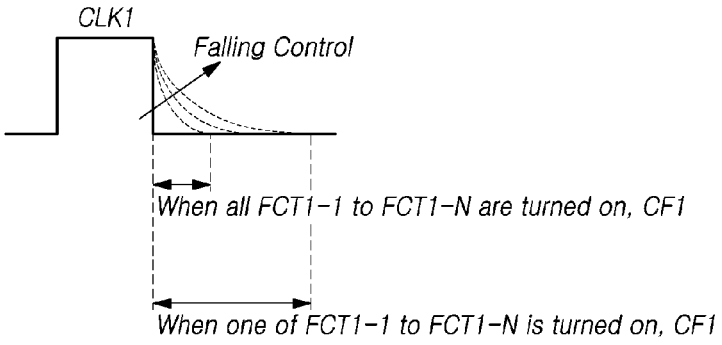
FIG. 13 illustrates a falling length of a first clock signal according to the number of turned-on falling control transistors among N number of first falling control transistors of the level shifter of FIG. 12.

FIG. 12 is a detailed diagram of a level shifter 300 for compensating for a difference in falling characteristics between gate signals in the display device 100 according to aspects of the present disclosure. FIG. 13 illustrates a falling length CF1 of a first clock signal CLK1 according to the number of turned-on first falling control transistors among N number of first falling control transistors (FCT1-1 to FCT1-N) of the level shifter 300 of FIG. 12.

Referring to FIG. 12, in a situation where a difference in falling characteristics between gate signals is a primary factor in image quality degradation or the like, the level shifter 300 can perform a control function of compensating for a difference in falling characteristics between gate signals instead of performing a control function of compensating for a difference in rising characteristics between gate signals.

Referring to FIG. 12, the level shifter 300 may be configured by a combination of the first clock output buffer CBUF1 of FIG. 10B and the second clock output buffer CBUF2 of FIG. 11A.

Referring to FIG. 12, the first clock output buffer CBUF1 included in the level shifter 300 can perform a falling control of the first clock signal CLK1 and may not perform a rising control of the first clock signal CLK1. In the first clock output buffer CBUF1 included in the level shifter 300, N number of first falling control transistors (FCT1-1 to FCT1-N) included in the first falling control circuit FCC1 can be controlled to be independently turned on or turned off, and N number of first rising control transistors (RCT1-1 to RCT1-N) included in the first rising control circuit RCC1 can be simultaneously, or nearly simultaneously, turned on or turned off.

Referring to FIG. 12, the second clock output buffer CBUF2 included in the level shifter 300 may not perform falling and rising controls of the second clock signal CLK2. In the second clock output buffer CBUF2 included in the level shifter 300, N number of second rising control transistors (RCT2-1 to RCT2-N) included in the second rising control circuit RCC2 can be simultaneously, or nearly simultaneously, turned on or turned off, and N number of second falling control transistors (FCT2-1 to FCT2-N) included in the second falling control circuit FCC2 can be simultaneously, or nearly simultaneously, turned on or turned off.

Referring to FIG. 12, one to (N−1) number of first falling control transistors among the N number of first falling control transistors (FCT1-1 to FCT1-N) can be turned on by N number of first falling control signals FCS1 [1:N], and all of the N number of second falling control transistors (FCT2-1 to FCT2-N) can be turned on by one second falling control signal FCS2.

A falling length CF1 of the first clock signal CLK1 output from the first clock output buffer CBUF1 may be greater than a falling length CF2 of the second clock signal CLK2 output from the second clock output buffer CBUF2.

A difference between a falling length F1 of an associated first gate signal VGATE1 and a falling length F2 of an associated second gate signal VGATE2 may be smaller than a difference between the falling length CF1 of the first clock signal CLK1 and the falling length CF2 of the second clock signal CLK2.

Referring to FIG. 12, when the falling length CF1 of the first clock signal CLK1 is greater than the falling length CF2 of the second clock signal CLK2, the number of turned-on falling control transistors among the N number of first falling control transistors (FCT1-1 to FCT1-N) may be smaller than the number of turned-on falling control transistors among the N number of second falling control transistors (FCT2-1 to FCT2-N).

Referring to FIGS. 12 and 13, in the first clock output buffer CBUF1 included in the level shifter 300, when all of the N number of first falling control transistors (FCT1-1 to FCT2-N) included in the first falling control circuit FCC1 are turned on, the first clock signal CLK1 falls at the earliest timing. Accordingly, the falling length CF1 of the first clock signal CLK1 may become smallest. Referring to FIG. 13, when all of the N number of first falling control transistors (FCT1-1 to FCT1-N) included in the first falling control circuit FCC1 are turned on, a voltage of the first clock signal CLK1 may fall from a high level voltage to a low level voltage with almost no time delay. That is, when all of the N number of first falling control transistors (FCT1-1 to FCT1-N) included in the first falling control circuit FCC1 are turned on, the falling length CF1 of the first clock signal CLK1 may become close to 0 (Zero).

Referring to FIGS. 12 and 13, in the first clock output buffer CBUF1 included in the level shifter 300, when one of the N number of first falling control transistors (FCT1-1 to FCT2-N) included in the first falling control circuit FCC1 is turned on, the first clock signal CLK1 falls at the latest timing. Accordingly, the falling length CF1 of the first clock signal CLK1 may become greatest.

Figure 14:
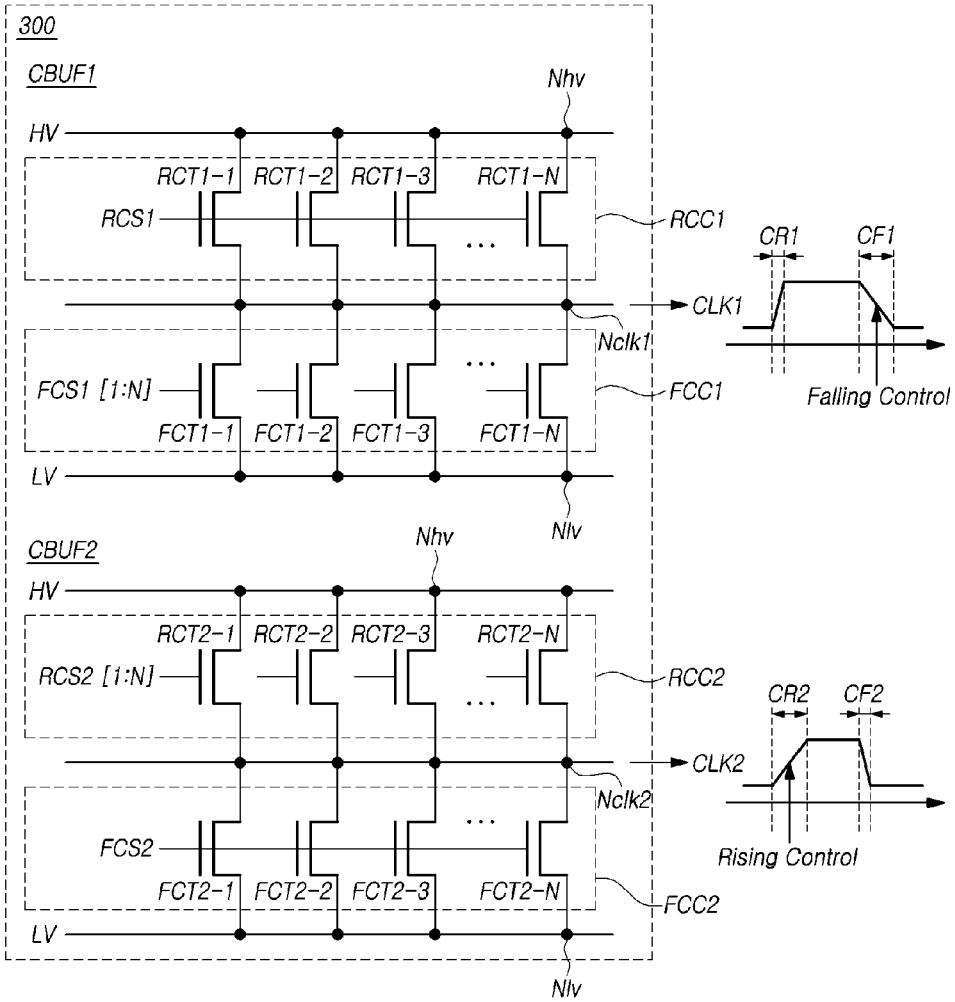
FIG. 14 is a detailed diagram of a level shifter for compensating for a difference in falling characteristics, and a difference in rising characteristics, between gate signals in the display device according to aspects of the present disclosure.
Figure 15:
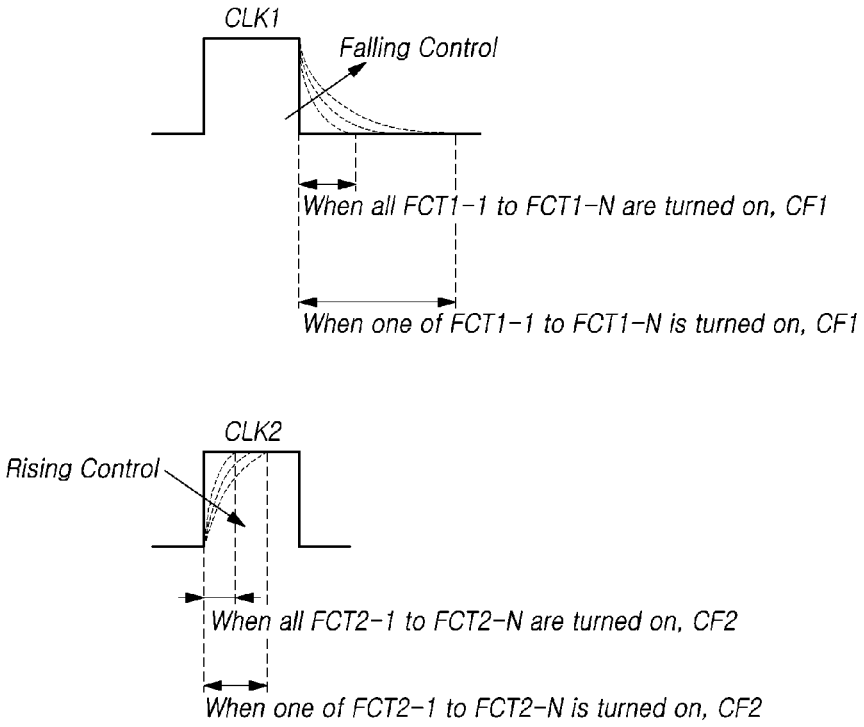
FIG. 15 illustrates a falling length of a first clock signal according to the number of turned-on falling control transistors among N number of first falling control transistors of the level shifter of FIG. 14 and a rising length of a second clock signal according to the number of turned-on rising control transistors among N number of second rising control transistors thereof.

FIG. 14 is a detailed diagram of a level shifter 300 for compensating for a difference in falling characteristics, and a difference in rising characteristics, between gate signals in the display device 100 according to aspects of the present disclosure. FIG. 15 illustrates a falling length CF1 of a first clock signal CLK1 according to the number of turned-on first falling control transistors among N number of first falling control transistors (FCT1-1 to FCT1-N) of the level shifter 300 of FIG. 14 and a rising length CR2 of a second clock signal CLK2 according to the number of turned-on second rising control transistors among N number of second rising control transistors (RCT2-1 to RCT2-N) thereof.

Referring to FIG. 14, when both a difference in falling characteristics and a difference in rising characteristics between gate signals are primary factors in image quality degradation or the like, the level shifter 300 can perform a control function of compensating for both a difference in falling characteristics and a difference in rising characteristics between gate signals.

Referring to FIG. 14, the level shifter 300 may be configured by a combination of the first clock output buffer CBUF1 of FIG. 10B and the second clock output buffer CBUF2 of FIG. 11C.

Referring to FIG. 14, the first clock output buffer CBUF1 included in the level shifter 300 can perform a falling control of the first clock signal CLK1 and may not perform a rising control of the first clock signal CLK1. In the first clock output buffer CBUF1 included in the level shifter 300, N number of first falling control transistors (FCT1-1 to FCT1-N) included in the first falling control circuit FCC1 can be controlled to be independently turned on or turned off, and N number of first rising control transistors (RCT1-1 to RCT1-N) included in the first rising control circuit RCC1 can be simultaneously, or nearly simultaneously, turned on or turned off.

Referring to FIG. 14, the second clock output buffer CBUF2 included in the level shifter 300 may not perform a falling control of the second clock signal CLK2 and can perform a rising control of the second clock signal CLK2. In the second clock output buffer CBUF2 included in the level shifter 300, N number of second rising control transistors (RCT2-1 to RCT2-N) included in the second rising control circuit RCC2 can be controlled to be independently turned on or turned off, and N number of second falling control transistors (FCT2-1 to FCT2-N) included in the second falling control circuit FCC2 can be simultaneously, or nearly simultaneously, turned on or turned off.

Referring to FIG. 14, one to (N−1) number of first falling control transistors among the N number of first falling control transistors (FCT1-1 to FCT1-N) can be turned on by N number of first falling control signals FCS1 [1:N]. All of the N number of second falling control transistors (FCT2-1 to FCT2-N) can be turned on by one second falling control signal FCS2.

A falling length CF1 of the first clock signal CLK1 output from the first clock output buffer CBUF1 may be greater than a falling length CF2 of the second clock signal CLK2 output from the second clock output buffer CBUF2.

A difference between a falling length F1 of an associated first gate signal VGATE1 and a falling length F2 of an associated second gate signal VGATE2 may be smaller than a difference between the falling length CF1 of the first clock signal CLK1 and the falling length CF2 of the second clock signal CLK2.

Referring to FIG. 14, when the falling length CF1 of the first clock signal CLK1 is greater than the falling length CF2 of the second clock signal CLK2, the number of turned-on falling control transistors among the N number of first falling control transistors (FCT1-1 to FCT1-N) may be smaller than the number of turned-on falling control transistors among the N number of second falling control transistors (FCT2-1 to FCT2-N).

Referring to FIG. 14, one to (N−1) number of second control transistors among the N number of second rising control transistors (RCT2-1 to RCT2-N) can be turned on by N number of second rising control signals RCS2 [1:N]. All of the N number of first rising control transistors (RCT1-1 to RCT1-N) can be turned on by one first rising control signal RC Sl.

A rising length CR2 of the second clock signal CLK2 output from the second clock output buffer CBUF2 may be greater than a rising length CR1 of the first clock signal CLK1 output from the first clock output buffer CBUF1.

A difference between a rising length R1 of an associated first gate signal VGATE1 and a rising length R2 of an associated second gate signal VGATE2 may be smaller than a difference between the rising length CR1 of the first clock signal CLK1 and the rising length CR2 of the second clock signal CLK2.

Referring to FIG. 14, when the rising length CR2 of the second clock signal CLK2 is greater than the rising length CR1 of the first clock signal CLK1, the number of turned-on rising control transistors among the N number of second rising control transistors (RCT2-1 to RCT2-N) may be smaller than the number of turned-on rising control transistors among the N number of first rising control transistors (RCT1-1 to RCT1-N).

Referring to FIGS. 14 and 15, in the first clock output buffer CBUF1 included in the level shifter 300, when all of the N number of first falling control transistors (FCT1-1 to FCT1-N) included in the first falling control circuit FCC1 are turned on, the first clock signal CLK1 falls at the earliest timing. Accordingly, the falling length CF1 of the first clock signal CLK1 may become smallest. Referring to FIG. 15, when all of the N number of first falling control transistors (FCT1-1 to FCT1-N) included in the first falling control circuit FCC1 are turned on, a voltage of the first clock signal CLK1 may fall from a high level voltage to a low level voltage with almost no time delay. That is, when all of the N number of first falling control transistors (FCT1-1 to FCT1-N) included in the first falling control circuit FCC1 are turned on, the falling length CF1 of the first clock signal CLK1 may become close to 0 (Zero).

Referring to FIGS. 14 and 15, in the first clock output buffer CBUF1 included in the level shifter 300, when one of the N number of first falling control transistors (FCT1-1 to FCT1-N) included in the first falling control circuit FCC1 is turned on, the first clock signal CLK1 falls at the latest timing. Accordingly, the falling length CF1 of the first clock signal CLK1 may become greatest.

Referring to FIGS. 14 and 15, in the second clock output buffer CBUF2 included in the level shifter 300, when all of the N number of second rising control transistors (RCT2-1 to RCT2-N) included in the second rising control circuit RCC2 are turned on, the second clock signal CLK2 rises at the earliest timing. Accordingly, the rising length CR2 of the second clock signal CLK2 may become smallest. Referring to FIG. 15, when all of the N number of second rising control transistors (RCT2-1 to RCT2-N) included in the second rising control circuit RCC2 are turned on, a voltage of the second clock signal CLK2 may rise from a low level voltage to a high level voltage with almost no time delay. That is, when all of the N number of second rising control transistors (RCT2-1 to RCT2-N) included in the second rising control circuit RCC2 are turned on, the rising length CR2 of the first clock signal CLK2 may become close to 0 (Zero).

Referring to FIGS. 14 and 15, in the second clock output buffer CBUF2 included in the level shifter 300, when one of the N number of second rising control transistors (RCT2-1 to RCT2-N) included in the second rising control circuit RCC2 is turned on, the second clock signal CLK2 rises at the latest timing. Accordingly, the rising length CF2 of the second clock signal CLK2 may become greatest.

Figure 16:
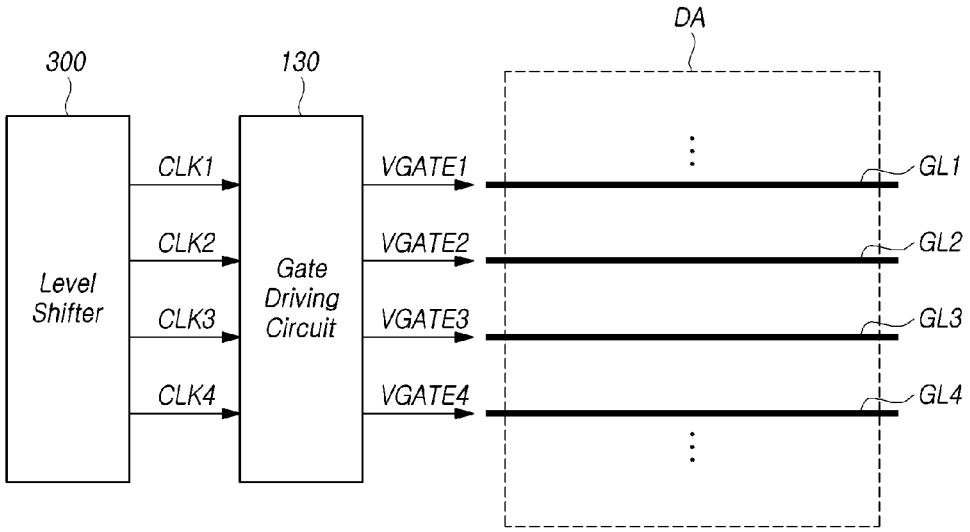
FIG. 16 illustrates an example gate signal output system of the display device according to aspects of the present disclosure.
Figure 17:
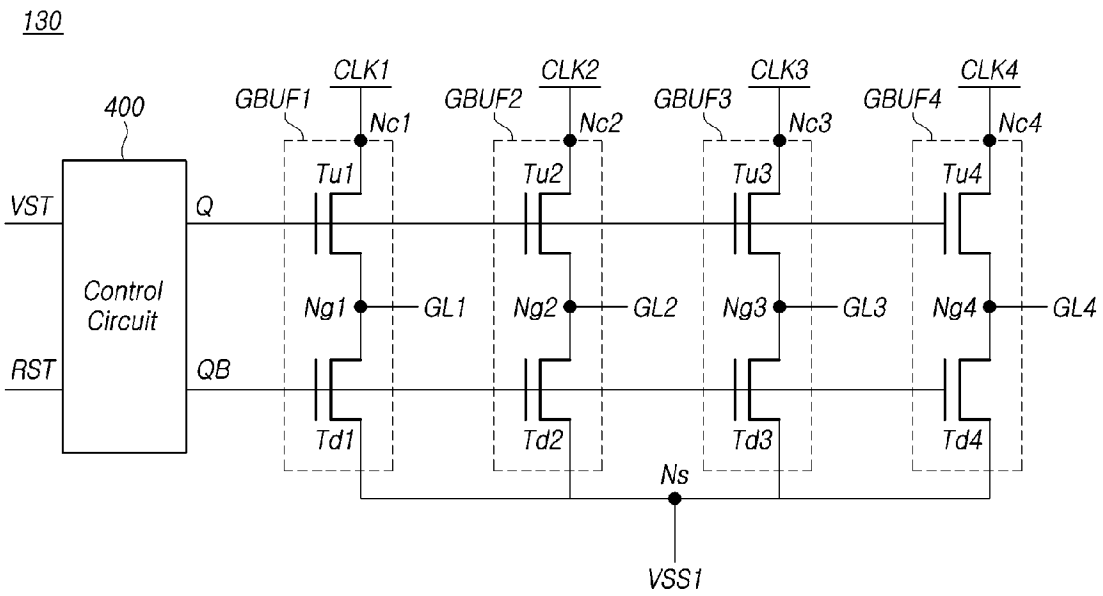
FIG. 17 illustrates an example gate driving circuit in the gate signal output system of FIG. 16.

FIG. 16 illustrates an example gate signal output system of the display device 100 according to aspects of the present disclosure. FIG. 17 illustrates an example gate driving circuit 130 in the gate signal output system of FIG. 16.

Referring to FIG. 16, when m is 4, four output buffer circuits (GBUF1 to GBUF4) may share one Q node Q.

When m is 4, four clock signals (CLK1 to CLK4) may be a first clock signal CLK1, a second clock signal CLK2, a third clock signal CLK3, and a fourth clock signal CLK4, and associated four gate signals (VGATE1 to VGATE4) may be a first gate signal VGATE1, a second gate signal VGATE2, a third gate signal VGATE3, and a fourth gate signal VGATE4.

Referring to FIG. 16, a level shifter 300 can output four clock signals (CLK1 to CLK4) of a plurality of clock signals. Here, the four clock signals (CLK1 to CLK4) may be the first clock signal CLK1, the second clock signal CLK2, the third clock signal CLK3, and the fourth clock signal CLK4.

Referring to FIG. 16, the gate driving circuit 130 can receive the four clock signals (CLK1 to CLK4) and output four gate signals (VGATE1 to VGATE4). That is, the gate driving circuit 130 can receive the first clock signal CLK1 and output the first gate signal VGATE1 to a first gate line GL1, receive the second clock signal CLK2 and output the second gate signal VGATE2 to a second gate line GL2, receive the third clock signal CLK3 and output the third gate signal VGATE3 to a third gate line GL3, and receive the fourth clock signal CLK4 and output the fourth gate signal VGATE4 to a fourth gate line GL4.

Referring to FIG. 17, the gate driving circuit 130 may include first to fourth output buffer circuits (GBUF1 to GBUF4) and a control circuit 400 for controlling the first to fourth output buffer circuits (GBUF1 to GBUF4).

The first output buffer circuit GBUF1 can output the first gate signal VGATE1 to the first gate line GL1 through a first gate output terminal Ng1 in response to (based on) the first clock signal CLK1 input to a first clock input terminal Nc1.

The first output buffer circuit GBUF1 may include a first pull-up transistor Tu1 electrically connected between the first clock input terminal Nc1 and the first gate output terminal Ng1, and controlled by a voltage in a Q node Q, and a first pull-down transistor Td1 electrically connected between the first gate output terminal Ng1 and a base input terminal Ns to which a base voltage VSS1 is input, and controlled by a voltage at a QB node QB.

The second output buffer circuit GBUF2 can output the second gate signal VGATE2 to the second gate line GL2 through a second gate output terminal Ng2 in response to (based on) the second clock signal CLK2 input to a second clock input terminal Nc2.

The second output buffer circuit GBUF2 may include a second pull-up transistor Tu2 electrically connected between the second clock input terminal Nc2 and the second gate output terminal Ng2, and controlled by a voltage in the Q node Q, and a second pull-down transistor Td2 electrically connected between the second gate output terminal Ng2 and the base input terminal Ns, and controlled by a voltage at the QB node QB.

The third output buffer circuit GBUF3 can output the third gate signal VGATE3 to the third gate line GL3 through a third gate output terminal Ng3 in response to (based on) the third clock signal CLK3 input to a third clock input terminal Nc3.

The third output buffer circuit GBUF3 may include a third pull-up transistor Tu3 electrically connected between the third clock input terminal Nc3 and the third gate output terminal Ng3, and controlled by a voltage in the Q node Q, and a third pull-down transistor Td3 electrically connected between the third gate output terminal Ng3 and the base input terminal Ns, and controlled by a voltage at the QB node QB.

The fourth output buffer circuit GBUF4 can output the fourth gate signal VGATE4 to the fourth gate line GL4 through a fourth gate output terminal Ng4 in response to (based on) the fourth clock signal CLK4 input to a fourth clock input terminal Nc4.

The fourth output buffer circuit GBUF4 may include a fourth pull-up transistor Tu4 electrically connected between the fourth clock input terminal Nc4 and the fourth gate output terminal Ng4, and controlled by a voltage in the Q node Q, and a fourth pull-down transistor Td4 electrically connected between the fourth gate output terminal Ng4 and the base input terminal Ns, and controlled by a voltage at the QB node QB.

Figure 18:
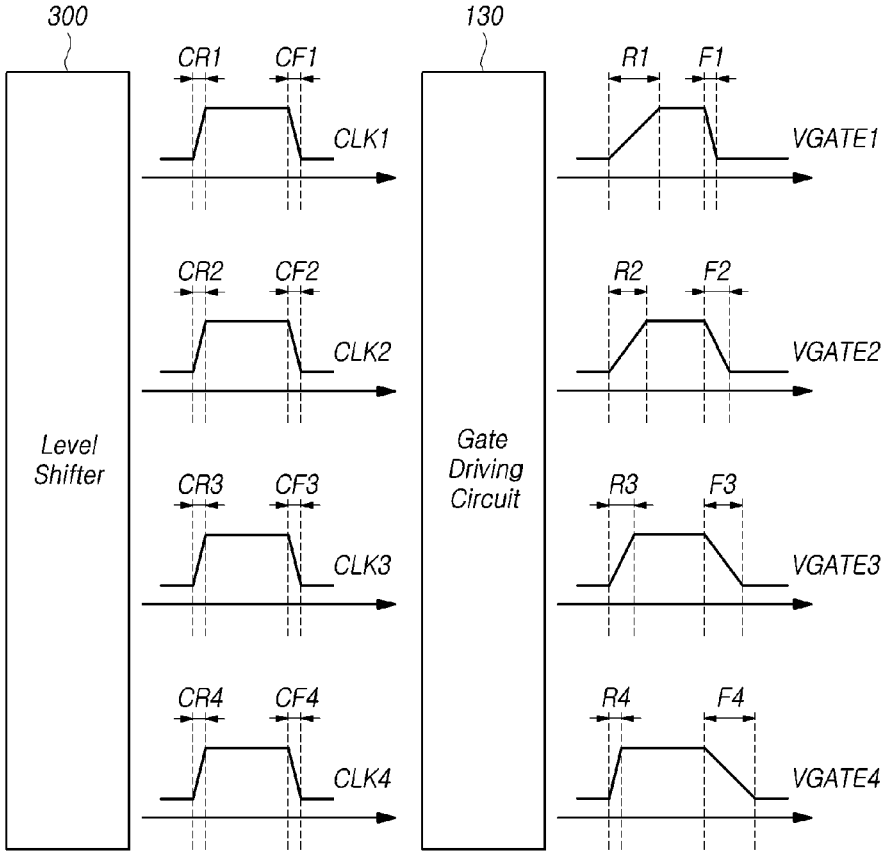
FIG. 18 illustrates characteristic differences between gate signals in the gate signal output system of FIG. 16.
Figure 19:
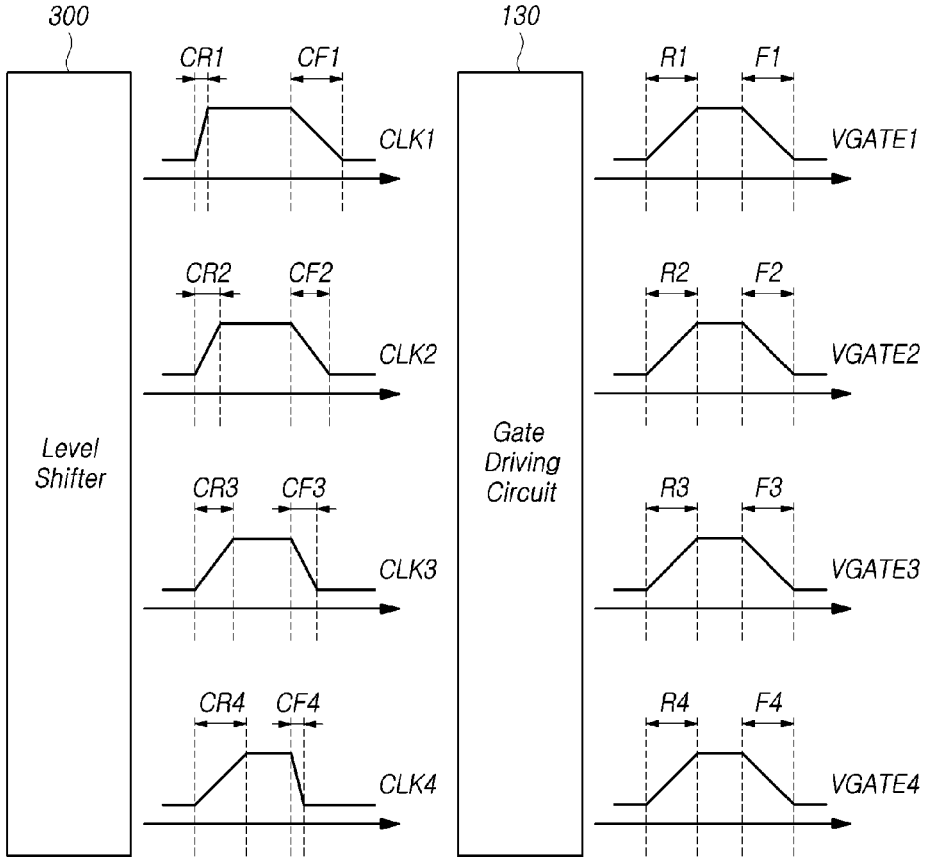
FIG. 19 illustrates compensation for a difference in characteristics between gate signals in the gate signal output system of FIG. 16.

FIG. 18 illustrates a difference in characteristics between gate signals in the gate signal output system (Q node sharing structure in the case of m=4) of FIG. 16. FIG. 19 illustrates compensation for a difference in characteristics between gate signals in the gate signal output system (Q node sharing structure in the case of m=4) of FIG. 16.

Referring to FIG. 18, when m is 4, m number of clock signals (CLK1 to CLKm) may include a first clock signal CLK1, a second clock signal CLK2, a third clock signal CLK3, and a fourth clock signal CLK4, and m number of associated gate signals (VGATE1 to VGATEm) may include a first gate signal VGATE1, a second gate signal VGATE2, a third gate signal VGATE3, and a fourth gate signal VGATE4.

Referring to FIG. 18, the level shifter 300 can output the first to fourth clock signals (CLK1 to CLK4), and the gate driving circuit 130 can output the first to fourth gate signals (VGATE1 to VGATE4) using the first to fourth clock signals (CLK1 to CLK4).

As described above, when the clock signal control function is not performed to compensate for a difference the characteristics between the gate signals, a difference in the characteristics between the gate signals may occur if the gate driving circuit 130 performs the overlap gate driving and has the Q node sharing structure.

The non-performing of the clock signal control function to compensate for a difference in characteristics between the gate signals means that the first to fourth clock signals (CLK1 to CLK4) have an equal signal waveform. Configuring the first to fourth clock signals (CLK1 to CLK4) to have the equal signal waveform means that the first to fourth clock signals (CLK1 to CLK4) have the same rising characteristic (a rising length) and falling characteristic (a falling length).

Referring to FIG. 18, when m=4, assuming that a turn-on voltage level duration of the first gate signal VGATE1 proceeds at the earliest timing and a turn-on voltage level duration of the fourth gate signal VGATE4 proceeds at the latest timing among the first to fourth gate signals (VGATE1 to VGATE4), a rising length R1 in a turn-on voltage level duration of the first gate signal VGATE1 among the first to fourth gate signals (VGATE1 to VGATE4) is the greatest. That is, a rising characteristic of the first gate signal VGATE1 among the first to fourth gate signals (VGATE1 to VGATE4) is the worst.

A falling length F4 in a turn-on voltage level duration of the fourth gate signal VGATE4 among the first to fourth gate signals (VGATE1 to VGATE4) is the greatest. That is, a falling characteristic of the fourth gate signal VGATE4 among the first to fourth gate signals (VGATE1 to VGATE4) is the worst.

Comparing respective rising characteristics (rising lengths) of the first to fourth gate signals (VGATE1 to VGATE4), the first gate signal VGATE1 has the worst rising characteristic, and a degree to which the respective rising characteristics of the remaining gate signals are bad may be in the order of the second gate signal VGATE2, the third gate signal VGATE3, and the fourth gate signal VGATE4. That is, the first gate signal VGATE1 may have the greatest rising length R1, the second gate signal VGATE2 may have the second greatest rising length R2, the third gate signal VGATE3 may have the third greatest rising length R3, and the fourth gate signal VGATE4 may have the smallest rising length R4 (i.e. R1>R2>R3>R4).

In this situation, among the first to fourth gate signals (VGATE1 to VGATE4), while the first gate signal VGATE1 invariably has the greatest rising length R1, differences between the respective rising lengths (R2, R3, R4) of the second to fourth gate signals (VGATE2 to VGATE4) may variously vary.

Comparing respective falling characteristics (falling lengths) of the first to fourth gate signals (VGATE1 to VGATE4), the fourth gate signal VGATE4 has the worst falling characteristic, and a degree to which the respective falling characteristics of the remaining gate signals are bad may be in the order of the third gate signal VGATE3, the second gate signal VGATE2, and the first gate signal VGATE1. That is, the fourth gate signal VGATE4 may have the greatest falling length F4, the third gate signal VGATE3 may have the second greatest falling length F3, the second gate signal VGATE2 may have the third greatest falling length F2, and the first gate signal VGATE1 may have the smallest falling length F1 (i.e. F1<F2<F3<F4).

In this situation, among the first to fourth gate signals (VGATE1 to VGATE4), while the fourth gate signal VGATE4 invariably has the greatest falling length F4, differences between the respective falling lengths (F1, F2, F3) of the first to third gate signals (VGATE1 to VGATE3) may variously vary.

In order to reduce the characteristic differences (rising characteristic differences, falling characteristic differences) between the first to fourth gate signals (VGATE1 to VGATE4) as described above (that is, to compensate for characteristic differences between the gate signals), the level shifter 300 can perform a clock signal control function.

Referring to FIG. 19, in order to reduce characteristic differences (falling characteristic differences) between first to fourth gate signals (VGATE1 to VGATE4), the level shifter 300 can control the respective falling lengths (CF1, CF2, and CF3) of the first to third clock signals (CLK1 to CLK3) to become greater for allowing the respective falling lengths (F1, F2, and F3) of the first to third gate signals (VGATE1 to VGATE3) to have a length similar to the falling length F4 of the fourth gate signal VGATE4 having the worst falling characteristic.

Referring to FIG. 19, the turn-on level voltage duration of the first gate signal VGATE1 and the turn-on level voltage duration of the second gate signal VGATE2 may overlap, and the turn-on level voltage duration of the second gate signal VGATE2 and the turn-on level voltage duration of the third gate signal VGATE3 may overlap, and the turn-on level voltage duration of the third gate signal VGATE3 and the turn-on level voltage duration of the fourth gate signal VGATE4 may overlap.

Referring to FIG. 19, the first gate signal VGATE1 may have its turn-on level voltage duration at an earlier timing than the fourth gate signal VGATE4 that is the latest gate signal VGATEm where m is 4. In this situation, the falling length CF1 of the first clock signal CLK1 may be greater than the falling length CF4 of the fourth clock signal CLK4, or the rising length CR4 of the fourth clock signal CLK4 may be greater than the rising length CR1 of the first clock signal CLK1. Associate discussions are conducted below.

Referring to FIG. 19, as long as the falling length CF4 of the fourth clock signal CLK4 is the smallest, differences between the respective falling lengths (CF1, CF2, and CF3) of the first to third clock signals (CLK1 to CLK3) may be allowed to vary.

Referring to FIG. 19, for example, the fourth clock signal CLK4 has the smallest falling length CF4, the third clock signal CLK3 has the second smallest falling length CF3, the second clock signal CLK2 has the third smallest falling length CF2, and the first clock signal CLK1 has the greatest falling length CF1 (i.e. CF4<CF3<CF2<CF1).

Referring to FIG. 19, in order to reduce characteristic differences (rising characteristic differences) between first to fourth gate signals (VGATE1 to VGATE4), the level shifter 300 can control the respective rising lengths (CR2, CR3, and CR4) of the second to fourth clock signals (CLK2 to CLK4) to become greater for allowing the respective rising lengths (R2, R3, and R4) of the second to fourth gate signals (VGATE2 to VGATE4) to have a length similar to the rising length R1 of the first gate signal VGATE1 having the worst rising characteristic.

Referring to FIG. 19, as long as the rising length CR1 of the first clock signal CLK1 is the smallest, differences between the respective first rising lengths (CR2, CR3, and CR4) of the second to fourth clock signals (CLK2 to CLK4) may be allowed to vary.

Referring to FIG. 19, for example, the first clock signal CLK1 has the smallest rising length CR1, the second clock signal CLK2 has the second smallest rising length CR2, the third clock signal CLK3 has the third smallest rising length CR3, and the fourth clock signal CLK4 has the greatest rising length CR4 (i.e. CR1<CR2<CR3<CR4).

Figure 20:
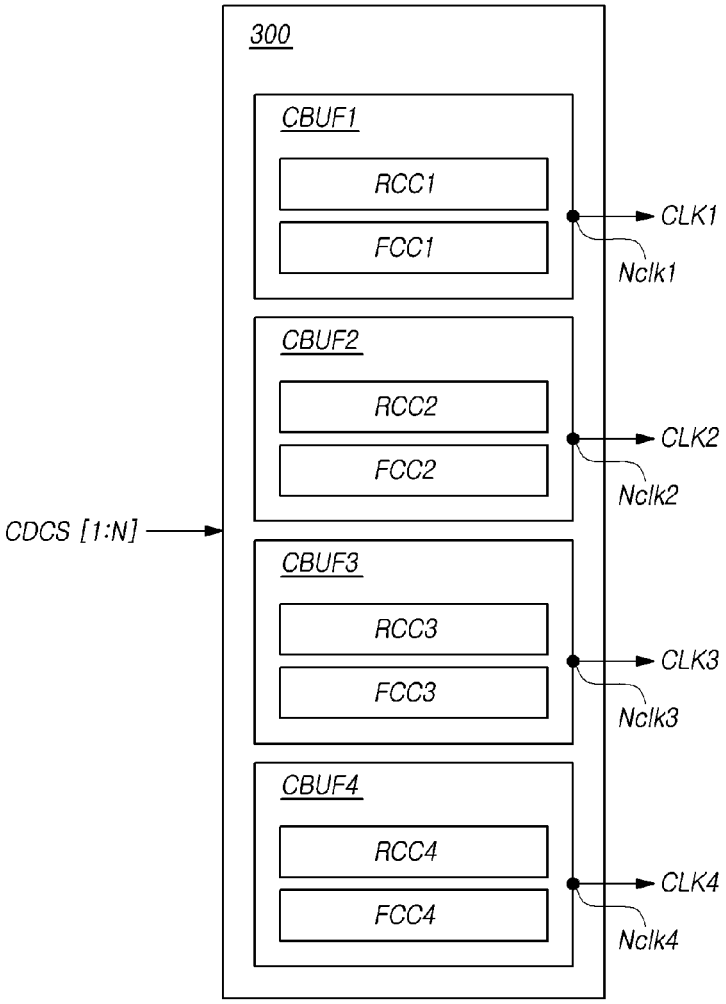
FIG. 20 is a block diagram of the level shifter in the gate signal output system of FIG. 16.
Figure 21:
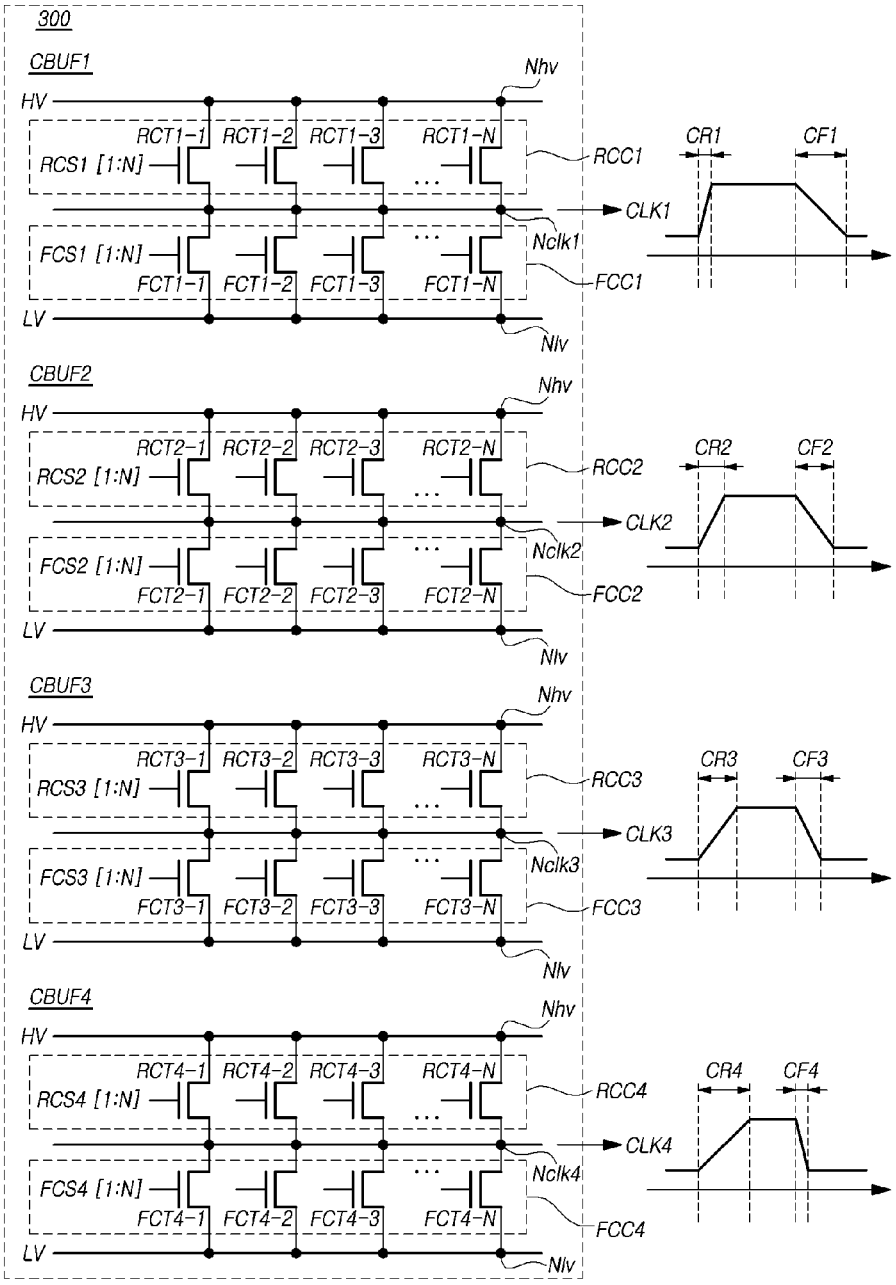
FIG. 21 is a detailed diagram of the level shifter of FIG. 19.

FIG. 20 is a block diagram of the level shifter 300 in the gate signal output system of FIG. 16. FIG. 21 is a detailed diagram of the level shifter 300 of FIG. 19.

Referring to FIGS. 20 and 21, the level shifter 300 can output the first clock signal CLK1, the second clock signal CLK2, the third clock signal CLK3, and the fourth clock signal CLK4 to the gate driving circuit 130.

Referring to FIGS. 20 and 21, the level shifter 300 may include a first clock output buffer CBUF1 for generating the first clock signal CLK1 and outputting the generated first clock signal CLK1 to a first clock output terminal Nclk1, a second clock output buffer CBUF2 for generating the second clock signal CLK2 and outputting the generated second clock signal CLK2 to a second clock output terminal Nclk2, a third clock output buffer CBUF3 for generating the third clock signal CLK3 and outputting the generated third clock signal CLK3 to a third clock output terminal Nclk3, and a fourth clock output buffer CBUF4 for generating the fourth clock signal CLK4 and outputting the generated fourth clock signal CLK4 to a fourth clock output terminal Nclk4.

Referring to FIG. 21, the first clock output buffer CBUF1 may include a first rising control circuit RCC1 including N number of first rising control transistors (RCT1-1 to RCT1-N) electrically connected between a high level voltage node Nhv and the first clock output terminal Nclk1, and a first falling control circuit FCC1 including N number of first falling control transistors (FCT1-1 to FCT1-N) electrically connected between a low level voltage node N1*v* and the first clock output terminal Nclk1, where N is a natural number of 2 or more.

Referring to FIG. 21, the second clock output buffer CBUF2 may include a second rising control circuit RCC2 including N number of second rising control transistors (RCT2-1 to RCT2-N) electrically connected between the high level voltage node Nhv and the second clock output terminal Nclk2, and a second falling control circuit FCC2 including N number of second falling control transistors (FCT2-1 to FCT2-N) electrically connected between the low level voltage node N1*v* and the second clock output terminal Nclk2.

Referring to FIG. 21, the third clock output buffer CBUF3 may include a third rising control circuit RCC3 including N number of third rising control transistors (RCT3-1 to RCT3-N) electrically connected between the high level voltage node Nhv and the third clock output terminal Nclk3, and a third falling control circuit FCC3 including N number of third falling control transistors (FCT3-1 to FCT3-N) electrically connected between the low level voltage node N1*v* and the third clock output terminal Nclk3.

Referring to FIG. 21, the fourth clock output buffer CBUF4 may include a fourth rising control circuit RCC4 including N number of fourth rising control transistors (RCT4-1 to RCT4-N) electrically connected between the high level voltage node Nhv and the fourth clock output terminal Nclk4, and a fourth falling control circuit FCC4 including N number of fourth falling control transistors (FCT4-1 to FCT4-N) electrically connected between the low level voltage node N1*v* and the fourth clock output terminal Nclk4.

Respective turn-ons or/and turn-offs of the N number of control transistors included in at least one of the first rising control circuit RCC1, the first falling control circuit FCC1, the second rising control circuit RCC2, the second falling control circuit FCC2, the third rising control circuit RCC3, the third falling control circuit FCC3, the fourth rising control circuit RCC4, and the fourth falling control circuit FCC4 can be independently controlled.

Referring to FIG. 21, in the first clock output buffer CBUF1, the respective turn-ons or/and turn-offs of the N number of first rising control transistors (RCT1-1 to RCT1-N) can be individually controlled by N number of first rising control signals RCS1 [1:N], and the respective turn-ons or/and turn-offs of the N number of first falling control transistors (FCT1-1 to FCT1-N) can be individually controlled by N number of first falling control signals FCS1 [1:N].

Referring to FIG. 21, in the second clock output buffer CBUF2, the respective turn-ons or/and turn-offs of the N number of second rising control transistors (RCT2-1 to RCT2-N) can be individually controlled by N number of second rising control signals RCS2 [1:N], and the respective turn-ons or/and turn-offs of the N number of second falling control transistors (FCT2-1 to FCT2-N) can be individually controlled by N number of second falling control signals FCS2 [1:N].

Referring to FIG. 21, in the third clock output buffer CBUF3, the respective turn-ons or/and turn-offs of the N number of third rising control transistors (RCT3-1 to RCT3-N) can be individually controlled by N number of third rising control signals RCS3 [1:N], and the respective turn-ons or/and turn-offs of the N number of third falling control transistors (FCT3-1 to FCT3-N) can be individually controlled by N number of third falling control signals FCS3 [1:N].

Referring to FIG. 21, in the fourth clock output buffer CBUF4, the respective turn-ons or/and turn-offs of the N number of fourth rising control transistors (RCT4-1 to RCT4-N) can be individually controlled by N number of fourth rising control signals RCS4 [1:N], and the respective turn-ons or/and turn-offs of the N number of fourth falling control transistors (FCT4-1 to FCT4-N) can be individually controlled by N number of fourth falling control signals FCS4 [1:N].

Referring to FIG. 21, when a falling length CF1 of the first clock signal CLK1 is greater than a falling length CF4 of the fourth clock signal CLK4, the number of turned-on falling control transistors among the N number of first falling control transistors (FCT1-1 to FCT1-N) may be smaller than the number of turned-on falling control transistors among the N number of fourth falling control transistors (FCT4-1 to FCT4-N).

Referring to FIG. 21, when a rising length CR4 of the fourth clock signal CLK4 is greater than a rising length CR1 of the first clock signal CLK1, the number of turned-on rising control transistors among the N number of fourth rising control transistors (RCT4-1 to RCT4-N) may be smaller than the number of turned-on rising control transistors among the N number of first rising control transistors (RCT1-1 to RCT1-N).

Figure 22:
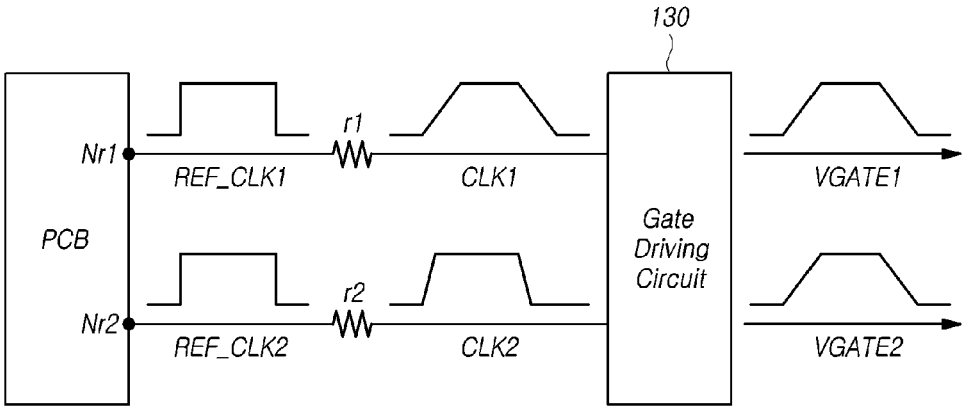
FIG. 22 illustrates compensation for a difference in characteristics between gate signals using resistors in the display device according to aspects of the present disclosure.

FIG. 22 illustrates compensation for a difference in characteristics between gate signals using at least one resistor (r1, r2) in the display device 100 according to aspects of the present disclosure.

Referring to FIG. 22, the display device 100 according to aspects of the present disclosure may include a printed circuit board PCB configured to output a first reference clock signal REF_CLK1 to a first reference clock output terminal Nr1 and output a second reference clock signal REF_CLK2 to a second reference clock output terminal Nr2, a first resistor r1 connected between the first reference clock output terminal Nr1 and the gate driving circuit 130, and a second resistor r2 connected between the second reference clock output terminal Nr2 and the gate driving circuit 130.

Referring to FIG. 22, the first reference clock signal REF_CLK1 and the second reference clock signal REF_CLK2 are uncontrolled clock signals, and respective rising lengths and falling lengths thereof may correspond to each other.

The first resistor r1 and the second resistor r2 may have different resistance values. For example, the first resistor r1 may have a resistance value larger than the second resistor r2. As a resistance value of the first resistor r1 increases, rising and falling lengths of the first clock signal CLK1 may become greater. As a resistance value of the second resistor r2 decreases, rising and falling lengths of the first clock signal CLK1 may become smaller.

The first clock signal CLK1 may be a signal when the first reference clock signal REF_CLK1 passes the first resistor r1 and then enters the gate driving circuit 130. The second clock signal CLK2 may be a signal when the second reference clock signal REF_CLK2 passes the second resistor r2 and then enters the gate driving circuit 130.

FIGS. 23A to 23D illustrates level shifters 300 controlling, and outputting, at least one clock signal (CLK1, CLK2) through a control for resistors, and included in the display device 100 according to aspects of the present disclosure.

Figure 23A:
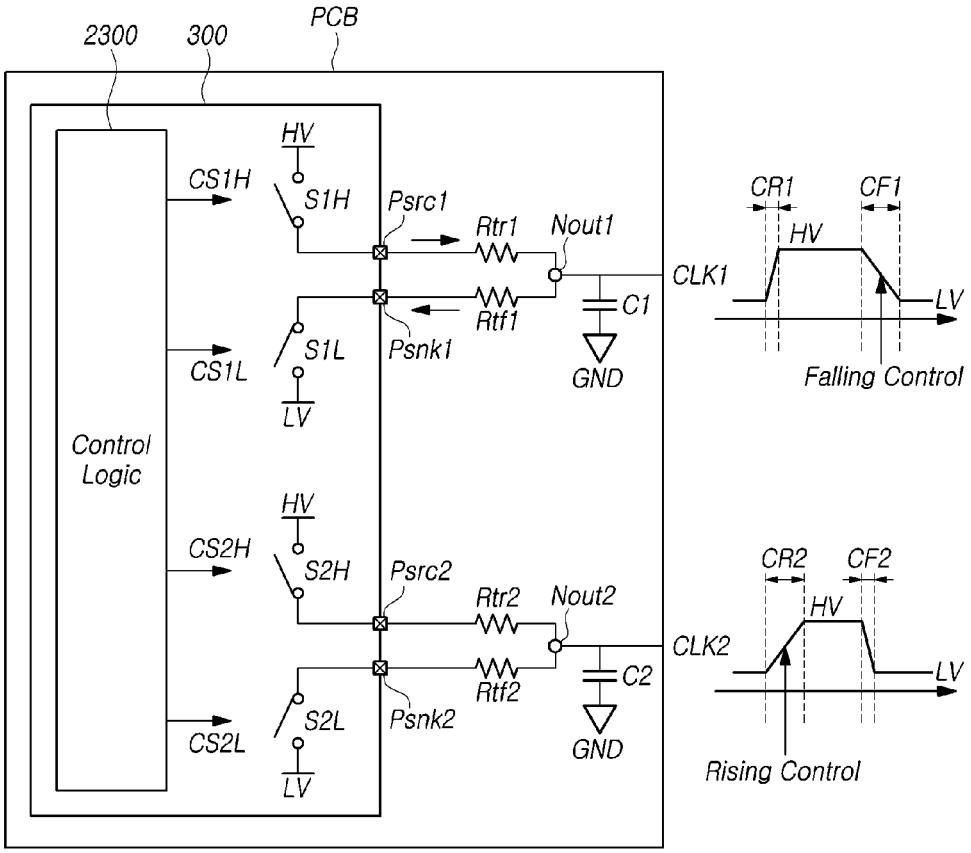
FIGS. 23A to 23E illustrates level shifters controlling, and outputting, clock signals through a control for resistors and included in the display device according to aspects of the present disclosure.

Referring to FIG. 23A, the level shifter 300 can supply m number of clock signals (CLK1 to CLKm) to the gate driving circuit 130. The level shifter 300 may be mounted on, or connected to, a printed circuit board PCB.

The m number of clock signals (CLK1 to CLKm) may include a first clock signal CLK1 and a second clock signal CLK2.

The level shifter 300 may include a first sourcing pin Psrc1, a first sink pin Psnk1, a second sourcing pin Psrc2, and a second sink pin Psnk2.

The level shifter 300 may include a first high level switch S1H located between the first sourcing pin Psrc1 and a node to which a high level voltage HV is applied, and a first low level switch S1L located between the first sink pin Psnk1 and a node to which a low level voltage LV is applied.

The level shifter 300 may include a second high level switch S2H located between the second sourcing pin Psrc2 and a node to which a high level voltage HV is applied, and a second low level switch S2L located between the second sink pin Psnk2 and a node to which a low level voltage LV is applied.

The level shifter 300 may further include a control logic 2300 for outputting control signals (CS1H, CS1L, CS2H, and CS2L) in order to control the respective switching operations of the first high level switch S1H, the first low level switch S1L, the second high level switch S2H, and the second low level switch S2L.

When the first high level switch S1H is turned on, the first clock signal CLK1 may rise to the high level voltage HV, and when the first low level switch S1L is turned on, the first clock signal CLK1 may fall to the low level voltage LV.

When the second high level switch S2H is turned on, the second clock signal CLK2 may rise to the high level voltage HV, and when the second low level switch S2L is turned on, the second clock signal CLK2 may fall to the low level voltage LV.

Each of the first high level switch S1H, the first low level switch S1L, the second high level switch S2H, and the second low level switch S2L described herein may be implemented using a transistor, and the respective control signals (CS1H, CS1L, CS2H, and CS2L) of the first high level switch S1H, the first low level switch S1L, the second high level switch S2H, and the second low level switch S2L may be voltages applied to gate nodes of transistors.

The printed circuit board PCB may include a first rising control resistor Rtr1, a first falling control resistor Rtf1, a second rising control resistor Rtr2, and a second falling control resistor Rtf2, and include a first output node Nout1 from which the first clock signal CLK1 is output to the gate driving circuit 130, and a second output node Nout2 from which the second clock signal CLK2 is output to the gate driving circuit 130.

The first rising control resistor Rtr1 may be electrically connected between the first sourcing pin Psrc1 and the first output node Nout1. The first falling control resistor Rtf1 may be electrically connected between the first sink pin Psnk1 and the first output node Nout1.

The second rising control resistor Rtr2 may be electrically connected between the second sourcing pin Psrc2 and the second output node Nout2. The second falling control resistor Rtf2 may be electrically connected between the second sink pin Psnk2 and the second output node Nout2.

A first capacitor C1 may be connected between the first output node Nout1 and ground GND, and a second capacitor C2 may be connected between the second output node Nout2 and the ground GND.

In order for a falling length CF1 of the first clock signal CLK1 to become greater than a falling length CF2 of the second clock signal CLK2, a resistance value of the first falling control resistor Rtf1 may be set to a value larger than a resistance value of the second falling control resistor Rtf2.

In order for a rising length CR2 of the second clock signal CLK2 to become greater than a rising length CR1 of the first clock signal CLK1, a resistance value of the second rising control resistor Rtr2 may be set to a value larger than a resistance value of the first rising control resistor Rtr1.

Figure 23B:
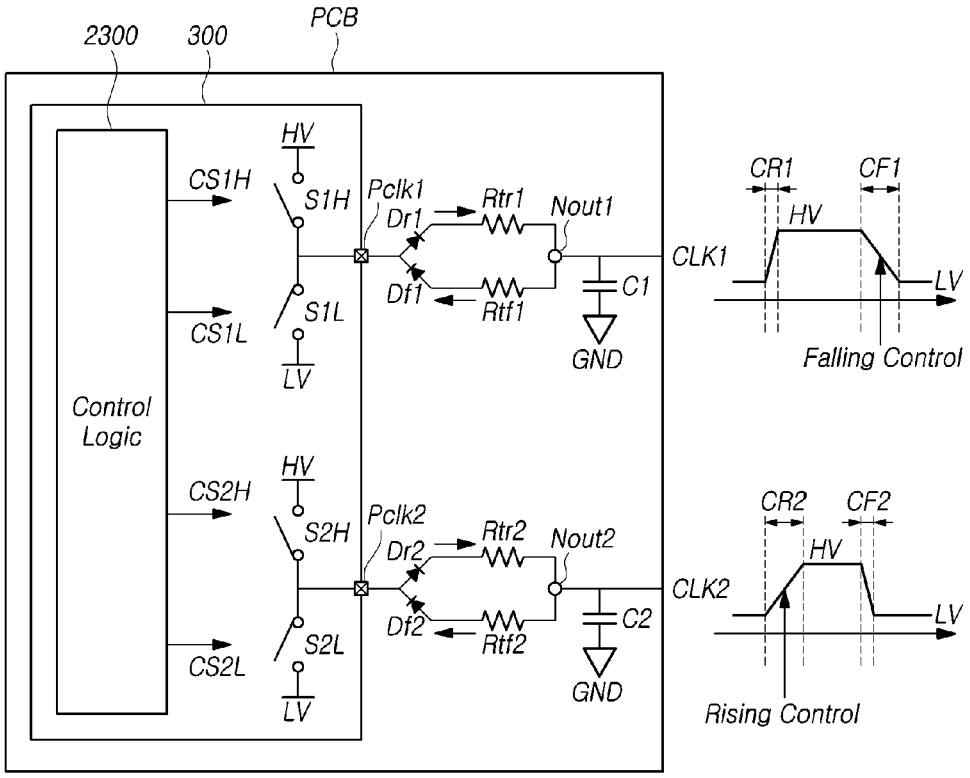

Referring to FIG. 23B, the level shifter 300 may include a first clock signal output pin Pclk1 and a second clock signal output pin Pclk2.

The level shifter 300 may include a first high level switch S1H located between the first clock signal output pin Pclk1 and a node to which a high level voltage HV is applied, and a first low level switch S1L located between the first clock signal output pin Pclk1 and a node to which a low level voltage LV is applied.

The level shifter 300 may include a second high level switch S2H located between the second clock signal output pin Pclk2 and a node to which a high level voltage HV is applied, and a second low level switch S2L located between the second clock signal output pin Pclk2 and a node to which a low level voltage LV is applied.

The level shifter 300 may further include a control logic 2300 for outputting control signals (CS1H, CS1L, CS2H, and CS2L) in order to control the respective switching operations of the first high level switch S1H, the first low level switch S1L, the second high level switch S2H, and the second low level switch S2L.

When the first high level switch S1H is turned on, the first clock signal CLK1 may rise to the high level voltage HV, and when the first low level switch S1L is turned on, the first clock signal CLK1 may fall to the low level voltage LV.

When the second high level switch S2H is turned on, the second clock signal CLK2 may rise to the high level voltage HV, and when the second low level switch S2L is turned on, the second clock signal CLK2 may fall to the low level voltage LV.

The printed circuit board PCB may include a first rising control resistor Rtr1, a first falling control resistor Rtf1, a second rising control resistor Rtr2, and a second falling control resistor Rtf2.

The printed circuit board PCB may include a first output node Nout1 from which the first clock signal CLK1 is output to the gate driving circuit 130, and a second output node Nout2 from which the second clock signal CLK2 is output to the gate driving circuit 130.

The printed circuit board PCB may include a first rising control diode Dr1 and a first falling control diode Df1 for allowing current to flow in directions opposite to each other. The printed circuit board PCB may include a second rising control diode Dr2 and a second falling control diode Df2 for allowing current to flow in directions opposite to each other.

The first rising control diode Dr1 and the first rising control resistor Rtr1 may be connected in series between the first clock signal output pin Pclk1 and the first output node Nout1. The first falling control diode Df1 and the first falling control resistor Rtf1 may be connected in series between the first clock signal output pin Pclk1 and the first output node Nout1.

The second rising control diode Dr2 and the second rising control resistor Rtr2 may be connected in series between the second clock signal output pin Pclk2 and the second output node Nout2. The second falling control diode Df2 and the second falling control resistor Rtf2 may be connected in series between the second clock signal output pin Pclk2 and the second output node Nout2.

A first capacitor C1 may be connected between the first output node Nout1 and ground GND, and a second capacitor C2 may be connected between the second output node Nout2 and the ground GND.

In order for a falling length CF1 of the first clock signal CLK1 to become greater than a falling length CF2 of the second clock signal CLK2, a resistance value of the first falling control resistor Rtf1 may be set to a value larger than a resistance value of the second falling control resistor Rtf2.

In order for a rising length CR2 of the second clock signal CLK2 to become greater than a rising length CR1 of the first clock signal CLK1, a resistance value of the second rising control resistor Rtr2 may be set to a value larger than a resistance value of the first rising control resistor Rtr1.

Figure 23C:
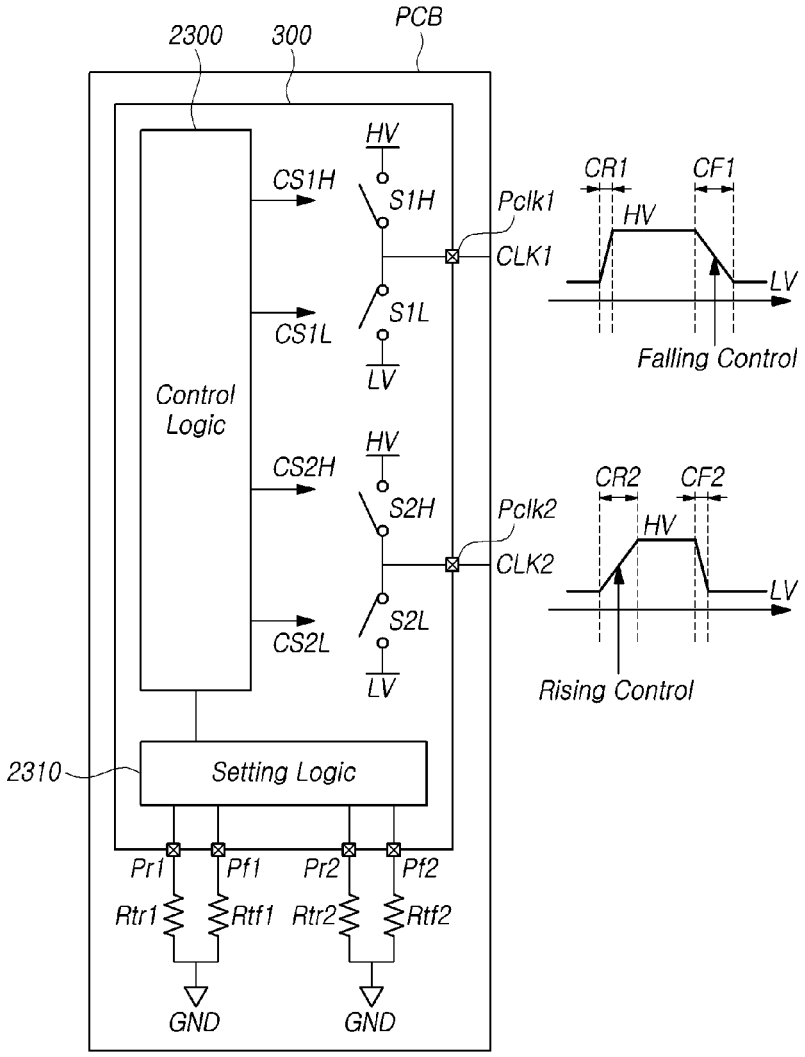

Referring to FIG. 23C, the level shifter 300 may include a first clock signal output pin Pclk1 and a second clock signal output pin Pclk2, and include a first rising setting pin Pr1, a first falling setting pin Pf1, a second rising setting pin Pr2, and a second falling setting pin Pf2.

The level shifter 300 may include a first high level switch S1H located between the first clock signal output pin Pclk1 and a node to which a high level voltage HV is applied, and a first low level switch S1L located between the first clock signal output pin Pclk1 and a node to which a low level voltage LV is applied.

The level shifter 300 may include a second high level switch S2H located between the second clock signal output pin Pclk2 and a node to which a high level voltage HV is applied, and a second low level switch S2L located between the second clock signal output pin Pclk2 and a node to which a low level voltage LV is applied.

The level shifter 300 may further include a control logic 2300 for outputting control signals (CS1H, CS1L, CS2H, and CS2L) in order to control the respective switching operations of the first high level switch S1H, the first low level switch S1L, the second high level switch S2H, and the second low level switch S2L.

When the first high level switch S1H is turned on, the first clock signal CLK1 may rise to the high level voltage HV, and when the first low level switch S1L is turned on, the first clock signal CLK1 may fall to the low level voltage LV.

When the second high level switch S2H is turned on, the second clock signal CLK2 may rise to the high level voltage HV, and when the second low level switch S2L is turned on, the second clock signal CLK2 may fall to the low level voltage LV.

Referring to FIG. 23C, the printed circuit board PCB may include a first rising control resistor Rtr1, a first falling control resistor Rtf1, a second rising control resistor Rtr2, and a second falling control resistor Rtf2.

The first rising control resistor Rtr1 may be electrically connected between the first rising setting pin Pr1 and ground GND. The first falling control resistor Rtf1 may be electrically connected between the first falling setting pin Pf1 and the ground GND.

The second rising control resistor Rtr2 may be electrically connected between the second rising setting pin Pr2 and the ground GND. The second falling control resistor Rtf2 may be electrically connected between the second falling setting pin Pf2 and the ground GND.

Referring to FIG. 23C, the level shifter 300 may further include a setting logic 2310 for detecting a resistance value of the first rising control resistor Rtr1 through the first rising setting pin Pr1, a resistance value of the first falling control resistor Rtf1 through the first falling setting pin Pf1, a resistance value of the second rising control resistor Rtr2 through the second rising setting pin Pr2, and a resistance value of the second falling control resistor Rtf2 through the second falling setting pin Pf2.

For example, the setting logic 2310 can supply a current having a known current value to the first rising setting pin Pr1, thereafter, measure a voltage value at the first rising setting pin Pr1, and then obtain a resistance value of the first rising control resistor Rtr1 by dividing the measured voltage value by the known current value, In this manner, the resistance values of the first falling control resistor Rtf1, the second rising control resistor Rtr2, and the second falling control resistor Rtf2 can also be obtained.

The setting logic 2310 can supply resistance control information on the obtained resistance values to the control logic 2300.

The control logic 2300 can control, using the resistance control information, a level of a resistance value (a turn-on resistance when being turned on) of each of the first high level switch S1H, the first low level switch S1L, the second high level switch S2H, and the second low level switch S2L.

In order for a falling length CF1 of the first clock signal CLK1 to become greater than a falling length CF2 of the second clock signal CLK2, a resistance value of the first low level switch S1L may be set to a value larger than a resistance value of the second low level switch S2L.

In order for a rising length CR2 of the second clock signal CLK2 to become greater than a rising length CR1 of the first clock signal CLK1, a resistance value of the second high level switch S2H may be set to a value larger than a resistance value of the first high level switch S1H.

Figure 23D:
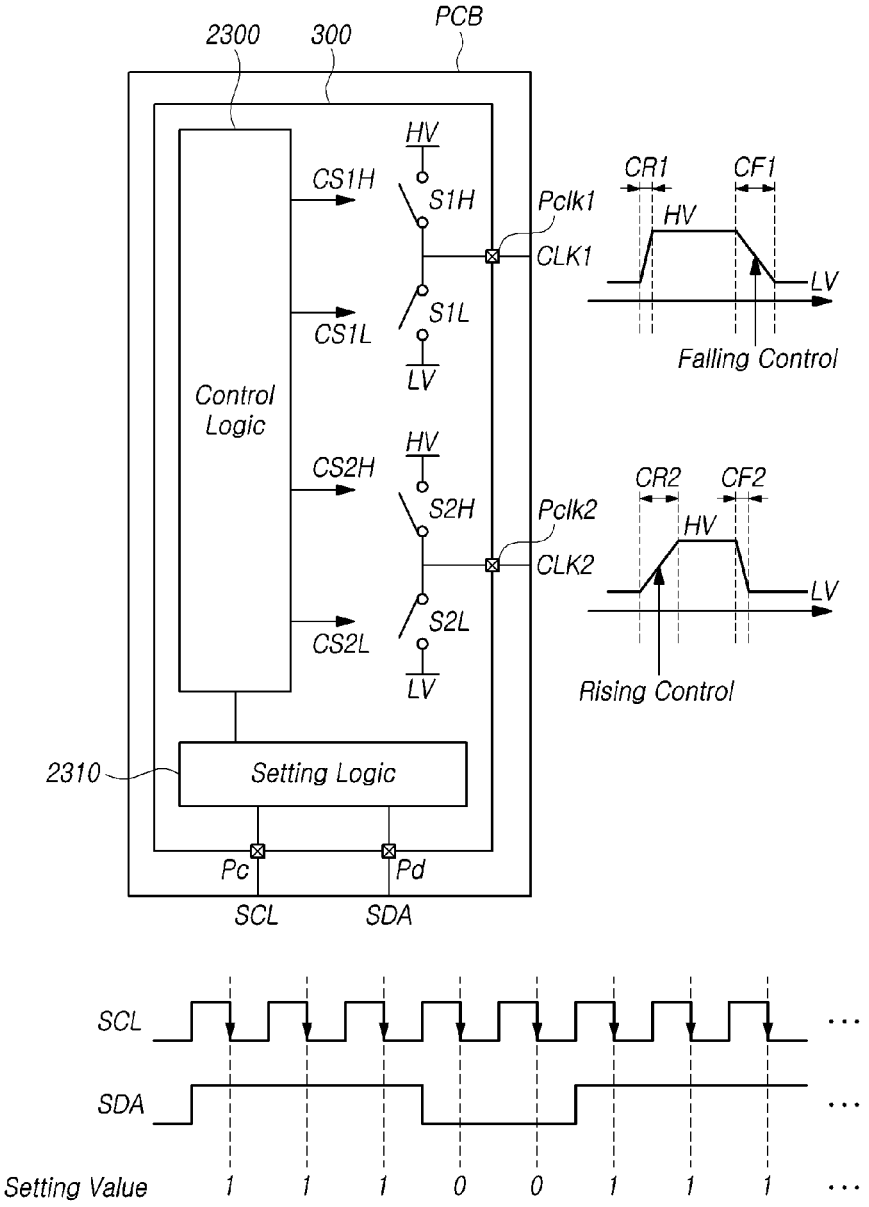

Referring to FIG. 23D, the level shifter 300 may include a first clock signal output pin Pclk1 and a second clock signal output pin Pclk2, and include a control clock port Pc and a control data port Pd.

Referring to FIG. 23D, the level shifter 300 may include a first high level switch S1H located between the first clock signal output pin Pclk1 and a node to which a high level voltage HV is applied, and a first low level switch S1L located between the first clock signal output pin Pclk1 and a node to which a low level voltage LV is applied.

The level shifter 300 may include a second high level switch S2H located between the second clock signal output pin Pclk2 and a node to which a high level voltage HV is applied, and a second low level switch S2L located between the second clock signal output pin Pclk2 and a node to which a low level voltage LV is applied.

The level shifter 300 may further include a control logic 2300 for outputting control signals (CS1H, CS1L, CS2H, and CS2L) in order to control the respective switching operations of the first high level switch S1H, the first low level switch S1L, the second high level switch S2H, and the second low level switch S2L.

When the first high level switch S1H is turned on, the first clock signal CLK1 may rise to the high level voltage HV, and when the first low level switch S1L is turned on, the first clock signal CLK1 may fall to the low level voltage LV.

The level shifter 300 can receive a control clock signal SCL from the controller 140 through the control clock port Pc, and receive control data SDA for controlling the respective signal waveforms of the first and second clock signals (CLK1 and CLK2) from the controller 140 through the control data port Pd.

The level shifter 300 may further include a setting logic 2310 for detecting a setting value using the control clock signal SCL and the control data SDA, and supplying predefined resistance control information corresponding to the detected setting value to the control logic 2300. The setting logic 2310 may be implemented using a register.

Referring to FIG. 23D, for example, the setting logic 2310 can identify a voltage level of the control data SDA for each falling timing (or rising timing) of the control clock signal SCL, obtain a bit stream (11100111) as a setting value by comparing the identified voltage level with a reference voltage level to observe whether the identified voltage level is larger or smaller than the reference voltage level or the extent to which the identified voltage level is larger or smaller than the reference voltage level, and derive control information corresponding to the obtained setting value using a correspondence table between predefined setting values and the resistance control information.

The setting logic 2310 can supply resistance control information on obtained resistance values to the control logic 2300.

The control logic 2300 can control, using the resistance control information, a level of a resistance value (a turn-on resistance when being turned on) of each of the first high level switch S1H, the first low level switch S1L, the second high level switch S2H, and the second low level switch S2L.

In order for a falling length CF1 of the first clock signal CLK1 to become greater than a falling length CF2 of the second clock signal CLK2, a resistance value of the first low level switch S1L may be set to a value larger than a resistance value of the second low level switch S2L.

In order for a rising length CR2 of the second clock signal CLK2 to become greater than a rising length CR1 of the first clock signal CLK1, a resistance value of the second high level switch S2H may be set to a value larger than a resistance value of the first high level switch S1H.

Figure 23E:
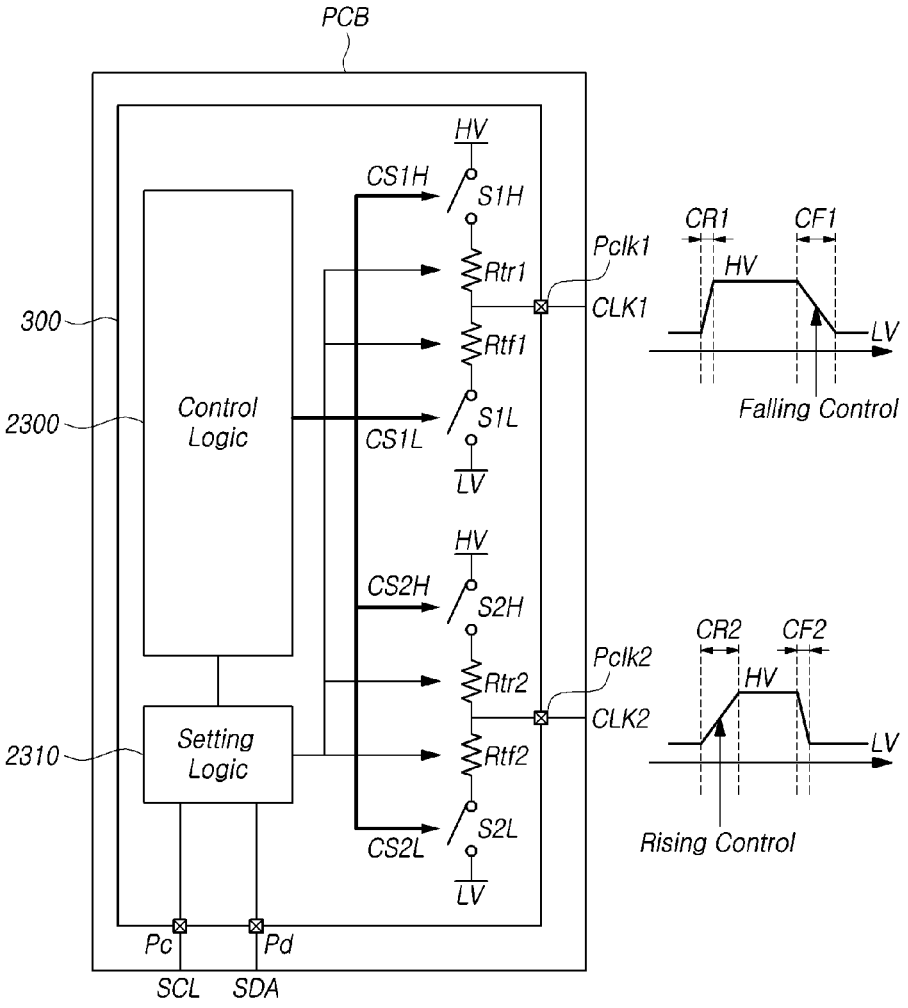

Referring to FIG. 23E, the level shifter 300 may include a first clock signal output pin Pclk1 and a second clock signal output pin Pclk2, and include a control clock port Pc and a control data port Pd.

Referring to FIG. 23E, the level shifter 300 may include a first rising control resistor Rtr1, a first falling control resistor Rtf1, a second rising control resistor Rtr2, and a second falling control resistor Rtf2.

The level shifter 300 may include a first high level switch S1H, a first low level switch S1L, a second high level switch S2H, and a second low level switch S2L.

The first high level switch S1H and the first rising control resistor Rtr1 may be connected in series between the first clock signal output pin Pclk1 and a node to which a high level voltage HV is applied. The first low level switch S1L and the first falling control resistor Rtf1 may be connected in series between the first clock signal output pin Pclk1 and a node to which a low level voltage LV is applied.

The second high level switch S2H and the second rising control resistor Rtr2 may be connected in series between the second clock signal output pin Pclk2 and a node to which a high level voltage HV is applied. The second low level switch S2L and the second falling control resistor Rtf2 may be connected in series between the second clock signal output pin Pclk2 and a node to which a low level voltage LV is applied.

The level shifter 300 may further include a control logic 2300 for outputting control signals (CS1H, CS1L, CS2H, and CS2L) in order to control the respective switching operations of the first high level switch S1H, the first low level switch S1L, the second high level switch S2H, and the second low level switch S2L.

When the first high level switch S1H is turned on, the first clock signal CLK1 may rise to the high level voltage HV, and when the first low level switch S1L is turned on, the first clock signal CLK1 may fall to the low level voltage LV.

The level shifter 300 can receive a control clock signal SCL from the controller 140 through the control clock port Pc, and receive control data SDA for controlling the respective signal waveforms of the first and second clock signals (CLK1 and CLK2) from the controller 140 through the control data port Pd.

The level shifter 300 may further include a setting logic 2310 for detecting a setting value using the control clock signal SCL and the control data SDA, and supplying predefined resistance control information corresponding to the detected setting value to the control logic 2300. The setting logic 2310 may be implemented using a register.

Referring to FIG. 23D, for example, the setting logic 2310 can identify a voltage level of the control data SDA for each falling timing (or rising timing) of the control clock signal SCL, obtain a bit stream (11100111) as a setting value by comparing the identified voltage level with a reference voltage level to observe whether the identified voltage level is larger or smaller than the reference voltage level or the extent to which the identified voltage level is larger or smaller than the reference voltage level, and derive control information corresponding to the obtained setting value using a correspondence table between predefined setting values and the resistance control information.

The setting logic 2310 may control, using a software tool, respective resistance values of the first rising control resistor Rtr1, the first falling control resistor Rtf1, the second rising control resistor Rtr2, and the second falling control resistor Rtf2 based on the control information.

In order for a falling length CF1 of the first clock signal CLK1 to become greater than a falling length CF2 of the second clock signal CLK2, a resistance value of the first falling control resistor Rtf1 may be set to a value larger than a resistance value of the second falling control resistor Rtf2.

In order for a rising length CR2 of the second clock signal CLK2 to become greater than a rising length CR1 of the first clock signal CLK1, a resistance value of the second rising control resistor Rtr2 may be set to a value larger than a resistance value of the first rising control resistor Rtr1.

Meanwhile, the respective resistance values of the first rising control resistor Rtr1, the first falling control resistor Rtf1, the second rising control resistor Rtr2, and the second falling control resistor Rtf2 may be the respective resistance values (turn-on resistances when being turned on) of the first high level switch S1H, the first low level switch S1L, the second high level switch S2H, and the second low level switch S2L, respectively.

In this situation, the setting logic 2300 can control a level of a resistance value (a turn-on resistance when being turned on) of each of the first high level switch S1H, the first low level switch S1L, the second high level switch S2H, and the second low level switch S2L.

In order for a falling length CF1 of the first clock signal CLK1 to become greater than a falling length CF2 of the second clock signal CLK2, a resistance value of the first low level switch S1L may be set to a value larger than a resistance value of the second low level switch S2L.

In order for a rising length CR2 of the second clock signal CLK2 to become greater than a rising length CR1 of the first clock signal CLK1, a resistance value of the second high level switch S2H may be set to a value larger than a resistance value of the first high level switch S1H.

A method of controlling a level of a resistance value (a turn-on resistance when being turned on) of at least one switch of the first high level switch S1H, the first low level switch S1L, the second high level switch S2H, and the second low level switch (S1H) included in the level shifters 300 of FIGS. 23C, 23D and 23E may include a method of controlling the number of turned-on switches of parallel switches and a method of controlling a voltage of a control signal.

The method of adjusting the number of turned-on switches of parallel switches is as follows.

As illustrated in FIGS. 10A to 10D, 11A to 11D, 12, 14 and 21, in a situation where a switch is configured, a resistance value of which is needed to be adjusted, with a plurality of sub-switches (e.g., RCT1-1 to RCT1-N) connected in parallel, a resistance value of the switch can be controlled by adjusting the number of turned-on switches of the plurality of sub-switches connected in parallel.

The method of controlling a voltage of a control signal is a method of controlling voltages of the control signals (CS1H, CS1L, CS2H, and CS2L) controlling the turn-ons and/or turn-offs of switches. This will be described in more detail with reference to FIG. 24.

Figure 24:
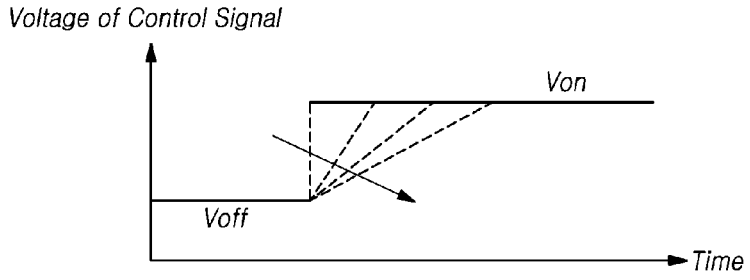
FIG. 24 illustrates a control signal for controlling a resistance level of a switching element in the level shifter included in the display device according to aspects of the present disclosure.

FIG. 24 is a diagram illustrating a control signal CS for controlling resistance levels of the switches (S1H, S1L, S2H, and S2L) in the level shifter 300 included in the display device 100 according to aspects of the present disclosure.

Referring to FIG. 24, a voltage variance of a control signal (a corresponding signal of the control signals (C S1H, C S1L, CS2H, and CS2L)) can be controlled in order to control a level of a resistance value (a turn-on resistance when being turned on) of at least one switch of the first high level switch S1H, the first low level switch S1L, the second high level switch S2H, and the second low level switch S2L included in the level shifters 300 of FIGS. 23C, 23D and 23E.

In order to allow a falling length CF1 of the clock signal CLK1 to become greater, discussions will be given on an example of controlling a resistance value of the first low level switch S1L.

The control logic 2300 can switch a voltage of the control signal CS1L applied to the first low level switch S1L from an off-voltage Voff to an on-voltage Von in order to turn on the first low level switch S1L.

In order to increase a resistance value of the first low level switch S1L, when switching the voltage of the control signal CS1L from the off-voltage Voff to the on-voltage Von, the control logic 2300 can switch from the off-voltage Voff to the on-voltage Von at a relatively reduced speed.

As shown in FIG. 24, as the voltage of the control signal CS1L applied to the first low-level switch S1L is slowly switched from the off-voltage Voff to the on-voltage Von (that is, as a slope in the graph of FIG. 24 becomes more gentle), current through the first low level switch S1L flows more slowly, this producing an effect equal to an increase in the resistance value of the first low level switch S1L.

Figure 25:
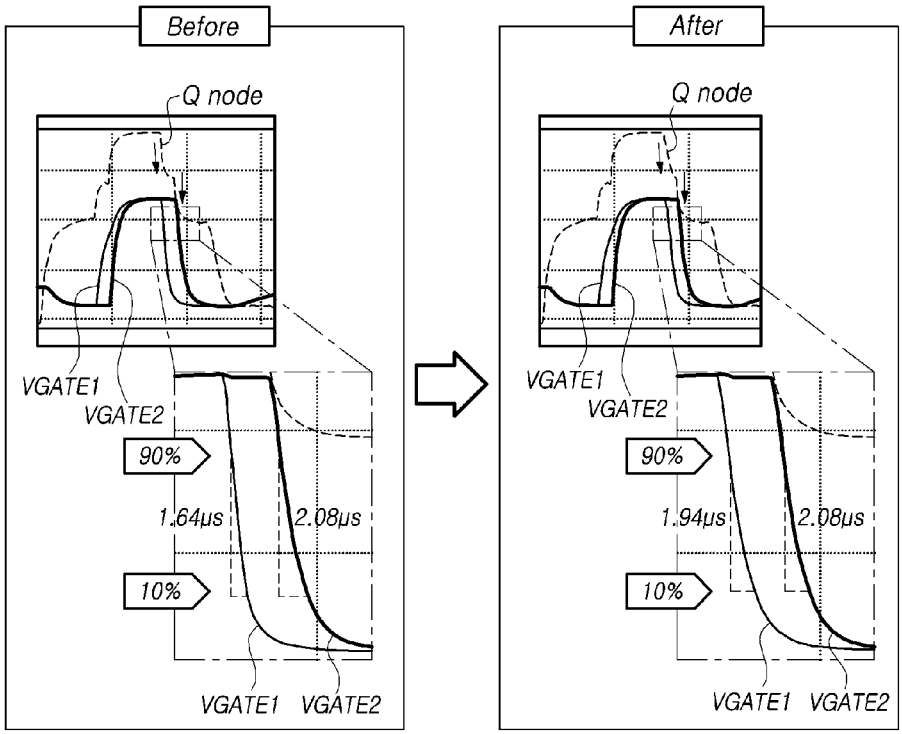
FIG. 25 illustrates an effect of compensation for a difference in characteristics between gate signals under a Q node sharing structure as in FIGS. 6A and 6B in the display device according to aspects of the present disclosure.

FIG. 25 illustrates an effect of compensation for a difference in characteristics between gate signals when the Q node sharing structure as in FIGS. 6A and 6B is applied in the display device 100 according to aspects of the present disclosure.

FIG. 25 shows graphs for a first gate signal VGATE1, a second gate signal VGATE2, and a Q node voltage before and after the characteristic difference compensation control between gate signals is applied in the case of m=2.

Referring to FIG. 25, before the characteristic difference compensation control between the gate signals is applied, falling characteristics of the first and second gate signals (VGATE1 and VGATE2) are as follows. In this case, a falling length represents a difference between a time when a voltage level reaches 90% of a voltage value before the falling and a time when the voltage level reaches 10% of the voltage value before the falling.

Referring to FIG. 25, before the characteristic difference compensation control between the gate signals is applied, a falling length of the first gate signal VGATE1 is 1.64 μs. A falling length of the second gate signal VGATE2 is 2.08 μs.

Referring to FIG. 25, before the characteristic difference compensation control between the gate signals is applied, a difference in the falling lengths (a falling difference) between the first gate signal VGATE1 and the second gate signal VGATE2 is 0.44 μs (=2.08-1.61).

It should be noted that in the effect verification simulation, when the characteristic difference compensation control between the gate signals is applied, only a falling control for allowing a falling length CF1 of a first clock signal CLK1 to become greater is applied.

Referring to FIG. 25, a falling characteristic of the first gate signal VGATE1 after the characteristic difference compensation control between the gate signals is applied as follows. Through the falling process of the first gate signal VGATE1, when being measured in terms of the falling length, a difference between a time when a voltage level reaches 90% of a voltage value before the falling and a time when the voltage level reaches 10% of the voltage value before the falling represents 1.94 μs that is extended from 1.64 μs measured before the characteristic difference compensation control is applied.

Referring to FIG. 25, a falling characteristic of the second gate signal VGATE2 after the characteristic difference compensation control between the gate signals is applied as follows. Through the falling process of the second gate signal VGATE2, when being measured in terms of the falling length, a difference between a time when a voltage level reaches 90% of a voltage value before the falling and a time when the voltage level reaches 10% of the voltage value before the falling represents 2.08 μs.

Referring to FIG. 25, after the characteristic difference compensation control between the gate signals is applied, a difference in the falling lengths (a falling difference) between the first gate signal VGATE1 and the second gate signal VGATE2 is 0.14 μs (=2.08-1.94). This is a value significantly reduced from 0.44 μs that is a difference value between the falling lengths before the characteristic difference compensation control between the gate signals is applied.

Accordingly, a difference in the falling characteristics between the first gate signal VGATE1 and the second gate signal VGATE2 can be reduced through the falling control of the first clock signal CLK1.

Figure 26:
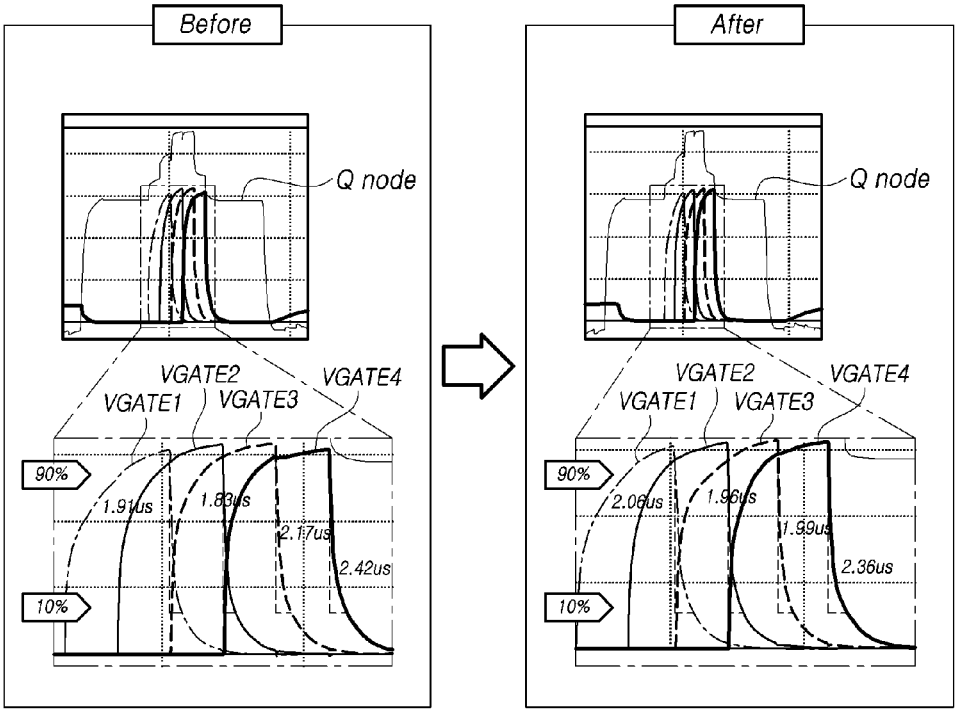
FIG. 26 illustrates an effect of compensation for a difference in characteristics between gate signals under a Q node sharing structure as in FIG. 17 in the display device according to aspects of the present disclosure.

FIG. 26 illustrates an effect of the function of compensating for a difference characteristics between gate signals when the Q node sharing structure (m=4) as in FIG. 17 is applied in the display device 100 according to aspects of the present disclosure.

FIG. 26 shows graphs for first to fourth gate signals (VGATE1 to VGATE4), and a Q node voltage before and after the characteristic difference compensation control between gate signals is applied in the case of m=4.

Referring to FIG. 26, before the characteristic difference compensation control between the gate signals is applied, falling characteristics of the first to fourth gate signals (VGATE1 to VGATE4) are as follows. In this case, a falling length represents a difference between a time when a voltage level reaches 90% of a voltage value before the falling and a time when the voltage level reaches 10% of the voltage value before the falling.

Referring to FIG. 26, before the characteristic difference compensation control between the gate signals is applied, a falling length of the first gate signal VGATE1 is 1.91 μs. A falling length of the second gate signal VGATE2 is 1.83 μs. A falling length of the third gate signal VGATE3 is 2.17 μs. A falling length of the fourth gate signal VGATE4 is 2.42 μs.

Referring to FIG. 26, before the characteristic difference compensation control between the gate signals is applied, a maximum difference in the falling lengths (a maximum falling difference) between the first to fourth gate signals (VGATE1 to VGATE4) is 0.59 μs (=2.42-1.83).

It should be noted that in the effect verification simulation, when the characteristic difference compensation control between the gate signals is applied, a falling control is applied for allowing: a falling length CF1 of a first clock signal CLK1 to become greatest; a falling length CF2 of a second clock signal CLK2 to become second greatest; and a falling length CF3 of a third clock signal CLK3 to become smaller than the falling length CF2 of the second clock signal CLK2.

Referring to FIG. 26, after the characteristic difference compensation control between the gate signals is applied, falling characteristics of the first to fourth gate signals (VGATE1 to VGATE4) are as follows.

Referring to FIG. 26, after the characteristic difference compensation control between the gate signals is applied, a falling length of the first gate signal VGATE1 is 2.061 μs. A falling length of the second gate signal VGATE2 is 1.96 μs. A falling length of the third gate signal VGATE3 is 1.99 μs. A falling length of the fourth gate signal VGATE4 is 2.36 μs.

Referring to FIG. 26, after the characteristic difference compensation control between the gate signals is applied, a maximum difference in the falling lengths (a maximum falling difference) between the first to fourth gate signals (VGATE1 to VGATE4) is 0.40 μs (=2.36-1.96). This is a value significantly reduced from 0.59 μs that is a difference value between the falling lengths before the characteristic difference compensation control between the gate signals is applied.

Accordingly, a difference in the falling characteristics between the first to fourth gate signals (VGATE1 to VGATE4) can be reduced through the falling control of the first to fourth clock signals (CLK1 to CLK4).

According to the aspects described herein, it is possible to provide the level shifter 300, the gate driving circuit 130, and the display device 100, which are capable of reducing differences in characteristics between gate signals, and thereby, improving image quality.

According to the aspects described herein, it is possible to provide the level shifter 300 capable of variously controlling rising characteristics and falling characteristics of clock signals, and gate driving circuit 130 and the display device 100 that use the level shifter 300.

According to the aspects described herein, it is possible to provide the level shifter 300, the gate driving circuit 130, and the display device 100, which are capable of reducing a size of an area in which the gate driving circuit is disposed even when the gate driving circuit is embedded in the display panel as an embedded type, and reducing differences in characteristics between gate signals.

The above description has been presented to enable any person skilled in the art to make and use the technical idea of the present disclosure, and has been provided in the context of a particular application and its requirements. Various modifications, additions and substitutions to the described aspects will be readily apparent to those skilled in the art, and the general principles defined herein may be applied to other aspects and applications without departing from the spirit and scope of the present disclosure. The above description and the accompanying drawings provide an example of the technical idea of the present disclosure for illustrative purposes only. That is, the disclosed aspects are intended to illustrate the scope of the technical idea of the present disclosure. Thus, the scope of the present disclosure is not limited to the aspects shown, but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A display device comprising:

a substrate;

m number of gate lines disposed over the substrate where m is a natural number of 2 or more; and a gate driving circuit disposed over the substrate and configured to supply m number of gate signals based on m number of clock signals to the m number of gate lines, wherein the gate driving circuit comprises m number of output buffer circuits configured to output the m number of gate signals based on the m number of clock signals, and a control circuit configured to control the m number of output buffer circuits, wherein each of the m number of output buffer circuits comprises a pull-up transistor and a pull-down transistor, and a point at which the pull-up transistor and the pull-down transistor are connected is electrically connected with a corresponding gate line among the m number of gate lines, wherein all gate nodes of the pull-up transistors included in the m number of output buffer circuits are electrically connected with one another, and all gate nodes of the pull-down transistors included in the m number of output buffer circuits are electrically connected with one another, and wherein a signal waveform of at least one of the m number of clock signals is different from at least one signal waveforms of at least one other clock signals of the m number of clock signals.

2. The display device according to claim 1, wherein the m number of gate signals comprises a first gate signal having a turn-on level voltage duration at the earliest timing and an m-th gate signal having a turn-on level voltage duration at the latest timing, wherein the m number of clock signals comprises a first clock signal corresponding to the first gate signal, and an m-th clock signal corresponding to the m-th gate signal, and wherein a falling length of the first clock signal is greater than a falling length of the m-th clock signal.

3. The display device according to claim 2, wherein a difference between a falling length of the first gate signal and a falling length of the m-th gate signal is smaller than a difference between the falling length of the first clock signal and the falling length of the m-th clock signal.

4. The display device according to claim 1, wherein the m number of gate signals comprises a first gate signal having a turn-on level voltage duration at an earliest timing and an m-th gate signal having a turn-on level voltage duration at a latest timing, wherein the m number of clock signals comprises a first clock signal corresponding to the first gate signal, and an m-th clock signal corresponding to the m-th gate signal, and wherein a rising length of the m-th clock signal is greater than a rising length of the first clock signal.

5. The display device according to claim 4, wherein a difference between a rising length of the first gate signal and a rising length of the m-th gate signal is smaller than a difference between the rising length of the first clock signal and the rising length of the m-th clock signal.

6. The display device according to claim 1, wherein, when the m is 2, the m number of clock signals comprises a first clock signal and a second clock signal, and the m number of gate signals comprises a first gate signal and a second gate signal, wherein the gate driving circuit is capable of outputting the first gate signal to a first gate line according to the first clock signal, and outputting the second gate signal to a second gate line according to the second clock signal, wherein a turn-on level voltage duration of the first gate signal and a turn-on level voltage duration of the second gate signal overlap, and the turn-on level voltage duration of the first gate signal is placed at a timing earlier than that of the second gate signal, and wherein a falling length of the first clock signal is greater than a falling length of the second clock signal, or a rising length of the second clock signal is greater than a rising length of the first clock signal.

7. The display device according to claim 6, wherein the gate driving circuit comprising:

a first output buffer circuit configured to output the first gate signal to the first gate line through a first gate output terminal in response to the first clock signal input to a first clock input terminal;

a second output buffer circuit configured to output the second gate signal to the second gate line through a second gate output terminal in response to the second clock signal input to a second clock input terminal; and a control circuit configured to control the first output buffer circuit and the second output buffer circuit, wherein the first output buffer circuit comprises a first pull-up transistor electrically connected between the first clock input terminal and the first gate output terminal and controlled by a voltage at a Q node, and a first pull-down transistor electrically connected between the first gate output terminal and a base input terminal to which a base voltage is input, and controlled by a voltage at a QB node, and wherein the second output buffer circuit comprises a second pull-up transistor electrically connected between the second clock input terminal and the second gate output terminal and controlled by the voltage at the Q node, and a second pull-down transistor electrically connected between the second gate output terminal and the base input terminal, and controlled by the voltage at the QB node.

8. The display device according to claim 7, wherein the first output buffer circuit further comprises a first additional pull-down transistor electrically connected between the first gate output terminal and the base input terminal, and controlled by a voltage at another QB node different from the QB node, wherein the second output buffer circuit further comprises a second additional pull-down transistor electrically connected between the second gate output terminal and the base input terminal, and controlled by the voltage at the another QB node, and wherein the first pull-down transistor and the first additional pull-down transistor operate alternately, and the second pull-down transistor and the second additional pull-down transistor operate alternately.

9. The display device according to claim 6, further comprising a level shifter configured to output the first clock signal and the second clock signal to the gate driving circuit, wherein the level shifter comprises:

a first clock output buffer for generating the first clock signal and outputting the generated first clock signal to the first clock output terminal; and a second clock output buffer for generating the second clock signal and outputting the generated second clock signal to the second clock output terminal, wherein the first clock output buffer comprises a first rising control circuit including N number of first rising control transistors electrically connected between a high level voltage node and the first clock output terminal where N is a natural number of 2 or more, and a first falling control circuit including N number of first falling control transistors electrically connected between a low level voltage node and the first clock output terminal, wherein the second clock output buffer comprises a second rising control circuit including N number of second rising control transistors electrically connected between the high level voltage node and the second clock output terminal, where a second falling control circuit including N number of second falling control transistors electrically connected between the low level voltage node and the second clock output terminal, and wherein respective turn-ons and turn-offs of N number of control transistors included in at least one of the first rising control circuit, the first falling control circuit, the second rising control circuit, and the second falling control circuit are independently controlled.

10. The display device according to claim 9, wherein the falling length of the first clock signal is greater than the falling length of the second clock signal, and wherein the number of turned-on falling control transistors among the N number of first falling control transistors is smaller than the number of turned-on falling control transistors among the N number of second falling control transistors.

11. The display device according to claim 9, wherein the rising length of the second clock signal is greater than the rising length of the first clock signal, and wherein the number of turned-on rising control transistors among the N number of second rising control transistors is smaller than the number of turned-on rising control transistors among the N number of first rising control transistors.

12. The display device according to claim 1, further comprising a level shifter configured to supply the m number of clock signals to the gate driving circuit, and a printed circuit board to which the level shifter is connected or on which the level shifter is mounted, wherein the m number of clock signals comprise a first clock signal and a second clock signal, wherein the level shifter comprises a first sourcing pin, a first sink pin, a second sourcing pin, and a second sink pin, wherein the printed circuit board comprises a first rising control resistor, a first falling control resistor, a second rising control resistor, a second falling control resistor, a first output node from which the first clock signal is output to the gate driving circuit, and a second output node from which the second clock signal is output to the gate driving circuit, wherein the first rising control resistor is electrically connected between the first sourcing pin and the first output node, and the first falling control resistor is electrically connected between the first sink pin and the first output node, and wherein the second rising control resistor is electrically connected between the second sourcing pin and the second output node, and the second falling control resistor is electrically connected between the second sink pin and the second output node.

13. The display device according to claim 1, further comprising a level shifter configured to supply the m number of clock signals to the gate driving circuit, and a printed circuit board to which the level shifter is connected or on which the level shifter is mounted, wherein the m number of clock signals comprise a first clock signal and a second clock signal, wherein the level shifter comprises a first clock signal output pin, and a second clock signal output pin, wherein the printed circuit board comprises a first rising control resistor, a first falling control resistor, a second rising control resistor, a second falling control resistor, a first output node from which the first clock signal is output to the gate driving circuit, a second output node from which the second clock signal is output to the gate driving circuit, a first rising control diode and a first falling control diode for allowing current to flow in directions opposite to each other, and a second rising control diode and a second falling control diode for allowing current to flow in directions opposite to each other, wherein the first rising control diode and the first rising control resistor are connected in series between the first clock signal output pin and the first output node, and the first falling control diode and the first falling control resistor are connected in series between the first clock signal output pin and the first output node, and wherein the second rising control diode and the second rising control resistor are connected in series between the second clock signal output pin and the second output node, and the second falling control diode and the second falling control resistor are connected in series between the second clock signal output pin and the second output node.

14. The display device according to claim 1, further comprising a level shifter configured to supply the m number of clock signals to the gate driving circuit, and a printed circuit board to which the level shifter is connected or on which the level shifter is mounted, wherein the m number of clock signals comprise a first clock signal and a second clock signal, wherein the level shifter comprises a first clock signal output pin, a second clock signal output pin, a first rising setting pin, a first falling setting pin, a second rising setting pin, and a second falling setting pin, wherein the printed circuit board comprises a first rising control resistor, a first falling control resistor, a second rising control resistor, and a second falling control resistor, wherein the first rising control resistor is electrically connected between the first rising setting pin and ground, and the first falling control resistor is electrically connected between the first falling setting pin and the ground, and wherein the second rising control resistor is electrically connected between the second rising setting pin and the ground, and the second falling control resistor is electrically connected between the second falling setting pin and the ground.

15. The display device according to claim 1, further comprising a level shifter configured to supply the m number of clock signals to the gate driving circuit, and a controller configured to control the gate driving circuit, wherein the m number of clock signals comprise a first clock signal and a second clock signal, wherein the level shifter comprises a first clock signal output pin, a second clock signal output pin, a control clock port, and a control data port, and wherein the level shifter configured to receive a control clock signal from the controller through the control clock port, and receive control data for controlling a signal waveform of each of the first clock signal and the second clock signal from the controller through the control data port.

16. A gate driving circuit comprising:

m number of output buffer circuits configured to output m number of gate signals based on m number of clock signals where m is a natural number of 2 or more; and a control circuit configured to control the m output buffer circuits, wherein each of the m number of output buffer circuits comprises a pull-up transistor and a pull-down transistor and a point at which the pull-up transistor and the pull-down transistor are connected is electrically connected with a corresponding gate line of the m number of gate lines, wherein all gate nodes of the pull-up transistors in the m number of output buffer circuits are electrically connected with one another, and all gate nodes of the pull-down transistors in the m number of output buffer circuits are electrically connected with one another, and wherein a signal waveform of at least one of the m number of clock signals is different from at least one of signal waveforms of at least one of other clock signals.

17. The gate driving circuit according to claim 16, wherein the m number of gate signals comprise a first gate signal having a turn-on level voltage duration at an earliest timing and an m-th gate signal having a turn-on level voltage duration at a latest timing, wherein the m number of clock signals comprises a first clock signal corresponding to the first gate signal, and an m-th clock signal corresponding to the m-th gate signal, and wherein a falling length of the first clock signal is greater than a falling length of the m-th clock signal.

18. The gate driving circuit according to claim 17, wherein a difference between a falling length of the first gate signal and a falling length of the m-th gate signal is smaller than a difference between the falling length of the first clock signal and the falling length of the m-th clock signal.

19. A level shifter comprising:

m number of clock output buffers configured to output m number of clock signals including first to m-th clock signals where m is a natural number of 2 or more, wherein each of the first and second clock signals among the first to m-th clock signals has a high level voltage duration partially overlap with each other, and wherein the first clock signal has a signal waveform different from at least one signal waveforms of at least one other clock signals among the m number of clock signals, wherein a falling length of the first clock signal of them number of clock signals is greater than a falling length of the m-th clock signal.

20. A display device comprising:

m number of gate lines disposed over a substrate where m is a natural number of 2 or more;

a gate driving circuit disposed over the substrate and configured to supply m number of gate signals based on m number of clock signals to the m number of gate lines;

a level shifter configured to supply the m number of clock signals to the gate driving circuit and including m number of clock output buffers configured to output the m number of clock signals including first to m-th clock signals; and a printed circuit board where the level shifter is disposed, wherein a falling length of the first clock signal of them number of clock signals is greater than a falling length of the m-th clock signal.

21. The display device according to claim 20, wherein the gate driving circuit comprises:

m number of output buffer circuits configured to output the m number of gate signals based on the m number of clock signals; and a control circuit configured to control the m number of output buffer circuits.

22. The display device according to claim 20, wherein each of the m number of output buffer circuits comprises:

a pull-up transistor;

a pull-down transistor; and a point at which the pull-up transistor and the pull-down transistor are connected, wherein the point is electrically connected with a corresponding gate line among the m number of gate lines.

23. The display device according to claim 22, wherein all gate nodes of the pull-up transistors included in the m number of output buffer circuits are electrically connected with one another, and all gate nodes of the pull-down transistors included in the m number of output buffer circuits are electrically connected with one another.

* * * * *